US006401804B1

(12) United States Patent
Shimoya et al.

(10) Patent No.: US 6,401,804 B1
(45) Date of Patent: Jun. 11, 2002

(54) HEAT EXCHANGER ONLY USING PLURAL PLATES

(75) Inventors: Masahiro Shimoya, Kariya; Ken Yamamoto, Obu, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/483,024

(22) Filed: Jan. 13, 2000

(30) Foreign Application Priority Data

Jan. 14, 1999 (JP) ..... 11-008146
Jan. 28, 1999 (JP) ..... 11-020519
May 27, 1999 (JP) ..... 11-148811

(51) Int. Cl.[7] ..... F28D 1/03; F28D 7/06

(52) U.S. Cl. ..... 165/70; 165/133; 165/148; 165/153; 165/176

(58) Field of Search ..... 165/148, 153, 165/166, 133, 70, 176

(56) References Cited

U.S. PATENT DOCUMENTS 4,932,469 A * 6/1990 Beatenbough ..... 165/153
5,050,671 A * 9/1991 Fletcher ..... 165/166
5,152,337 A * 10/1992 Kawakatsu et al. ..... 165/153
5,465,785 A * 11/1995 Adderley et al. ..... 165/166
5,692,559 A * 12/1997 Cheong ..... 165/148
5,720,340 A * 2/1998 Ohara et al. ..... 165/133
6,047,769 A * 4/2000 Shimoya et al. ..... 165/153

FOREIGN PATENT DOCUMENTS

JP 3-221789 * 9/1991 ..... 165/153
JP 4-131698 * 5/1992 ..... 165/153
JP 10-227544 8/1998

* cited by examiner

*Primary Examiner*—Leonard Leo
(74) *Attorney, Agent, or Firm*—Harness, Dickey & Pierce, PLC

(57) ABSTRACT

Plural heat-exchanging plates for forming an evaporator have plural projection ribs. The projection ribs protrude toward outside of each pair of the heat-exchanging plates to form therein refrigerant passages through which refrigerant flows, and to form an air passage between adjacent pairs of the heat-exchanging plates. The projection ribs protrude from flat surfaces of the heat-exchanging plates toward the air passage to disturb a straight flow of air. The projection ribs are provided in each of the heat-exchanging plates to have a protrusion pitch (P1) between adjacent two, and the protrusion pitch is set in a range of 2–20 mm. Further, each of the heat-exchanging plates has a thickness of in a range of 0.1–0.35 mm, and a passage pitch (P2) between the refrigerant passages is in a range of 1.4–3.9 mm. Thus, in the evaporator formed by only using the plural heat-exchanging plates, a sufficient heat-exchanging performance can be obtained.

33 Claims, 37 Drawing Sheets

12a
13
14 (19)
14 (20)
14a
16
16a
18
18a
19
20
39B
39C
39D
A
F
G
h 12b
14 (19)
14 (20)
140 (141)
40B
40C
40D
A
F
G
h
16
16a
18
18a
14
19
20

HEAT EXCHANGER ONLY USING PLURAL PLATES

CROSS-REFERENCE TO RELATED APPLICATION

This application is related to and claims priority from Japanese Patent Applications No. Hei. 11-8146 filed on Jan. 14, 1999, No. Hei. 11-20519 filed on Jan. 28, 1999, and No. Hei. 11-148811 filed on May 27, 1999, the contents of which are hereby incorporated by reference.

BACKGROUND OF THE INVENTION

1. Field of the Invention

The present invention relates to a heat exchanger formed by only using plural plates for defining inside fluid passages through which an inside fluid flows. The heat exchanger is suitably applied to a refrigerant evaporator for a vehicle air conditioner.

2. Description of Related Art

In a conventional refrigerant evaporator for a vehicle air conditioner, a corrugated fin having louvers for increasing heat-transmitting area is disposed between adjacent flat tubes each of which is formed into a hollow shape by connecting a pair of plates facing each other. In this case, when a flow rate of air passing through the corrugated fines becomes high, over-pressure loss may be caused. Therefore, in the conventional refrigerant evaporator, the flow rate of air passing through the corrugated fins is generally set to be lower. Thus, for improving heat-transmitting performance on an air side in the conventional refrigerant evaporator, top-end effect of the louvers is used so that a boundary layer is made thinner. In the recent years, because the louvers is made finer until a processing limit, processing steps become difficult. Further, because the corrugated fins are assembled between adjacent flat tubes, assembling performance of the refrigerant evaporator is deteriorated. That is, since a conventional heat exchanger needs corrugated fins, it is difficult to reduce the manufacturing cost and the size of the heat exchanger.

SUMMARY OF THE INVENTION

In view of the foregoing problems, it is an object of the present invention to provide a heat exchanger which is formed by only using plural heat-exchanging plates defining an inside fluid passage without using a fin member such as a corrugated fin, while having a sufficient heat-transmitting performance.

It is an another object of the present invention to provide a heat exchanger formed by only using plural heat-exchanging plates defining plural inside fluid passages, which readily detects an inside fluid leakage between the inside fluid passages.

It is a further another object of the present invention to provide a refrigerant evaporator formed by only using plural heat-exchanging plates defining an inside fluid passages, which prevents condensed water from scattering on a downstream air side thereof.

It is a further another object of the present invention to provide a heat exchanger formed by only using plural heat-exchanging plates defining an inside fluid passage, which has a reduced small size and is manufactured in low cost by thinning the heat-exchanging plates.

According to the present invention, a heat exchanger for performing a heat exchange between an inside fluid and an outside fluid includes plural pairs of heat-exchanging plates each having a plurality of projection ribs. Each pair of the heat-exchanging plates face each other in such a manner that, the projection ribs protrude outwardly to form therein an inside fluid passage through which the inside fluid flows, and to form an outside fluid passage through which the outside fluid flows between adjacent pairs of the heat-exchanging plates. Further, the projection ribs protrude from flat surfaces of the heat-exchanging plates to the outside fluid passage to disturb a flow of the outside fluid, the projection ribs are provided in each of the heat-exchanging plates to have a protrusion pitch (P1) between adjacent two, and the protrusion pitch is in a range of 2–20 mm. Thus, even in the heat exchanger without a fin member, a straight line flow of outside fluid is disturbed by the protrusion outer portions of the projection ribs, and a necessary heat-exchanging effect is obtained. Further, because the heat exchanger is formed only by using the heat-exchanging plates, the heat exchanger is manufactured in low cost, and a size of the heat exchanger is reduced. Further, because the protrusion pitch is set in the range of 2–20 mm, heat-exchanging performance of the heat exchanger is effectively improved.

Preferably, adjacent pairs of the heat-exchanging plates are provided to have a passage pitch (P2) which is a distance between the inside fluid passages of the adjacent pairs of the heat-exchanging plates, and the passage pitch is in a range of 1.4–3.9 mm. Therefore, the heat-exchanging performance of the heat exchanger is improved while the pressure loss in the outside fluid passage is restricted in a predetermined range.

More preferably, the protrusion pitch is set in a range of 10–20 mm, and the passage pitch is set in a range of 1.4–2.3 mm. Therefore, the heat-exchanging performance is further effectively improved.

Further, adjacent pairs of the heat-exchanging plates have a clearance therebetween to form the outside fluid passage, and the clearance is in a range of 0.7–1.95 mm. The inside fluid passages are provided inside the projection ribs by connecting each pair of the heat-exchanging plates. On the other hand, each of the heat-exchanging plates has a plate thickness, and the plate thickness is in a range of 0.1–0.35 mm. Thus, the heat-exchanging plate is made thinner, the weight of the heat exchanger is reduced, and heat-exchanging performance per volume is improved.

Preferably, the projection ribs extend in an up-down direction approximately perpendicular to a flow direction of the outside fluid. Therefore, when the heat exchanger is used as an evaporator, condensed water generated on protrusion top surfaces of the projection ribs is smoothly discharged downwardly. Thus, draining performance of condensed water is improved in the evaporator, and air-flow resistance is prevented from increasing due to condensed water on the protrusion top surfaces of the projection ribs.

Further, the inside fluid passages of the heat exchanger are partitioned into a first inside fluid passage group and a second inside fluid passage group in the flow direction of the outside fluid, each pair of the heat exchanging plates have an inner leakage-detecting projection rib between the first inside fluid passage group and the second inside fluid passage group in the flow direction of the outside fluid, the inner leakage-detecting projection rib extends along the projection ribs, and the inner leakage-detecting projection rib has therein an inner leakage-detecting passage opened to an outside. Therefore, when an inner leakage is generated in the heat exchanger so that the first inside fluid passage group and the second inside fluid passage group communicate with each other, the inside fluid is discharged to an outside from the inner leakage-detecting passage. Thus, an inner leakage is simply and accurately detected.

Preferably, each of the heat-exchanging plates is composed of an aluminum core layer, a brazing layer clad on one surface of the aluminum core layer, and a sacrifice corrosion layer clad on the other surface of the aluminum core layer. Further, each pair of the heat-exchanging plates are connected by bonding the flat surfaces to each other through brazing using the brazing layer. Thus, the heat-exchanging plates becomes thinner, and are manufactured in low cost.

More preferably, the inside fluid passages are partitioned into a first inside fluid passage group and a second inside fluid passage group in the flow direction of the outside fluid, the heat-exchanging plates have tank portions at an end side in an extending direction of the projection ribs, the tank portions protrude from the flat surfaces to form communication holes, the tank portions are partitioned into a first tank member and a second tank member at an upstream side of the first tank member in the flow direction of the outside fluid. The first tank member communicates with the first inside fluid passage group and the second tank member communicates with the second inside fluid passage group. Further, the first tank member has a dimension in the up-down direction smaller than that of the second tank member. Thus, within the heat exchanger, a downstream flow area is enlarged as compared with an upstream flow area in the flow direction of the outside fluid. Accordingly, when the heat exchanger is used as a refrigerant evaporator so that air passing through the evaporator is cooled, it can effectively prevent condensed water from scattering to a downstream air side from a downstream air end of the evaporator.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
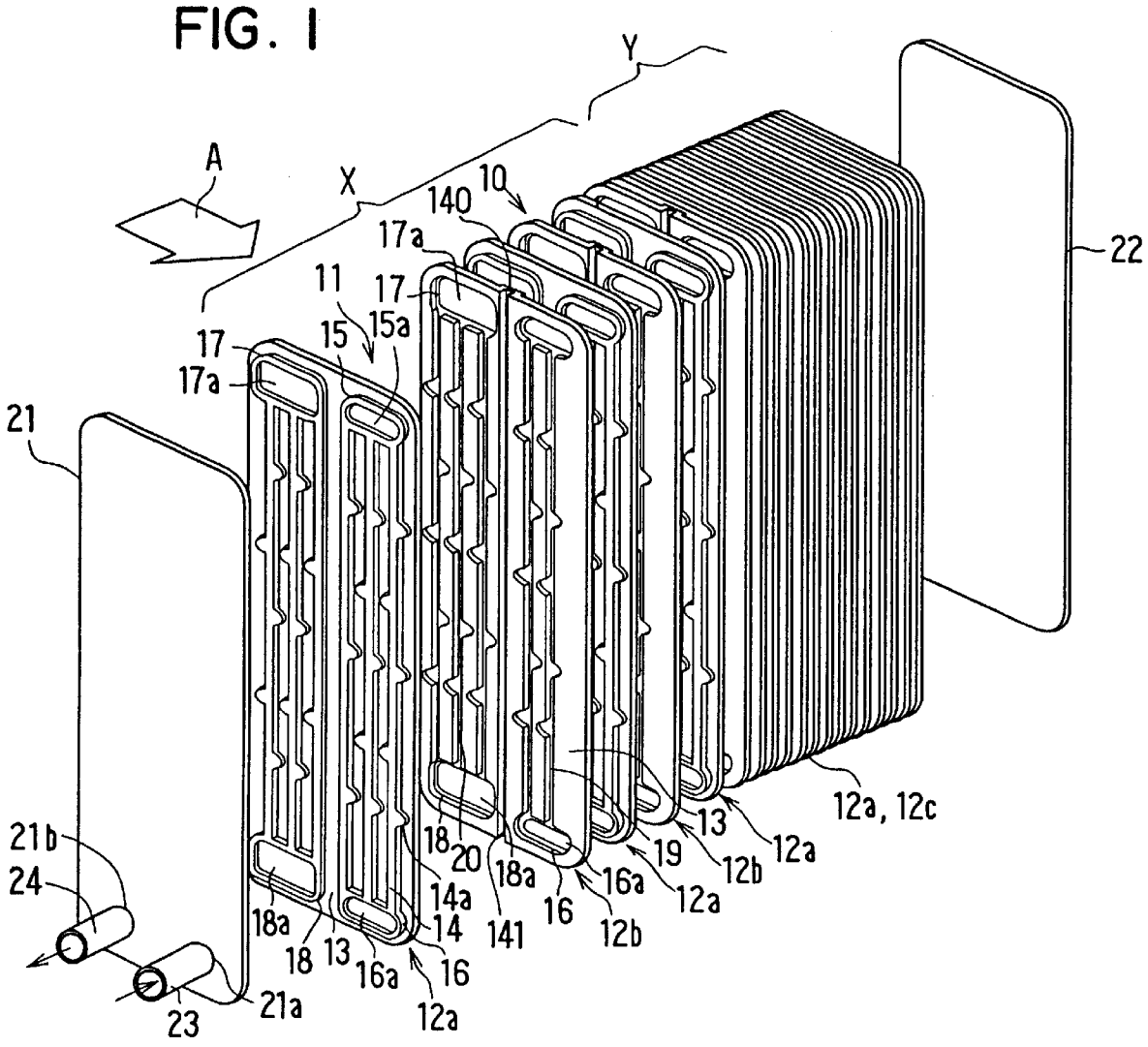
FIG. 1 is a disassembled perspective view showing an evaporator according to a first preferred embodiment of the present invention.
Figure 2:
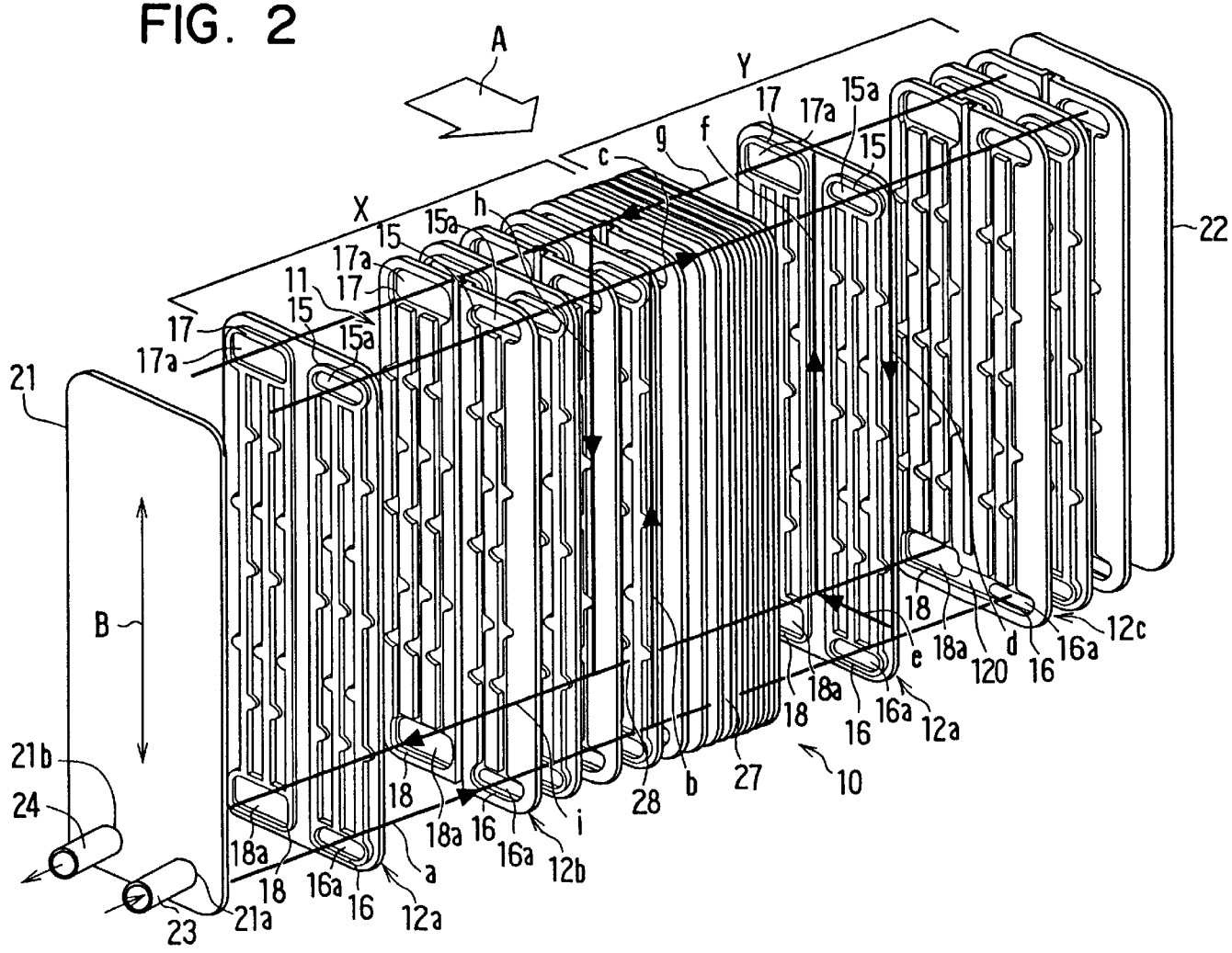
FIG. 2 is a disassembled perspective view showing a refrigerant passage of the evaporator according to the first embodiment.

A first preferred embodiment of the present invention will be now described with reference to FIGS. 1–7. In the first embodiment, the present invention is typically applied to a refrigerant evaporator for a vehicle air conditioner. However, the present invention can be applied to an any heat exchanger for performing a heat-exchange. As shown in FIGS. 1, 2, the evaporator 10 is disposed so that an air-flowing direction A is approximately perpendicular to a refrigerant-flow direction B shown in FIG. 2. The evaporator 10 includes a core portion 11 for performing a heat-exchange between air (i.e., outside fluid) and refrigerant (i.e., inside fluid), which is formed by laminating plural heat-exchanging plates 12*a*, 12*b*, 12*c* in a laminating direction.

That is, in the first embodiment, the core portion 11 is constructed by a heat-exchanging area X (i.e., left area X) and a heat-exchanging area Y (i.e., right area Y). The left area X is formed by combining plural first heat-exchanging plates 12*a* shown in FIG. 3 and plural second heat-exchanging plates 12*b* shown in FIG. 4. On the other hand, the right area Y is formed by combining plural first heat-exchanging plates 12*a* shown in FIG. 3 and plural third heat-exchanging plates 12*c* shown in FIG. 5.

Figure 3:
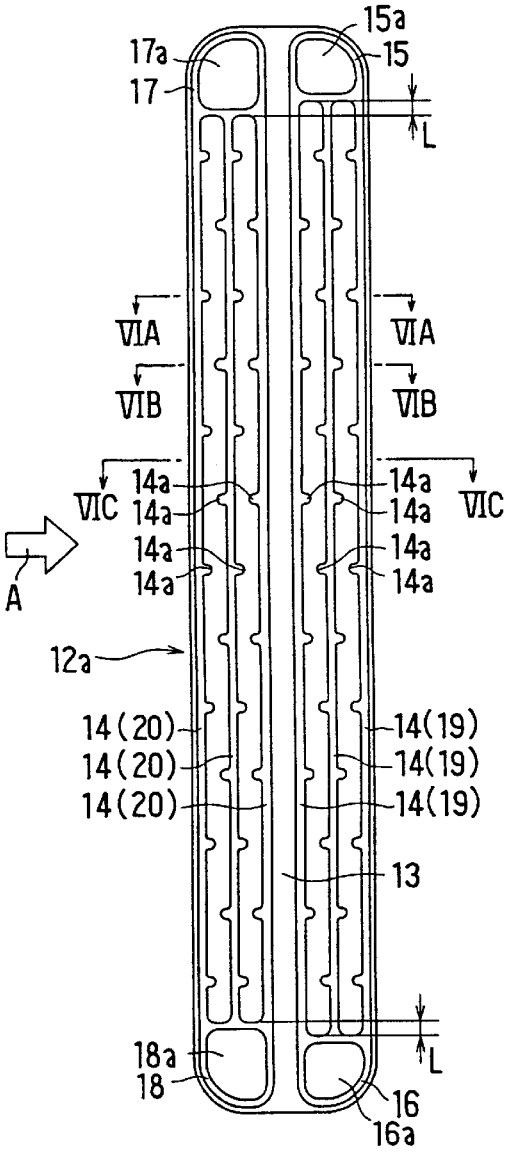
FIG. 3 is a plan view of a first heat-exchanging plate according to the first embodiment.
Figure 4:
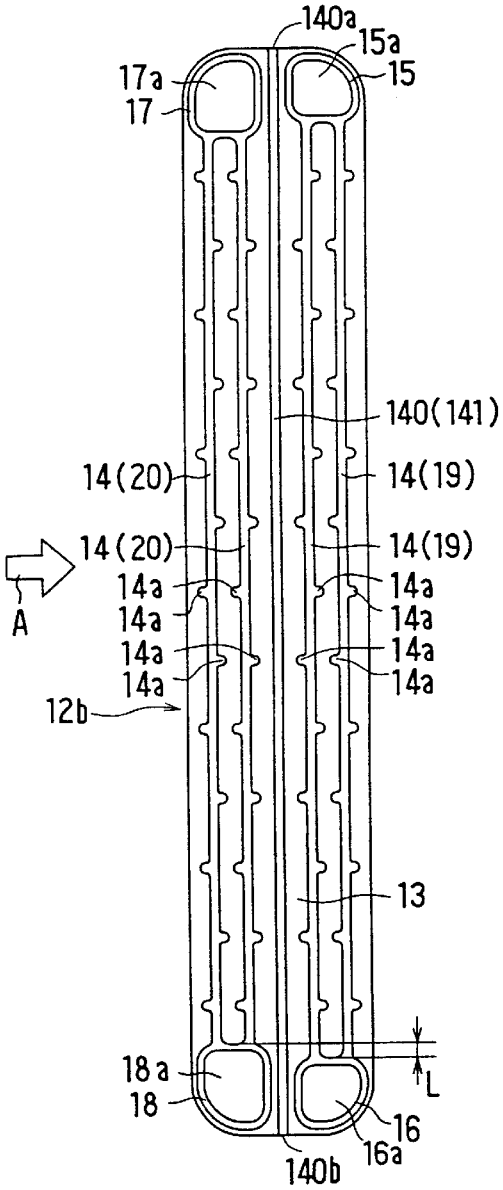
FIG. 4 is a plan view of a second heat-exchanging plate according to the first embodiment.
Figure 5:
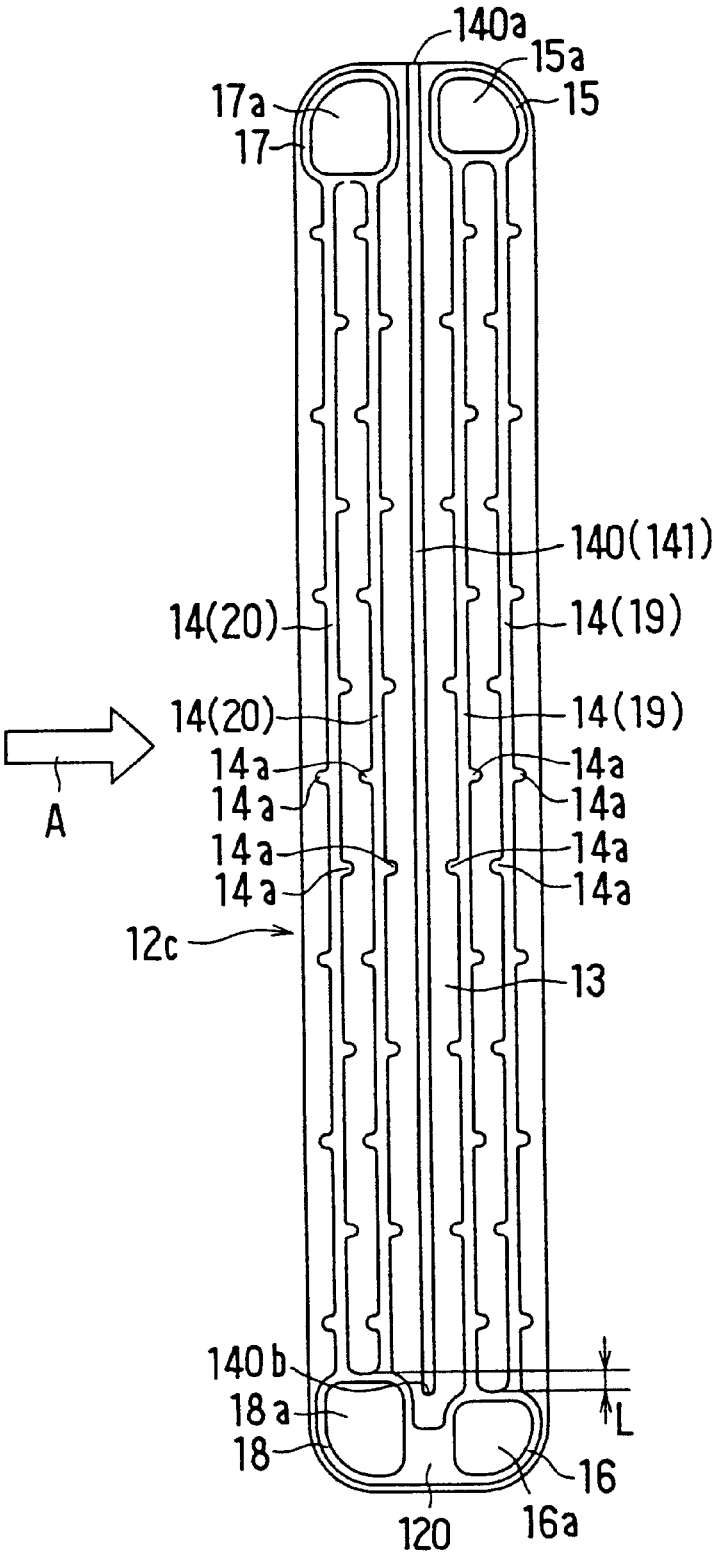
FIG. 5 is a plan view of a third heat-exchanging plate according to the first embodiment.

Each of the heat-exchanging plates 12*a*, 12*b*, 12*c* is a both-surface clad thin plate which is formed by cladding an aluminum brazing material (e.g., A4000) on both surfaces of an aluminum core material (e.g., A3000). The thin plate is press-formed to have a plate thickness "t" in a range of 0.1–0.4 mm. As shown in FIGS. 3–5, each of the heat-exchanging plates 12*a*, 12*b*, 12*c* is approximately formed into a rectangular plan shape to have the same outer peripheral shape. For example, the rectangular plan shape has a longitudinal length of about 245 mm, and a lateral width of about 45 mm. However, inner detail shapes of the heat-exchanging plates 12*a*, 12*b*, 12*c* are different from each other for some reasons such as a refrigerant passage formation, an evaporator assembly, a brazing structure of the evaporator and a discharge of condensed water.

Figure 6A:
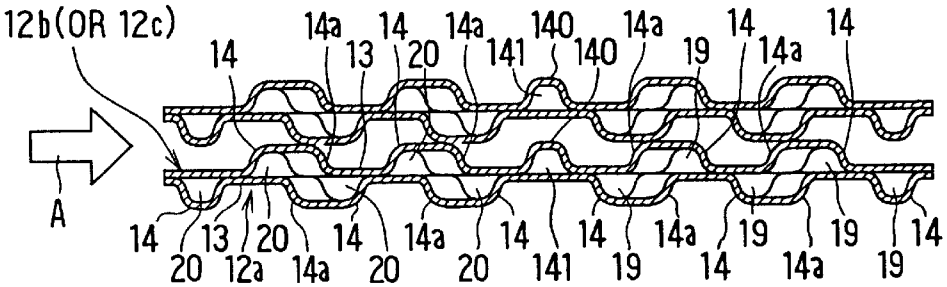
FIG. 6A is a cross-sectional view taken along line VIA—VIA in FIG. 3.
Figure 6B:
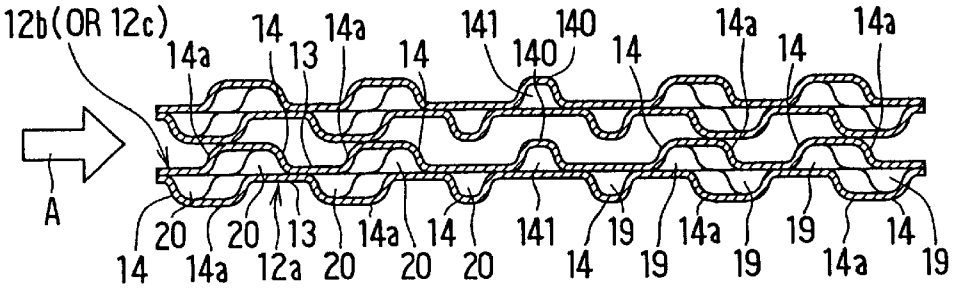
FIG. 6B is a cross-sectional view taken along line VIB—VIB in FIG. 3.
Figure 6C:
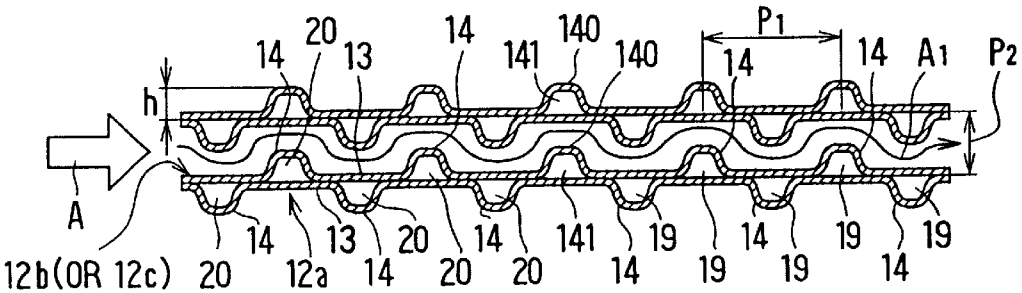
FIG. 6C is a cross-sectional view taken along line VIC—VIC in FIG. 3, after the first heat-exchanging plate and the second or third heat-exchanging plate are laminated according to the first embodiment.

As shown in FIGS. 3–5, in each of the heat-exchanging plates 12*a*, 12*b*, 12*c*, projection ribs 14 project from a flat base plate 13 toward a back side in a face-back direction in FIGS. 3–5. The projection ribs 14 are provided for defining therein refrigerant passages (inner fluid passage) 19, 20 through which low-pressure refrigerant having passed through a pressure-reducing unit (e.g., expansion valve) of a refrigerant cycle flows. The heat-exchanging plates 12*a*, 12*b*, 12*c* continuously extend in a longitudinal direction in parallel with each other to be approximately perpendicular to the air-flowing direction A. Further, as shown in FIGS. 6A, 6B, 6C, each projection rib 14 has a substantially trapezoidal sectional shape. Each first heat-exchanging plate 12*a* has six projection ribs 14 extending in the plate longitudinal direction as shown in FIG. 3, each second heat-exchanging plate 12*b* has four projection ribs 14 extending in the plate longitudinal direction as shown in FIG. 4, and each third heat-exchanging plate 12*c* has four projection ribs 14 extending in the plate longitudinal direction as shown in FIG. 5.

Further, a projection rib 140 for detecting an inner refrigerant leakage is formed at a center portion in each of the second and third heat-exchanging plates 12*b*, 12*c* in the width direction. The projection rib 140 has a shape similar to the projection rib 14. However, in the second heat-exchanging plate 12*b*, for detecting the inner refrigerant leakage, an inner leakage-detecting passage 141 of the projection rib 140 is opened outside the evaporator 10 (heat exchanger) at both ends 140*a*, 140*b* in the longitudinal direction (hereinafter, the ends 140*a*, 140*b* are referred to as longitudinal ends 140*a*, 140*b*". That is, in the second heat-exchanging plate 12*b*, the projection rib 140 extends to both longitudinal ends 140*a*, 140*b* so that the inner-leakage detecting passage 140 is opened outside the evaporator 10. On the other hand, as shown in FIG. 5, in the third heat-exchanging plate 12*c*, only one longitudinal end 140*a* of the projection rib 140 is opened outside the evaporator 10, and the other longitudinal end 140*b* thereof extends to a position proximate to a tank portion to be closed. In the first embodiment, each of the projection ribs 14, 140 has the same protrusion height protruding from the flat base plate 13, as shown in FIGS. 6A, 6B, 6C.

In the first embodiment, the first heat-exchanging plate 12*a* has six projection ribs 14, and each of the second and third heat-exchanging plates 12*b*, 12*c* has four projection ribs 14 and one projection rib 140. When the first heat-exchanging plate 12*a* and the second heat-exchanging plate 12*b* are connected, both the flat base plates 13 of the first and second heat-exchanging plates 12*a*, 12*b* contact, while the projection ribs 14 of the first heat-exchanging plate 12*a* and the projection ribs 14, 140 of the second heat-exchanging plate 12*b* protrude toward an outer side. In this case, the projection ribs 14, 140 of the second heat-exchanging plate 12 are placed between the projection ribs 14 of the first heat-exchanging plate 12*a* in the plate width direction.

Similarly, when the first heat-exchanging plate 12*a* and the third heat-exchanging plate 12*b* are connected, both the flat base plates 13 of the first and third heat-exchanging plates 12*a*, 12*c* contact, while the projection ribs 14 of the first heat-exchanging plate 12*a* and the projection ribs 14, 140 of the third heat-exchanging plate 12*b* protrude toward an outer side. In this case, the projection ribs 14, 140 of the third heat-exchanging plate 12 are placed between the projection ribs 14 of the first heat-exchanging plate 12*a* in the plate width direction.

Further, when both the flat base plates 13 of the first heat-exchanging plate 12*a* and the second or third heat-exchanging plate 12*b*, 12*c* contact, inner recess sides of the projection ribs 14, 140 of the second or third heat-exchanging plate 12*b*, 12*c* are closed by the flat base plate 13 of the first heat-exchanging plate to form therein a refrigerant passage, and inner recess sides of the projection ribs 14 of the first heat-exchanging plate 12*a* are closed by the flat base plate 13 of the second or third heat-exchanging plate 12*b*, 12*c* to form therein a refrigerant passage.

That is, in the plate width direction of the heat-exchanging plates 12*a*, 12*b*, 12*c*, a first refrigerant passage 19 is formed within the projection ribs 14 placed a downstream air side from a center portion i.e., the position where the projection rib 140 for detecting a refrigerant leakage is provided. On the other hand, in the plate width direction of the heat-exchanging plates 12*a*, 12*b*, 12*c*, a second refrigerant passage 20 is formed within the projection ribs 14 placed an upstream air side from the center portion. Further, the inner leakage-detecting passage 141 for detecting an inner refrigerant leakage is formed inside the projection rib 140 at the center portion.

Thus, as shown in FIGS. 6A–6C, five first refrigerant passages 19 and five second refrigerant passages 20 are respectively formed in parallel with each other between the first heat-exchanging plate 12*a* and the second heat-exchanging plate 12*b*, and are respectively formed in parallel with each other between the first heat-exchanging plate 12*a* and the third heat-exchanging plate 12*c*.

Figure 7:
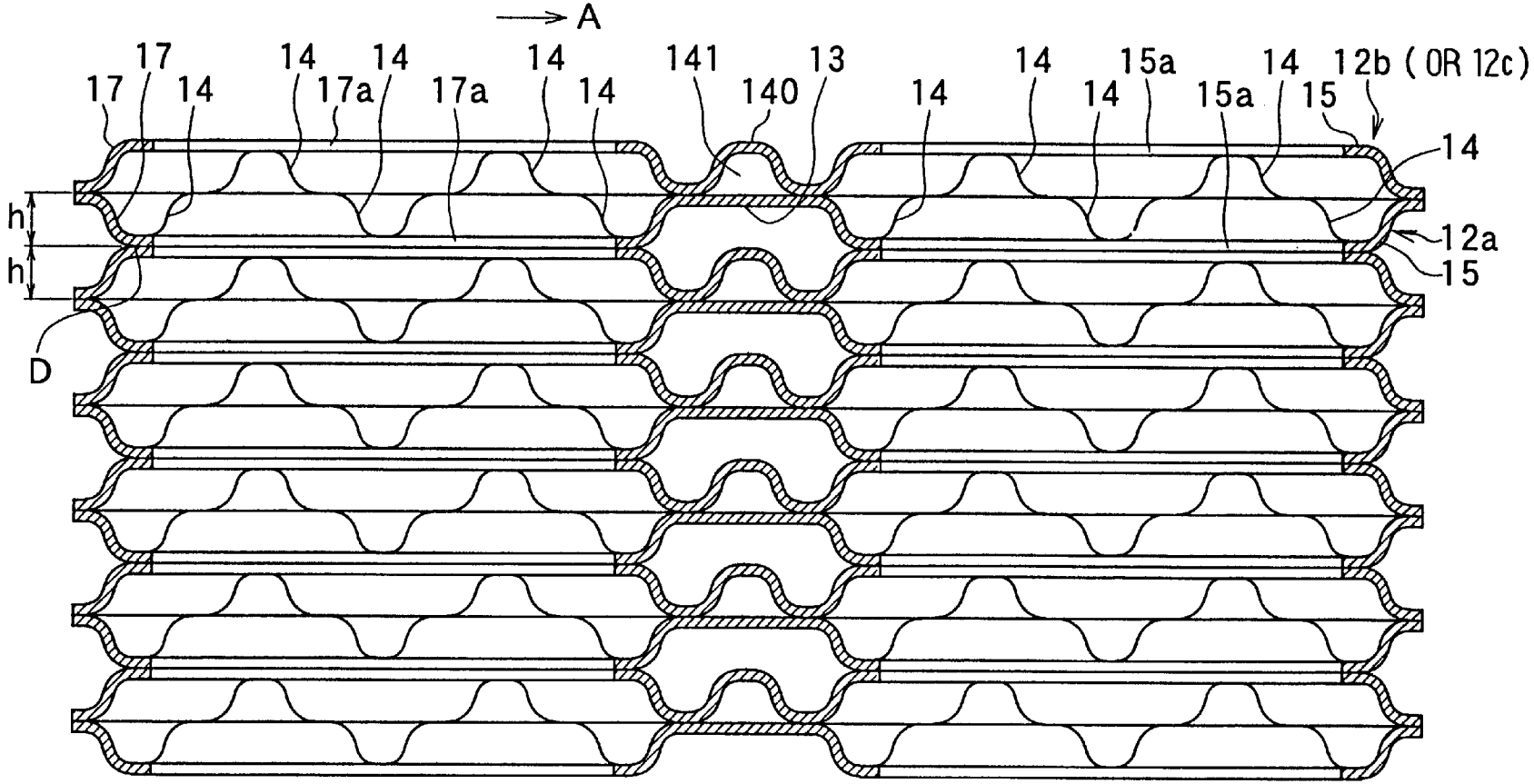
FIG. 7 is a sectional view showing a tank portion according to the first embodiment.

Further, tank portions 15–18 are formed at both end portions of each heat-exchanging plate 12*a*, 12*b*, 12*c* in the plate longitudinal direction perpendicular to the air-flowing direction A. Further, in the both end portions of each heat-exchanging plate 12*a*, 12*b*, 12*c*, the upper tank portions 15, 17 are separated in the plate width direction, and the lower tank portions 16, 18 are separated in the plate width direction. As shown in FIG. 7, the tank portions 15–18 are protruded in the same direction as the projection ribs 14, 140 by the same protrusion height "h".

In the first embodiment, the tank portions 15–18 protrude in the same direction as the projection ribs 14 to form inner recess shapes therein, and inner recess shapes due to the protrusion of the projection ribs 14 at both ends in the plate longitudinal direction are formed to be continued to the inner recess shapes of the tank portions 15–18. Therefore, both end portions of the first refrigerant passage 19 communicate with the tank portions 15, 16 on a downstream air side, and both end portions of the second refrigerant passage 20 communicate with the tank portions 17, 18 on an upstream air side.

Further, the tank portions 15, 17 placed at an upper end side are partitioned from each other in the plate width direction, and the tank portions 16, 18 placed at a lower end side are also partitioned from each other in the plate width direction. Therefore, as shown in FIGS. 3–5, each punched shape of the tank portions 15–18 is formed into an approximate D-shape. However, each punched shape of the tank portions 15–18 may be formed into an oval shape as shown in FIGS. 1, 2.

Because communication holes 15*a*–18*a* are respectively opened in the tank portions 15–18, the tank portions 15–18 communicate with each other between adjacent heat-exchanging plates 12*a*, 12*b*, 12*c* in the right-left direction in FIGS. 1, 2 (i.e., the laminating direction of the heat-exchanging plates) through the communication holes 15*a*–18*a*. That is, as shown in FIG. 7, protrusion top end portions of each tank portion 15–18 in the heat-exchanging plates 12*a*, 12*b*, 12*c* protrude in the laminating direction of the heat-exchanging plates 12*a*, 12*b*, 12*c* by a protrusion height "h", and adjacent protrusion top end portions of the tank portions 15–18 contact in the laminating direction to be connected to each other so that the communication holes 15*a*–18*a* are formed.

As shown in FIG. 5, in the third heat-exchanging plate 12*c*, the lower end 140*b* (the other end) of the projection rib 140 extends until the position proximate to the tank portions 16, 18 to not continuously extend. The center portion between the both tank portions 16, 18 protrudes together the same direction as the tank portions 16, 18 to form a communication passage 120 through which the communication holes 16*a*, 18*a* of both the tank portions 16, 18 directly communicate with each other.

As shown in FIGS. 3–5, in each of the first, second and third plates 12*a*–12*c*, each of the downstream-air side tank portions 15, 16 has a dimension (height) in the plate longitudinal direction, smaller than that of the upstream side tank portions 17, 18 by a predetermined dimension L, so that an air-flowing area in the downstream side of the core portion 11 is increased as compared with the upstream air side of the core portion 11.

Plural small protrusions 14*a* each of which protrudes from a side surface of each projection rib 14 in the plate width direction are formed in each of the heat-exchanging plates 12*a*–12*c*. At the same position of the projection ribs 14 in the plate longitudinal direction, the small protrusions 14*a* are provided by plural number.

In each of the second and third heat-exchanging plates 12*b*, 12*c*, the small protrusions 14*a* are provided in each projection rib 14 to alternately protrude reversely in the plate width direction. On the other hand, in each first heat-exchanging plate 12*a*, the small protrusions 14*a* protrude from each projection rib 14 to face corresponding protrusions 14 of the second or third heat-exchanging plate 12*b*, 12*c* in the plate width direction. Therefore, protrusions 14*a* between the first and second heat-exchanging plates 12*a*, 12*b* or between the first and third heat-exchanging plates 12*a*, 12*c* contact to have a contact portion. Thus, the first and second heat-exchanging plates 12*a*, 12*b* or the first and third heat-exchanging plates 12*a*, 12*c* are bonded while pushing pressure of the heat-exchanging plates 12*a*–12*c* is applied to the contact portion of the protrusions 14.

In a case where the protrusions 14*a* protruding from the projection ribs 14 toward the plate width direction are not provided, only protrusion tops of the tank portions 15–18 contact in the plate longitudinal direction of each heat-exchanging plates 12*a*–12*c*, and therefore, a contact portion is not provided at any middle position of the heat-exchanging plates 12*a*–12*c* in the plate longitudinal direction. That is, in this case, all middle portion of the heat-exchanging plates 12*a*–12*c* in the plate longitudinal direction is formed as shown in FIG. 6C.

However, according to the present invention, as shown in FIGS. 6A, 6B, the contact portion of the protrusions 14*a* is formed in a middle position of the heat-exchanging plates 12*a*, 12*b*, 12*c* in the plate longitudinal direction. Therefore, the pushing pressure of the heat-exchanging plates 12*a*–12*c* is applied to the middle position in the plate longitudinal direction so that the flat base plates 13 of the heat-exchanging plates 12*a*–12*c* can effectively contact by using the pushing pressure. Thus, contact surfaces of the flat base plates 13 are accurately brazed, and a refrigerant leakage from the refrigerant passages 19, 20 is prevented.

As shown in FIG. 6C, the positions of the projection ribs 14, 140 of adjacent heat-exchanging plates 12*a*–12*c* are set to be offset in the plate width direction (i.e., the air-flowing direction A), so that opened inner portions of the projection ribs 14, 140 of one heat-exchanging plate 12*a*, 12*b*, 12*c* are closed by the flat base plate 13 of an adjacent heat-exchanging plate 12*a*, 12*b*, 12*c* to form the refrigerant passages 19, 20.

On the other hand, protrusion top surfaces of the projection ribs 14, 140 of the one heat-exchanging plate 12*a*, 12*b*, 12*c* are placed to face the flat base plate 13 of the other adjacent heat exchanging plate 12*a*, 12*b*, 12*c*. Therefore, a clearance is formed between the protrusion top surfaces of the protrusions 14, 140 in the one heat-exchanging plate 12*a*, 12*b*, 12*c* and the flat base plate 13 of the other adjacent heat-exchanging plate 12*a*, 12*b*, 12*c* to form an air passage. The clearance has a dimension in the laminating direction, which is obtained by subtracting a plate thickness from the protrusion height "h" of the projection ribs 14. Therefore, an air passage is continuously formed in the core portion 11 in the whole length in the plate with direction (i.e., the air-flowing direction A) into a wave like, as shown by "A1" in FIG. 6C. Thus, air passes through between the first and second heat-exchanging plates 12*a*, 12*b* or between the first and third heat-exchanging plates 12*a*, 12*c* in a wave like, as shown by arrow A1.

Referring back to FIGS. 1, 2, end plates 21, 22 having the same size as the heat-exchanging plates 12*a*, 12*b*, 12*c* are disposed at both sides of the core portion 11 in the laminating direction of the heat-exchanging plates 12*a*, 12*b*, 12*c*. Each of the end plates 21, 22 is formed into a flat plate shape, and contacts the protrusion sides of the projection ribs 14 and the tank portions 15–18 of the outermost first heat-exchanging plate 12*a* in the laminating direction.

A refrigerant inlet hole 21*a* and a refrigerant outlet hole 21*b* are opened in the left-side end plate in FIGS. 1, 2. The refrigerant inlet hole 21*a* communicates with the communication hole 16*a* of the downstream side tank portion 16 of the outermost first heat-exchanging plate 12*a*, and the refrigerant outlet hole 21*b* communicates with the communication hole 18*a* of the upstream side tank 18 of the outermost first heat-exchanging plate 12*a*. Further, a refrigerant inlet pipe 23 and a refrigerant outlet pipe 24 are respectively connected to the refrigerant inlet hole 21*a* and the refrigerant outlet hole 21*b* of the end plate 21.

Because the end plate 21 is connected to the outermost first heat-exchanging plate 12*a* and the inlet and outlet pipes 23, 24, the end plate 21 is made of a both-surface clad material which is formed by cladding an aluminum brazing material (e.g., A4000) on both surfaces of an aluminum core material (e.g., A3000), similarly to the heat-exchanging plates 12*a*, 12*b*, 12*c*. On the other hand, because the end plate 22 is connected to only the outermost first heat-exchanging plate 12*a*, the end plate 22 is made of a single-surface clad material which is formed by cladding an aluminum brazing material (e.g., A4000) on a single surface of an aluminum core material (e.g., A3000). Further, each of the end plates 21, 22 has a plate thickness "t" (e.g., t=1.0 mm) thicker than that of the heat-exchanging plates 12*a*, 12*b*, 12*c*. Therefore, the strength of the core portion 11 of the evaporator 10 is improved in the first embodiment.

Gas-liquid two phase refrigerant decompressed in a decompressing unit such as an expansion valve flows into the refrigerant inlet pipe 23, and the refrigerant outlet pipe 24 is connected to a suction side of a compressor (not shown) so that gas refrigerant evaporated in the evaporator 10 is introduced into the suction side of the compressor.

In the heat-exchanging plates 12*a*, 12*b*, 12*c* of the evaporator 10, the first refrigerant passage 19 on the downstream air side is used as an inlet side refrigerant passage among an entire refrigerant passage of the evaporator 10 because refrigerant from the refrigerant inlet pipe 23 flows into the first refrigerant passage 19. On the other hand, the second refrigerant passage 20 on the upstream air side is used as an outlet side refrigerant passage among the entire refrigerant passage of the evaporator 10 because refrigerant from the first refrigerant passage 19 flows into the second refrigerant passage 20 and further flows into the refrigerant outlet pipe 24.

Next, the entire refrigerant passage of the evaporator 10 will be described with reference to FIG. 2. In the half left area X on the side of the end plate 21 in the laminating direction of the heat-exchanging plates 12*a*, 12*b*, 12*c*, plural pairs each of which is formed by assembling both of the first and second heat-exchanging plates 12*a*, 12*b* are laminated. On the other hand, in the half right area Y on the side of the end plate 22, plural pairs each of which is formed by assembling both of the first and third heat-exchanging plates 12*a*, 12*c* are laminated. Thereafter, the heat-exchanging plates 12*a*, 12*b*, 12*c* are brazed to form the core portion 11.

Further, in the tank portions 15–18 placed at upper and lower sides of the evaporator 10, the downstream-air side tank portions 15, 16 are used as a refrigerant-inlet side tank, and the upstream-air side tank portions 17, 18 are used as a refrigerant outlet side tank. A partition member 27 is disposed in the refrigerant tank portion 16 at a middle position (i.e., a boundary portion between the area X and the area Y) in the laminating direction of the heat-exchanging plates 12*a*, 12*b*, 12*c* so that the tank portion 16 is partitioned into a left side tank passage and a right side tank passage in FIG. 2.

Similarly, a partition member 28 is disposed in the refrigerant tank portion 18 at a middle position (i.e., the boundary portion between the area X and the area Y) in the laminating direction of the heat-exchanging plates 12*a*, 12*b*, 12*c* so that the tank portion 18 is also partitioned into a left side tank passage and a right side tank passage in FIG. 2. Among the heat-exchanging plates 12*a*–12*c*, only in the heat-exchanging plates corresponding the position of the partition members 27, 28, the communication holes 15*a*, 18*a* of the tank portions 15, 18 are closed to form the partition members 27, 28.

In the evaporator 10 according to the first embodiment, gas-liquid two-phase refrigerant decompressed in the expansion valve flows into the refrigerant inlet-side tank portion 16 from the refrigerant inlet pipe 23 as shown by arrow "a" in FIG. 2. Because the passage of the tank portion 16 is partitioned by the partition member 27 into the right side tank passage and the left side tank passage, refrigerant introduced from the refrigerant inlet pipe 23 only flows into the left side tank passage of the tank portion 16.

Thereafter, in the left area X, refrigerant flows through the first refrigerant passage 19 upwardly toward the inlet-side tank portion 15 as shown by arrow "b" in FIG. 2. Then, refrigerant flows in the refrigerant inlet-side tank portion 15 toward rightwardly and flows into the right area Y as shown by arrow "c" in FIG. 2, and further flows downwardly through the first refrigerant passage 19 in the right area Y into the right side tank passage of the tank portion 16 as shown by arrow "d" in FIG. 2.

Because the communication passage 120 is formed between the lower tank portions 16, 18 of each third heat-exchanging plates 12*c*, refrigerant in the right side tank passage of the tank portion 16 flows into the right side tank passage of the tank portion 18 through the communication passage 120 in the right area Y, as shown by arrow "e" in FIG. 2. Here, the right side tank passage of the tank portion 18 is partitioned from the left side tank passage of the tank portion 18 by the partition member 28. Therefore, refrigerant from the right side tank passage of the tank portion 16 only flows into the right side tank passage of the tank portion 18 through the communication passage 120. Next, refrigerant in the right side tank passage of the tank portion 18 flows upwardly into the tank portion 17 in the right area Y through the second refrigerant passage 20, as shown by arrow "f" in FIG. 2.

Next, refrigerant in the refrigerant tank 17 flows from the right side toward the left side as shown by arrow "g" in FIG. 2. Thereafter, refrigerant flows through the second refrigerant passage 20 in the left area X downwardly from the tank portion 17 into the left side tank passage of the tank portion 18, as shown by arrow "h" in FIG. 2. Further, refrigerant flows through the left side tank passage of the tank portion 18 as shown by arrow "i" in FIG. 2, and flows outside the evaporator 10 from the refrigerant outlet pipe 24.

In the first embodiment, construction members of the evaporator 10, shown in FIGS. 1, 2, are laminated while in a contacting state to be connected to each other. The assembly of the construction members is moved into a furnace while being supported by a jig, and is heated to the melting point of the brazing material. Thus, the construction members are integrally brazed to form the evaporator 10.

According to the first embodiment, because the small protrusions 14*a* are formed in the heat-exchanging plates 12*a*, 12*b*, 12*c*, the protrusions 14*a* contact each other at the contact portions by contacting adjacent the first and second heat-exchanging plates 12*a*, 12*b* or by contacting adjacent the first and third heat-exchanging plates 12*a*, 12*c*. Therefore, the pushing pressure in the laminating direction is applied to the contact portions of the protrusions 14*a* by the jig, and the heat-exchanging plates 12*a*–12*c* can be bonded to each other through the contact portions of the protrusions 14*a*.

Thus, the pushing pressure is also applied to a middle position of the heat-exchanging plates 12*a*, 12*b*, 12*c* in the plate longitudinal direction, in addition to the tank portion 15–18. Accordingly, the flat base plates 13 between adjacent heat-exchanging plates 12*a*, 12*b*, 12*c* contact accurately in an entire area. Therefore, the contact portions between the flat base plates 13 can be sufficiently accurately brazed, and a refrigerant leakage from the first and second refrigerant passages 19, 20 is prevented.

An outside refrigerant leakage from the evaporator 10 is checked by the following method. That is, the evaporator 10 after brazing is disposed in a sealed compartment, one of the refrigerant inlet pipe 23 and the refrigerant outlet pipe 24 is closed by a suitable cover, and an examination fluid (e.g., helium gas) is supplied to the refrigerant passage of the evaporator 10 by a predetermined pressure from the other one of the refrigerant inlet pipe 23 and the refrigerant outlet pipe 24, so that a fluid leakage from the evaporator 10 into the sealed chamber is checked. In an inferior evaporator where the contacting surfaces at the outer peripheral portions between the flat base plates 13 of the heat-exchanging plates 12*a*, 12*b*, 12*c* are not sufficiently bonded and brazed, because the examination fluid is directly leaked outside the evaporator, the interior evaporator is readily checked by using the above-examination method.

However, when contacting surfaces of the flat base plates 13 placed at a center position of the heat-exchanging plates 12*a*, 12*b*, 12*c* in the plate width direction is insufficiently bonded and brazed, an inner refrigerant leakage where the first refrigerant passage 19 and the second refrigerant passage 20 directly communicate with each other is caused. In this case, it is impossible to detect the inner refrigerant leakage of the evaporator by the above-examination method.

According to the first embodiment of the present invention, the projection rib 140 for detecting an inner leakage of refrigerant is provided at a center in each flat base plate 13 of the second and third heat-exchanging plates 12*b*, 12*c* in the plate width direction. Further, the inner leakage-detecting passage 141 provided inside the projection rib 140 of the second heat-exchanging plate 12*b* is opened outside the evaporator 10 at both longitudinal ends 140*a*, 140*b*, and the inner leakage-detecting passage 141 provided inside the projection rib 140 of the third heat-exchanging plate 12*c* is opened outside the evaporator 10 only at the longitudinal end 140*a* (upper end). In the third heat-exchanging plate 12*c*, at the other longitudinal end 140*b*, the inner leakage-detecting passage 141 is not opened outside the evaporator 10. Thus, when an inner leakage of refrigerant within the refrigerant passage of the evaporator 10 is caused, an examination fluid is leaked outside the evaporator 10 through the inner leakage-detecting passage 141 of the projection rib 140.

Next, operation of the evaporator 10 according to the first embodiment will be described. In the first embodiment, the evaporator 10 is disposed in an air conditioning case in such a manner that an up-down direction of the evaporator 10 corresponds to the up-down direction in FIGS. 1, 2. Air is blown by a blower unit toward the evaporator 10 as shown by arrow "A" in FIGS. 1, 2.

When the compressor of the refrigerant cycle operates, gas-liquid two-phase refrigerant decompressed in the expansion valve flows through the refrigerant passage of the evaporator 10, as shown by the above-described arrows "a"–"i" shown in FIG. 2. On the other hand, as shown by the arrow A1 in FIG. 6C, an air passage is formed in a wave like continuously in an entire plate width by the spaces formed between the outside surface of the flat base plate 13 and the outside protrusion surfaces of the projection ribs 14, 140 of the adjacent heat-exchanging plates 12*a*–12*c* of the core portion 11.

As a result, air blown by the blower unit meanderingly passes through the air passage in the wave like between both the first and second heat-exchanging plates 12*a*, 12*b* and between both the first and third heat-exchanging plate 12*a*, 12*c*. Therefore, refrigerant passing through the refrigerant passage 19, 20 of the evaporator 10 absorbs an evaporation-latent heat from air passing through the heat-exchanging plates 12*a*, 12*b*, 12*c* to be evaporated, so that air is cooled.

Relative to the air-flowing direction A, the first refrigerant passage 19 at the refrigerant inlet side is provided at the downstream air side, and the second refrigerant passage 20 at the refrigerant outlet side is provided at an upstream air side from the first refrigerant passage 19. Further, the air-flowing direction A is approximately perpendicular to the longitudinal direction (i.e., the refrigerant-flowing direction B in the refrigerant passage 19, 20) of the projection ribs 14, 140 of the heat-exchanging plates 12*a*–12*c*, and each of the projection ribs 14, 140 has the outer protrusion surface (heat-exchanging surface) protruding in a direction perpendicular to the air-flowing direction A. Thus, air is restricted from linearly flowing due to the outer protrusion surface of the projection ribs 14, 140.

Thus, the flow of air passing through the spaces between the heat-exchanging plates 12*a*–12*c* is disturbed, and heat-exchanging effect is greatly improved by the outer protrusion surfaces of the projection ribs 14, 140. Thus, even in the evaporator 10 where the core portion 11 is formed only by the heat-exchanging plates 12*a*–12*c*, because air passing through the heater core 11 is disturbed due to the outer protrusion surfaces of the projection ribs 14, 140, a necessary cooling performance is obtained.

Further, according to the first embodiment of the present invention, the communication passage 120 is formed at a center position between the lower tank portions 16, 18 in the third heat-exchanging plate 12*c* disposed in the right area Y so that both tank portions 16, 18 directly communicate with each other through the communication passage 120. Therefore, it is unnecessary to provide a side refrigerant passage in the end plate 22. Thus, in the first embodiment, the end plate 22 is formed into a single flat-plate like. Accordingly, relative to the end plate 22, the arrangement space of the heater core 11 is made larger, and the heat-exchanging performance of the core portion 11 is improved.

Next, draining performance of condensed water generated from the evaporator 10 will be now described. When the evaporator 10 is disposed in the air conditioning case to be practically used, the longitudinal direction (i.e., plate longitudinal direction) of the heat-exchanging plates 12*a*, 12*b*, 12*c* is arranged in the up-down direction as shown in FIGS. 1, 2. Therefore, outside the refrigerant passages 19, 20 of heat-exchanging plates 12*a*, 12*b*, 12*c*, it is possible to continuously form a clearance extending in the plate longitudinal direction (i.e., up-down direction in FIGS. 1, 2) between the adjacent heat-exchanging plates 12*a*, 12*b*, 12*c*. As a result, condensed water generated on the outer surfaces of the heat-exchanging plates 12*a*, 12*b*, 12*c* falls smoothly downwardly through the clearance.

Generally, a part of condensed water tends to move downstream air side. According to the first embodiment of the present invention, each of the upstream-air side tank portions 17, 18 has a height dimension in the up-down direction higher than that of the downstream-air side tank portions 15, 16 by a predetermined dimension L. Therefore, within the core portion 11, a downstream air-flowing area becomes larger as compared with an upstream air-flowing area, and air flow rate is decreased in the downstream air-flowing in the core portion 11. Thus, even when condensed water is moved toward the downstream air-flowing area of the core portion 11, condensed water is restricted from flying toward a downstream air side from a downstream side end of the heat-exchanging plates 12*a*–12*c*.

Figure 8:
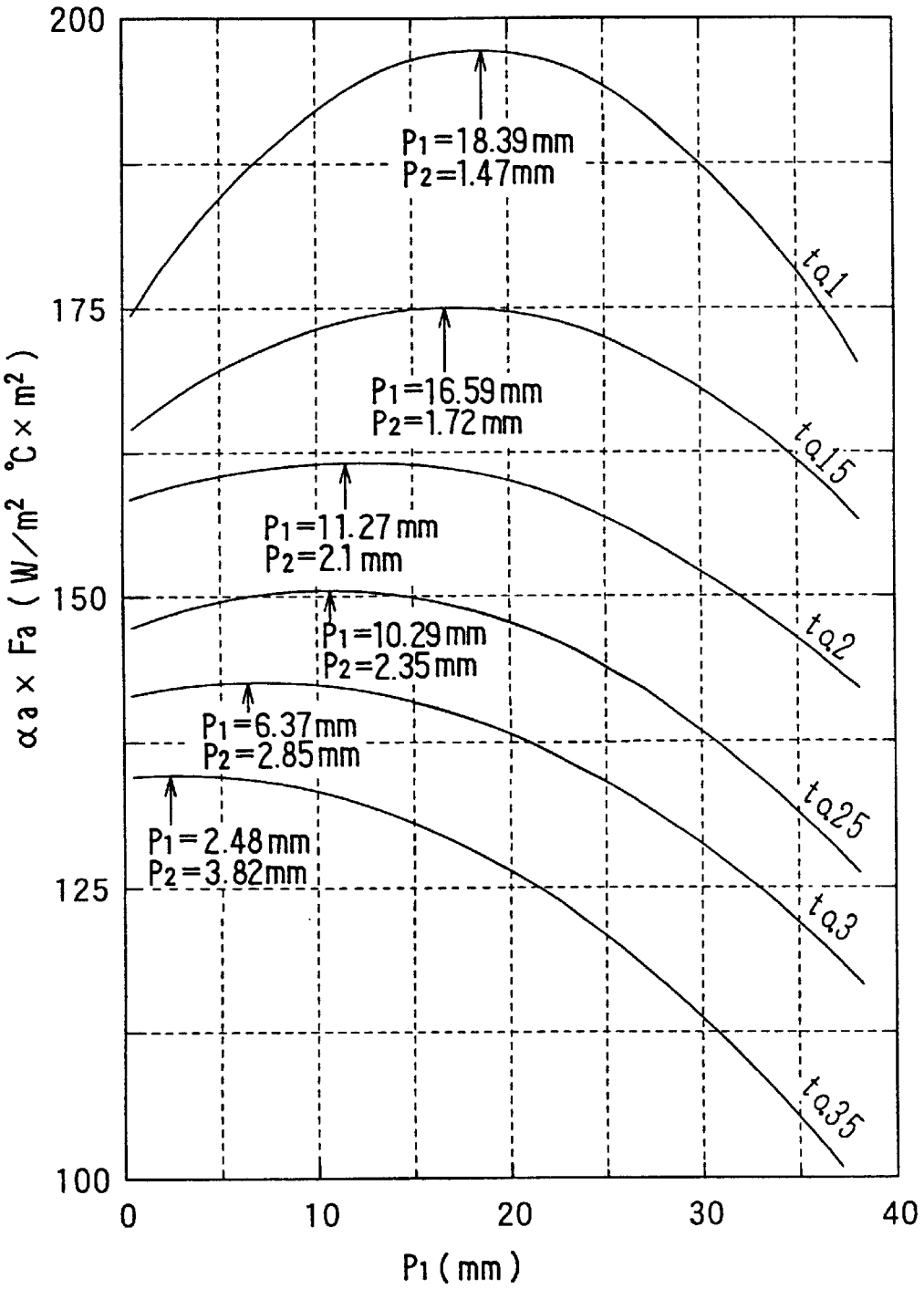
FIG. 8 is a graph showing a relationship between a protrusion pitch P1, a passage pitch P2 and a heat-exchanging performance according to the first embodiment.

Next, the relationship between a specific example of an evaporator (heat exchanger) and the heat-exchanging performance will be now described. FIG. 8 shows a characteristics of the heat-exchanging performance. In FIG. 8, the vertical axis indicates the product of an air-side heat conductivity "$\alpha a$" and an air-side heat-exchanging area "Fa", and the horizontal axis indicates a protrusion pitch P1. Here, the protrusion pitch P1 is a distance between adjacent protrusion portions 14(140) in each of the heat-exchanging plates 12*a*, 12*b*, 12*c* in the air-flowing direction A, as shown in FIG. 6C. On the other hand, a passage pitch P2 indicated in FIG. 8 is a distance between adjacent plate portions for forming the refrigerant passages 19 (or 20) in the plate laminating direction, as shown in FIG. 6C.

As shown in FIG. 8, by changing the protrusion pitch P1 and the passage pitch P2, the heat-exchanging performance (i.e., the product of the $\alpha a$ and the Fa) is changed. That is, as the protrusion pitch P1 becomes smaller, the air-side heat conductivity $\alpha a$ becomes larger. When the protrusion pitch P1 is decreased, the number of the protrusion ribs 14 is increased. Therefore, the air flow is more readily disturbed, and the air-side heat conductivity $\alpha a$ is improved. On the other hand, as the protrusion pitch P1 becomes smaller, pressure loss of air is increased in the air passage.

On the other hand, as the passage pitch P2 becomes smaller, the laminating number of the heat-exchanging plates 12*a*–12*c* is increased in the same-size heat exchanger. Therefore, the air-side heat-exchanging area Fa is increased. However, as the passage pitch P2 is made smaller, the pressure loss of air is increased in the air passage. FIG. 8 shows the calculated result, when a flow rate of air at an air inlet of the heat exchanger is set to 2 m/s, and when the protrusion pitch P1 and the passage pitch P2 are set so that the pressure loss of air becomes a constant value of 100 Pa. Further, in FIG. 8, the plate thickness "t" can be set to in a range of 0.1 mm–0.35 mm. The plate thickness "t" of each heat-exchanging plate 12*a*, 12*b*, 12*c* is set in accordance with the inner refrigerant pressure, the corrosion resistance, the molding performance, the material, and the like.

As shown in FIG. 8, when the passage pitch P2 is changed in a range of 1.47 mm–3.82 mm to be reduced, the protrusion pitch P1 where the heat-exchanging performance becomes maximum is changed in a range of 2.48 mm–18.39 mm to be increased. When the pressure loss of air is beforehand set to a constant value, it is favorable for the heat-exchanging performance in a case where the passage pitch P2 is made smaller and the protrusion pitch P1 is made larger, as compared with a case where the passage pitch P2 is made larger and the protrusion pitch P1 is made smaller.

In the first embodiment, when the protrusion pitch P1 is approximately set in a range of 2–20 mm, the heat-exchanging performance can be effectively improved in each passage pitch P2. Further, when the passage pitch P2 is approximately set in a range of 1.4–3.9 mm, the heat-exchanging performance is improved while the pressure loss of air is restricted from being increased. Further, the clearance between the heat-exchanging plates 12*a*, 12*b*, 12*c*, for forming the air passage, has a dimension in the plate laminating direction, and the dimension is calculated by (P2×½–t). Here, the "t" is the plate thickness. Thus, in the first embodiment, the clearance in the plate laminating direction, for forming the air passage, is approximately in a range of 0.7 mm–1.95 mm.

In the first embodiment of the present invention, when the protrusion pitch P1 is set in a range of 10–20 mm, and the passage pitch P2 is set in a range of 1.4–2.3 mm, the heat-exchanging performance of the evaporator 10 can be further effectively improved.

In a case where a heat exchanger has plural corrugated fins, because the corrugated fins are provided between adjacent tubes, the height (a dimension corresponding to "h" in FIG. 7) of the tank portion is need to have more than 5 mm. Therefore, during a pressing of an aluminum plate for a tube, the aluminum plate is needed to be greatly extended for forming the tank portion. Therefore, O-material (softest) having a sufficient extending distance is used as a material of the aluminum plate for a tube. The O-material is an aluminum material defined in "JIS H 0001", which becomes in a softest state by annealing. The O-material has an elongation percentage greatly larger than that of an H-material. However, when the O-material having a sufficient elongation percentage is used, a part of the aluminum plate is thinned by corrosion (i.e., erosion) of brazing material clad on the surface of the aluminum plate. Therefore, corrosion resistance of the aluminum plate is decreased. For preventing the corrosion of the brazing material, a hard material (H-material) having a small elongation percentage may be used. However, in this case, the tank portion may be broken because the H-material has an insufficient elongation percentage. Specifically, as defined in the "JIS H 0001", the H-material has a level such as H1, H2, H3. When the H-material is in a level of H112, because a hardening is generated during an elongation, it is unnecessary to perform the hardening after the elongation.

However, according to the first embodiment of the present invention, the evaporator 10 is formed only by laminating the heat-exchanging plates 12*a*–12*c*. Therefore, the height "h" of the tank portions 15–18 can be set to be equal to or smaller than 2 mm, similarly to the height "h" of the projection ribs 14, 140. Thus, even when the H-material having a small elongation percentage is used as the aluminum material for forming the heat-exchanging plates 12*a*–12*c*, the tank portions 15–18 having predetermined shapes can be readily formed by pressing without a break. As a result, in the first embodiment, the thickness (t) of each heat-exchanging plate 12*a*, 12*b*, 12 can be made thinner (t=0.1–0.35 mm) while corrosion resistance is improved, and the weight of the evaporator 10 (heat exchanger) is reduced.

A second preferred embodiment of the present invention will be now described with reference to FIGS. 9–14. In the above-described first embodiment of the present invention, each of the projection ribs 14 is formed to continuously extend in a direction approximately perpendicular to the air-flowing direction A. However, the projection ribs 14 may be formed to be inclined relative to the air-flowing direction A. Further, each of the projection ribs 14 may be formed into an independent thin and long protrusion shape.

Figure 11:
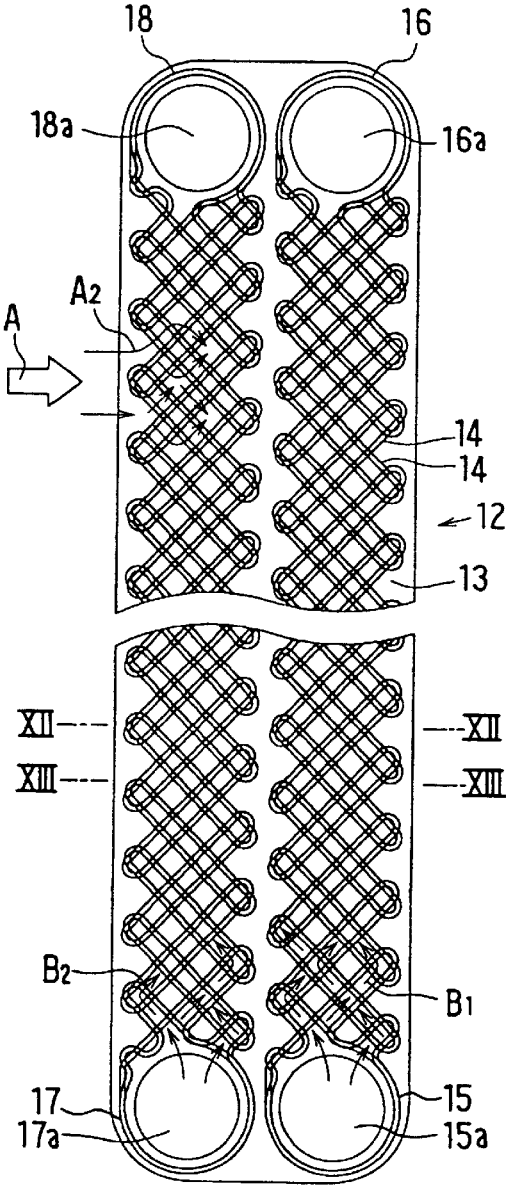
FIG. 11 is a plan view showing an overlapped state of a pair of the heat-exchanging plates according to the second embodiment.
Figure 12:
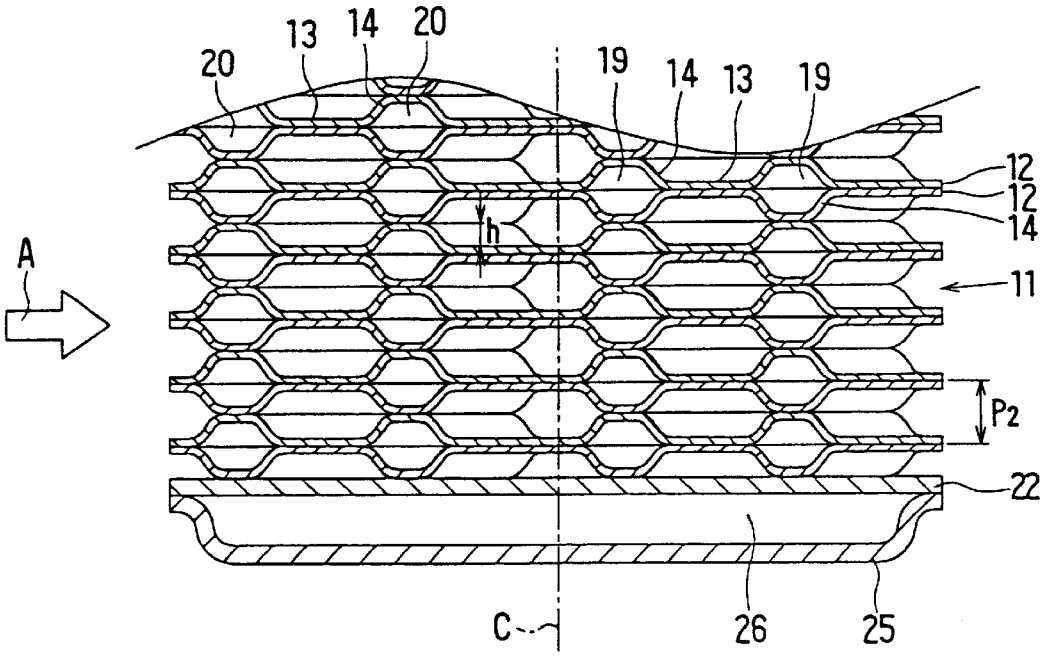
FIG. 12 is a cross-sectional view taken along line XII–XII in FIG. 11.
Figure 13:
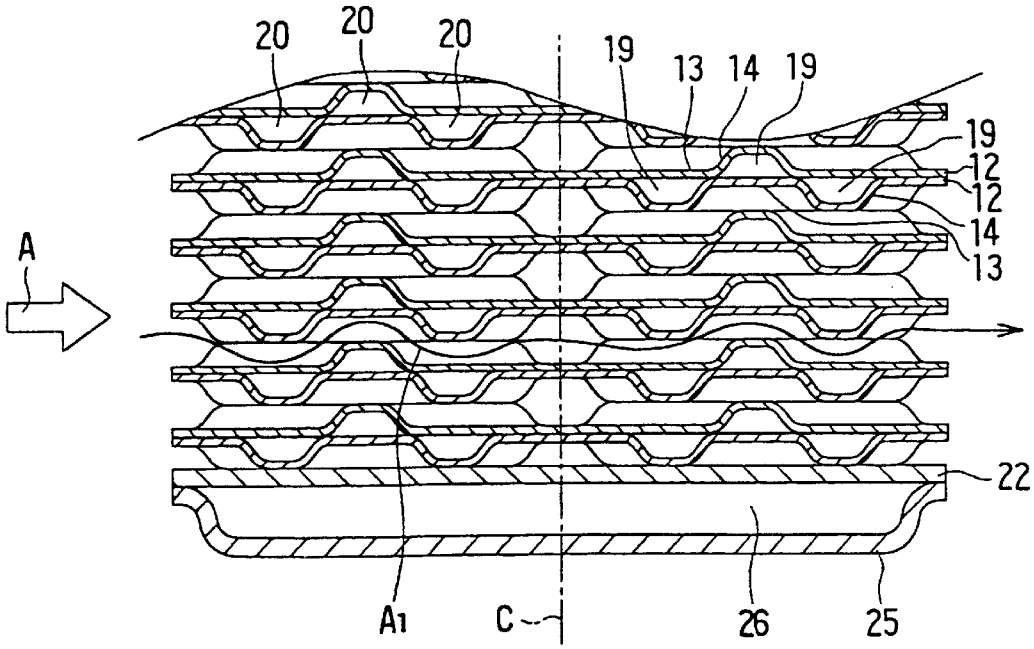
FIG. 13 is a cross-sectional view taken along line XIII—XIII in FIG. 11.

In the second embodiment, an evaporator 10 is formed by connecting and laminating plural heat-exchanging plates 12 each of which has a similar structure. In the second embodiment, plural thin and long projection ribs 14 are independently formed in each heat-exchanging plate 12 to each have a protrusion shape and to extend in an inclination direction which is inclined by a predetermined angle θ (FIG. 10) relative to the air-flowing direction A. As shown in FIG. 11, in overlapped positions of the projection ribs 14 of each pair of the heat-exchanging plates 12, the inner spaces of the plural projection ribs 14 communicate with each other, so that the refrigerant passages 19, 20 are formed.

In FIG. 11, the refrigerant flow in the first refrigerant passage 19 on the downstream air side is indicated by arrow "B1", and the refrigerant flow in the second refrigerant passage 20 on the upstream air side is indicated by arrow "B2". On the other hand, as shown by arrow "A2" in FIG. 11, air (outside fluid) is meandered on the flat surface of the heat exchanging plate 12. Further, as shown by arrow "A1" in FIG. 13, air is also meandered in the plate laminating direction.

Figure 9:
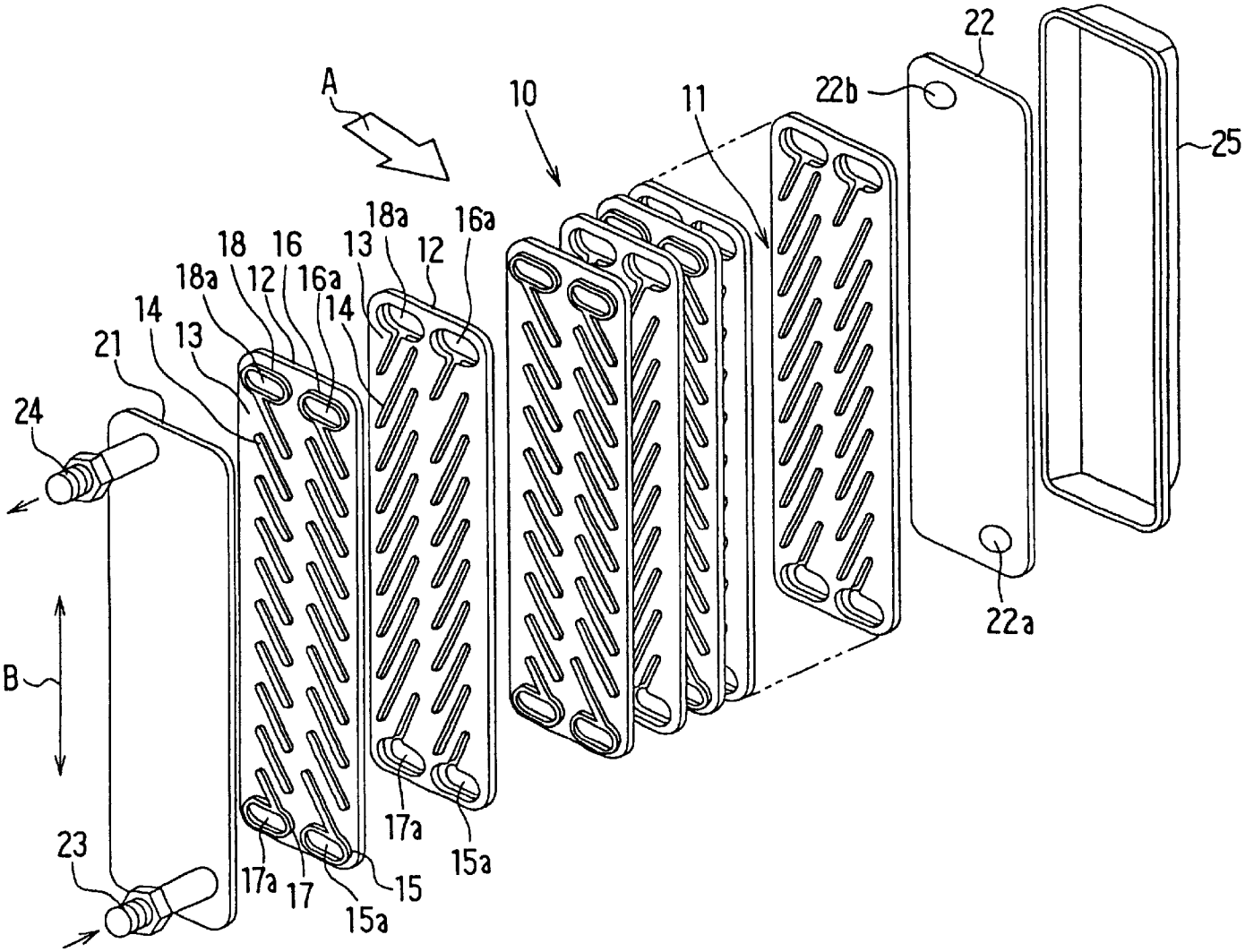
FIG. 9 is a disassembled perspective view showing an evaporator according to a second preferred embodiment of the present invention.
Figure 10:
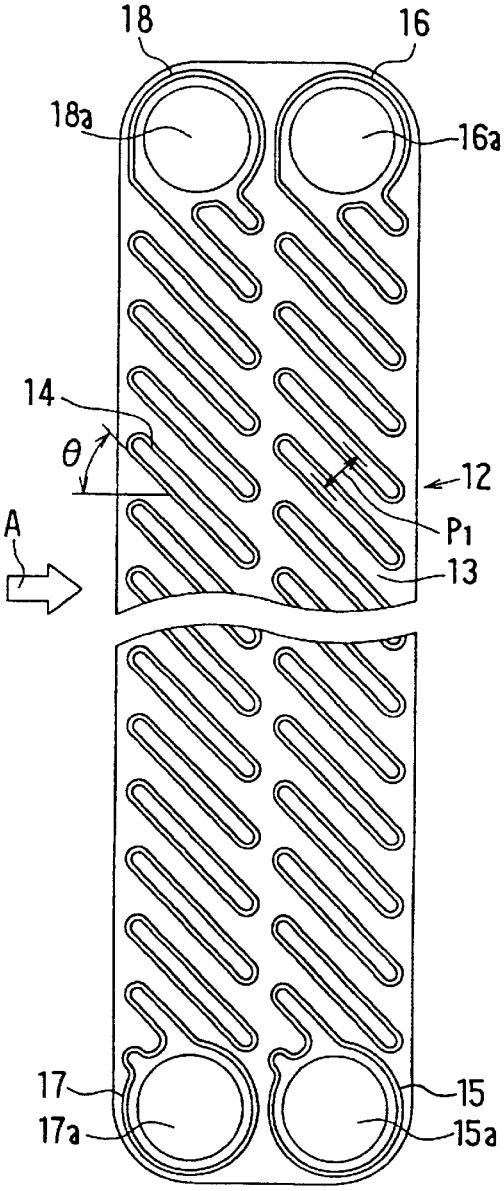
FIG. 10 is a plan view of a heat-exchanging plate according to the second embodiment.
Figure 14:
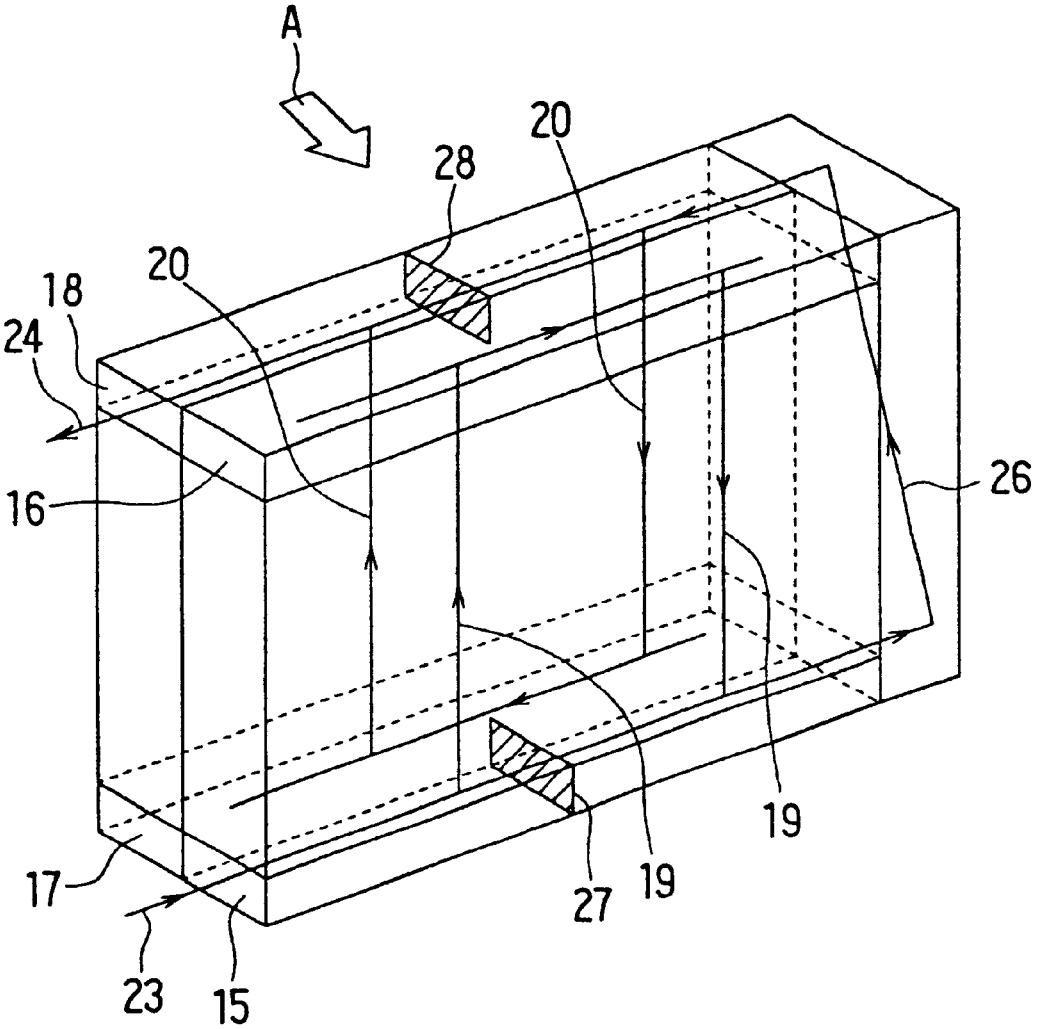
FIG. 14 is a schematic perspective view showing a refrigerant passage of the evaporator according to the second embodiment.

In the second embodiment, as shown in FIGS. 9, 14, a recessed side plate 25 is disposed outside an end plate 22 having communication holes 22*a*, 22*b*. Therefore, a side refrigerant passage 26 is defined between the side plate 25 and the end plate 22, and the communication holes 22*a*, 22*b* of the end plate 22 communicate with each other through the side refrigerant passage 26. In the second embodiment, a refrigerant passage in the tank portion 15 is partitioned by a partition member 27, and a refrigerant passage in the tank portion 18 is also partitioned by a partition member 28. Therefore, as shown in FIG. 14, refrigerant flows through an entire refrigerant passage of the evaporator 10 in accordance with the routine shown by the arrows in FIG. 14.

In the second embodiment, the projection ribs 14 are arranged in two lines to be inclined in the same inclination direction. That is, the projection ribs 14 are arranged in an upstream air line and a downstream air line in the heat-exchanging plate 12.

In the second embodiment, the components similar to those in the first embodiment are indicated with the same reference number, and the explanation thereof is omitted. Even in the second embodiment of the present invention, the protrusion pitch P1 shown in FIG. 10 and the passage pitch P2 shown in FIG. 12 has the relationship relative to the heat-exchanging performance, similar to the first embodiment. Therefore, the dimension ranges of the protrusion pitch P1 and the passage pitch P2 can be applied to the evaporator 10 of the second embodiment.

Figure 15:
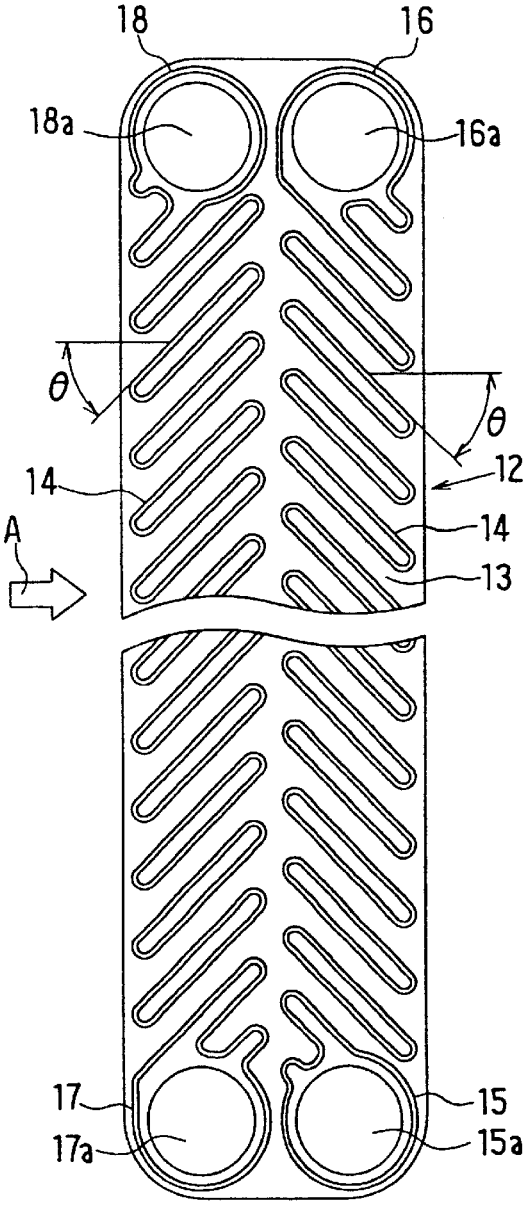
FIG. 15 is a plan view showing a heat-exchanging plate according to a third preferred embodiment of the present invention.
Figure 16:
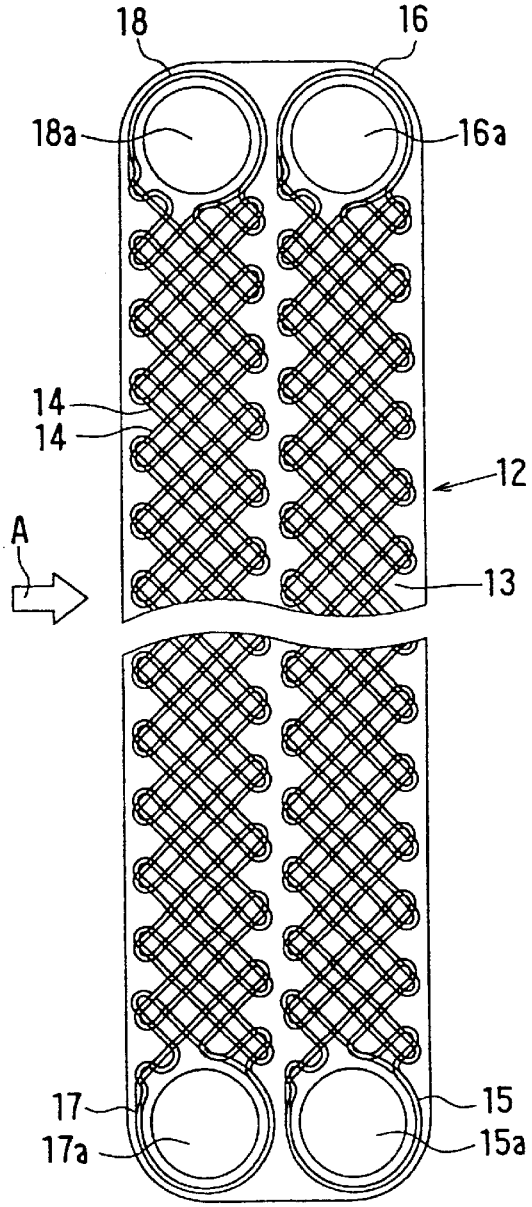
FIG. 16 is a plan view showing an overlapped state of a pair of the heat-exchanging plates according to the third embodiment.

A third preferred embodiment of the present invention will be now described with reference to FIGS. 15 and 16. In the above-described second embodiment, the projection ribs 14 arranged at the upstream air side are inclined in the same inclination direction as the projection ribs 14 arranged at the downstream air side. According to the third embodiment of the present invention, as shown in FIGS. 15, 16, the projection ribs 14 arranged at the upstream air side are inclined in an inclination direction opposite to that of the projection ribs 14 arranged at the downstream air side. In the third embodiment, the other portions are similar to those in the above-described second embodiment.

Figure 17:
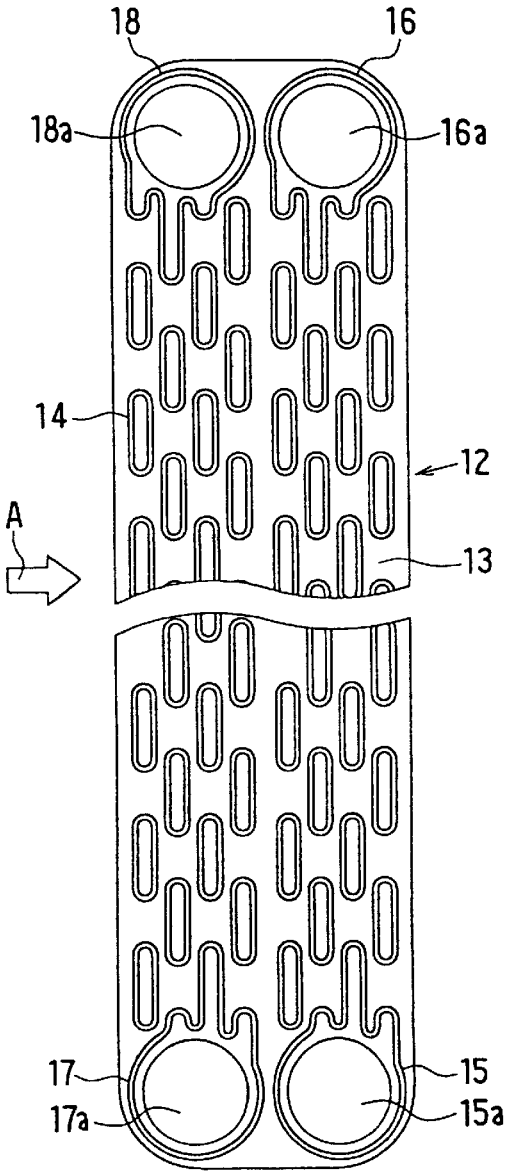
FIG. 17 is a plan view showing a heat-exchanging plate according to a fourth preferred embodiment of the present invention.
Figure 18:
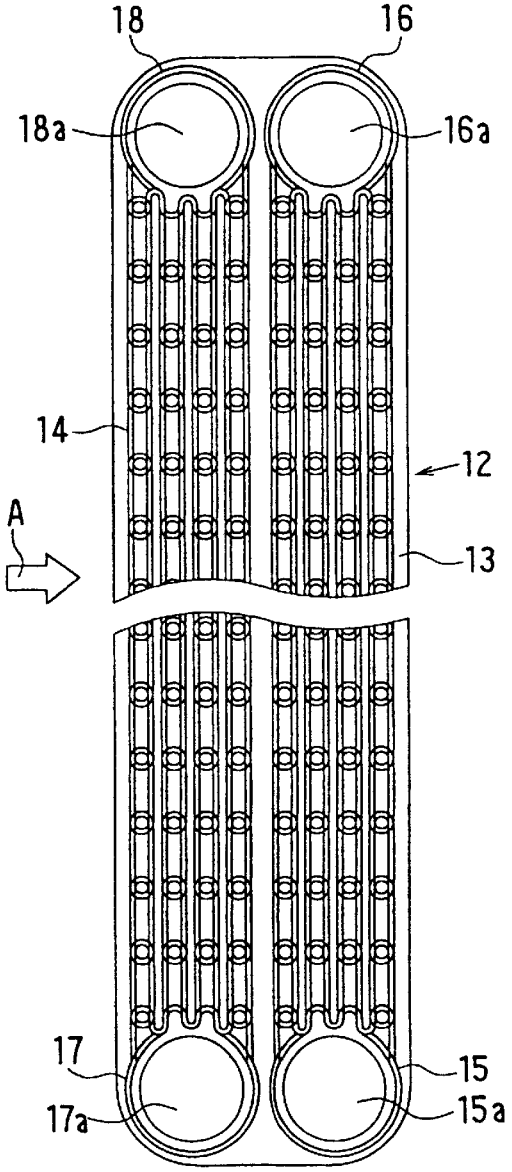
FIG. 18 is a plan view showing an overlapped state of a pair of the heat-exchanging plates according to the fourth embodiment.

A fourth preferred embodiment of the present invention will be now described with reference to FIGS. 17, 18. In the fourth embodiment, each of the projection ribs 14 is arranged in a direction perpendicular to the air-flowing direction A. That is, the projection ribs 14 are arranged in parallel with the longitudinal direction of the heat-exchanging plates 12.

According to the fourth embodiment of the present invention, the projection ribs 14 are arranged staggeringly to be parallel to the longitudinal direction of the heat-exchanging plates 12. As shown in FIG. 18, when a pair of the heat-exchanging plates 12 are connected, the projection ribs 14 of the pair of the heat-exchanging plates 12 overlap and communicate with each other at the end portions thereof, so that the refrigerant passages 19, 20 are formed. Thus, according to the fourth embodiment, refrigerant flows through the entire refrigerant passages 19, 20 in parallel with the longitudinal direction of the heat-exchanging plates 12.

Figure 19:
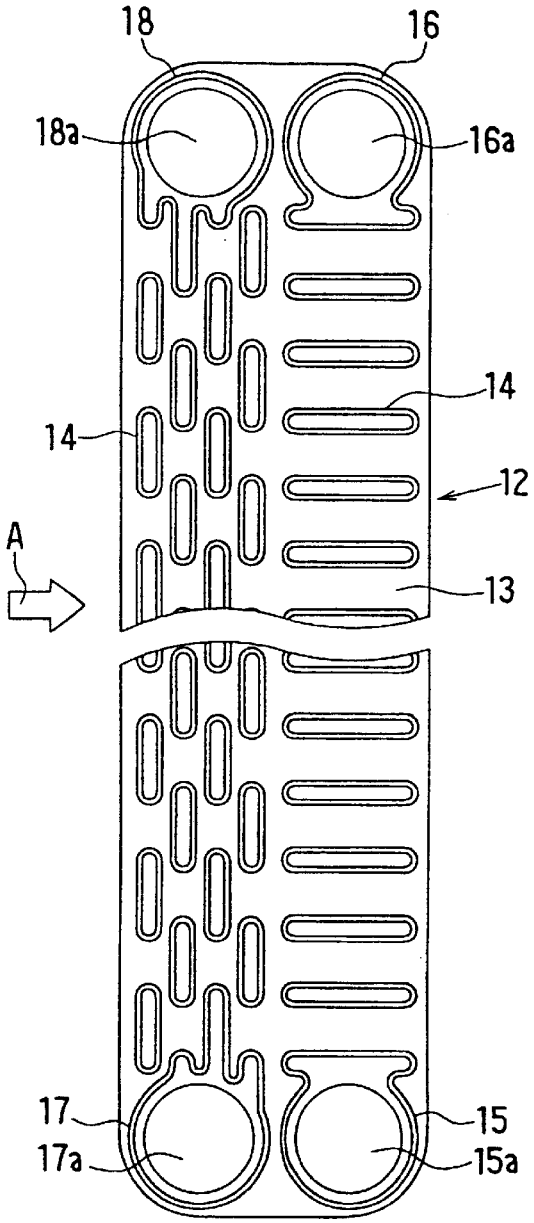
FIG. 19 is a plan view showing a heat-exchanging plate according to a fifth preferred embodiment of the present invention.
Figure 20:
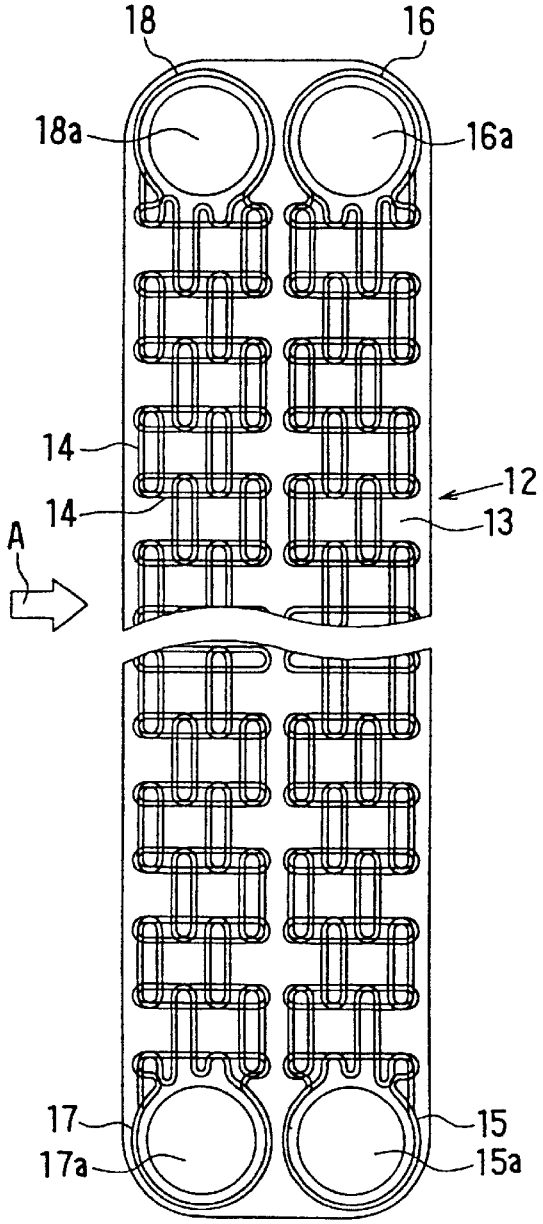
FIG. 20 is a plan view showing an overlapped state of a pair of the heat-exchanging plates according to the fifth embodiment.

A fifth preferred embodiment of the present invention will be now described with reference to FIGS. 19, 20. In the fifth embodiment, as shown in FIGS. 19, 20, among the projection ribs 14 arranged in two lines in the air-flowing direction A, one side projection ribs 14 are arranged perpendicular to the air-flowing direction A, and the other side projection ribs 14 are arranged in parallel with the air-flowing direction A, Thus, according to the fifth embodiment, as shown in FIG. 20, refrigerant flows through the refrigerant passages 19, 20 while changing the flow direction alternately between the longitudinal direction and the width direction of the heat-exchanging plate 12.

Figure 21:
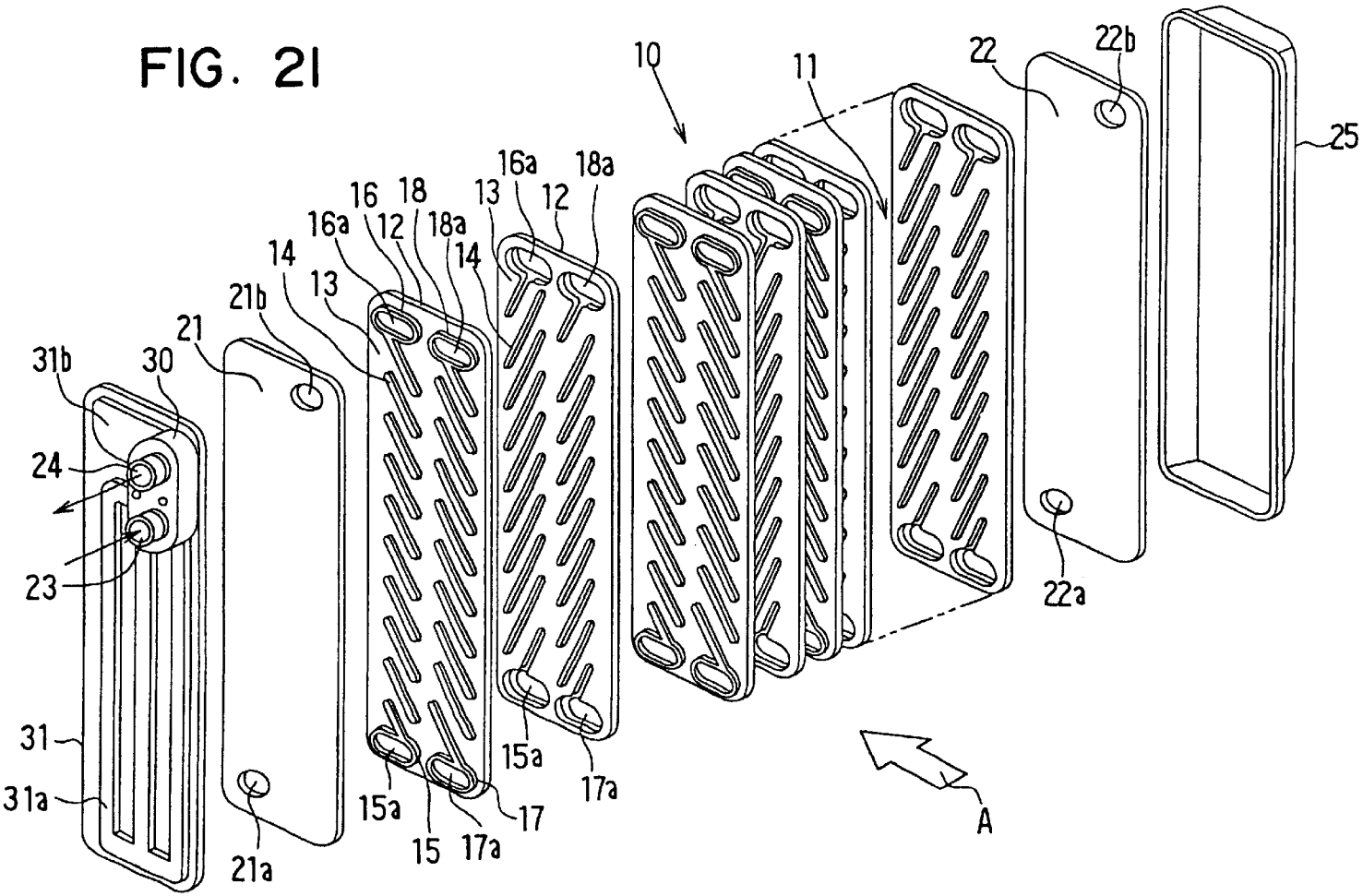
FIG. 21 is a disassembled perspective view showing an evaporator according to a sixth preferred embodiment of the present invention.

A sixth preferred embodiment of the present invention will be now described with reference to FIG. 21. In the sixth embodiment, as shown in FIG. 21, the air-flowing direction A is opposite to that in FIG. 9 of the second embodiment. In the above-described second embodiment, the refrigerant inlet pipe 23 and the refrigerant outlet pipe 24 are independently connected to the left side end plate 21, as shown in FIG. 9. However, in the sixth embodiment, the refrigerant inlet pipe 23 and the refrigerant outlet pipe 24 are integrally formed within a single joint block 30.

Further, a side plate 31 is connected to the left side end plate 21, so that a side refrigerant passage communicating with the refrigerant inlet and outlet in the joint block 30 is defined between the side plate 31 and the end plate 21. The end plate 21 has both communication holes 21*a*, 21*b*. The communication hole 21*a* communicates with the communication hole 15*a* in the refrigerant-inlet side tank portion 15 on the lower side. The communication hole 21*b* communicates with the communication hole 18*a* in the refrigerant-outlet side tank portion 18 on the upper side.

Similarly to the end plates 21, 22 and the side plate 25, the side plate is a both-surface clad plate which is formed by cladding an aluminum brazing material (e.g., A4000) on both surfaces of an aluminum core material (e.g., A3000). The side plate is thickened to about 1.0 mm for increasing the rigidity of the evaporator 10.

The joint block 30 is, for example, made of an aluminum bare material (A6000). In the joint block 30, the refrigerant inlet pipe 23 and the refrigerant outlet pipe 24 are integrally formed. In the sixth embodiment, the joint block 30 is disposed and connected to the upper portion of the side plate 31.

In the side plate 31, a first protrusion portion 31*a* is press-formed under the position where the joint block 30 is connected. The first protrusion portion 31*a* is joined at both upper and lower end portions thereof, and is divided into three portions between both end portions for increasing the rigidity of the side plate 31. The recess inside portion of the first protrusion portion 31*a* defines a refrigerant passage of the side plate 31. An upper end of the refrigerant passage of the first protrusion portion 31*a* communicates with the refrigerant inlet pipe 23 of the joint block 30, and a lower end thereof communicates with the communication hole 21*a* of the end plate 21.

Further, in the side plate 31, a second protrusion portion 31*b* is press-formed above the joint block 30. The recess inside portion of the second protrusion portion 31*b* defines a refrigerant passage through which the refrigerant outlet pipe 24 communicates with the communication hole 21*b* of the end plate 21.

In the sixth embodiment, because the refrigerant inlet pipe 23 and the refrigerant outlet pipe 24 are integrally formed within the single joint block 30, the arrangement structure of the evaporator 10 and external refrigerant pipes is made simple.

A seventh preferred embodiment of the present invention will be now described with reference to FIGS. 22–25. In each of the above-described embodiments, the heat-exchanging plate 12 has two tank portions 15–18 at both longitudinal ends thereof respectively. That is, the heat-exchanging plate 12 has totally four tank portions 15–18. The tank portions 15–18 has a small limited area for performing heat-exchange between air and refrigerant. Therefore, in the seventh embodiment, as shown in FIG. 22–25, only upper tank portions 16, 18 are formed at the longitudinal upper end of the heat-exchanging plate 12, and the lower tank portions 15, 17 are eliminated. Thus, the heat-exchanging area is made maximum, and the evaporator 10 can be downsized while maintaining the cooling performance thereof.

Figure 23:
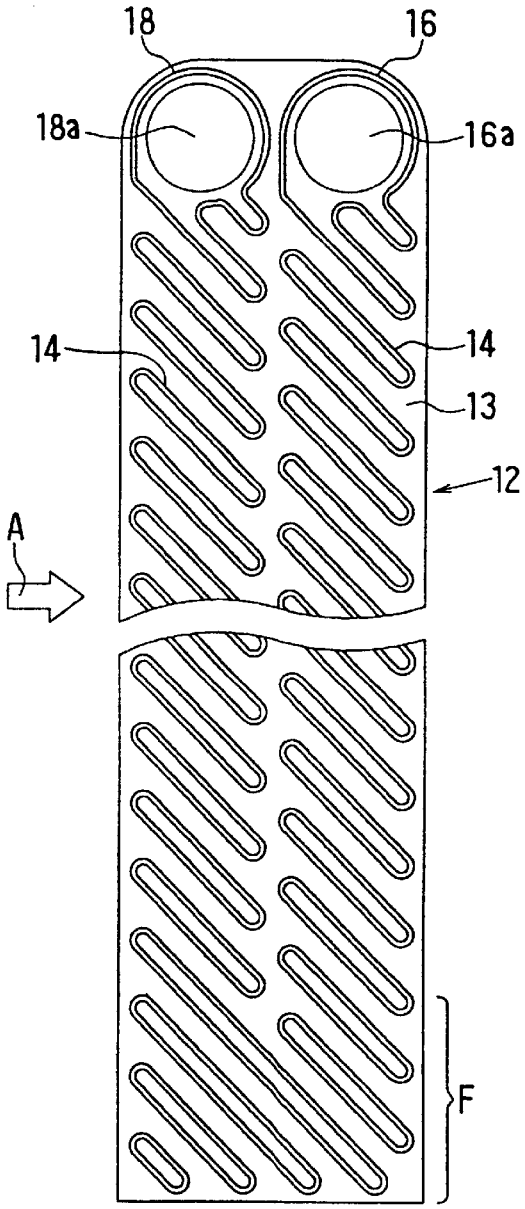
FIG. 23 is a plan view showing a heat-exchanging plate used in the seventh embodiment of the present invention.
Figure 25:
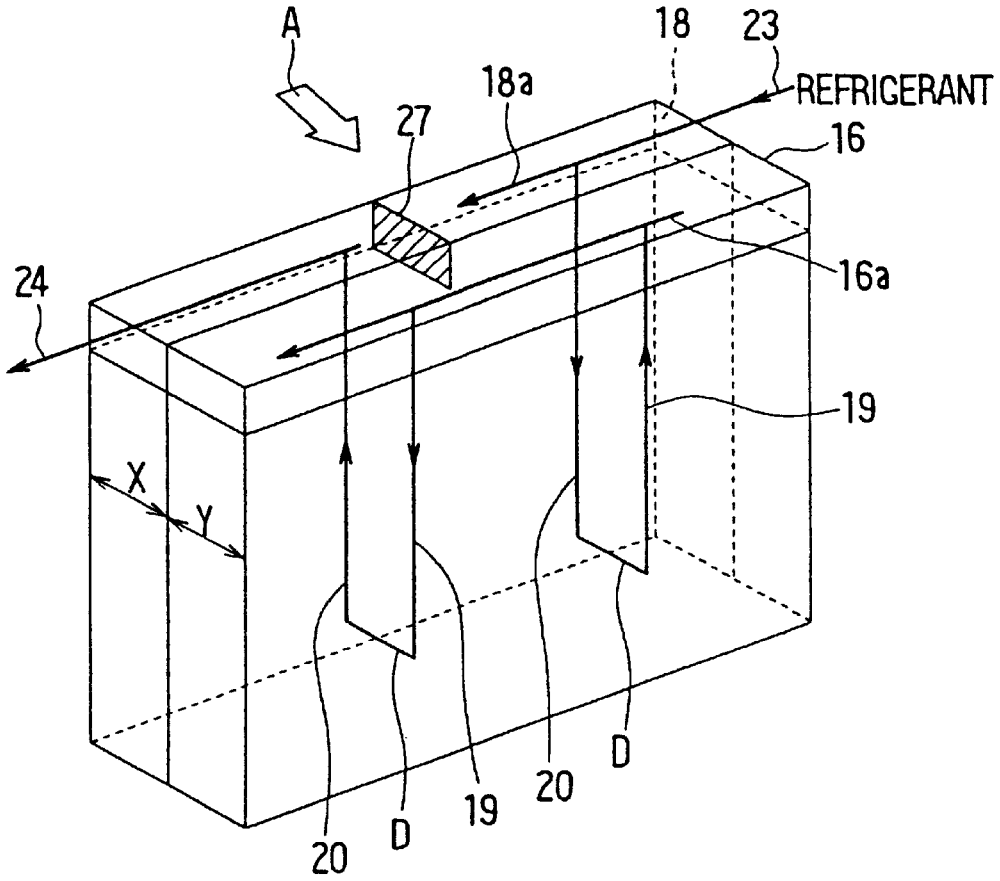
FIG. 25 is a schematic perspective view showing a refrigerant passage of the evaporator according to the seventh embodiment.

That is, in the seventh embodiment, the projection ribs 14 are also formed in the vicinity of the lower end of the heat-exchanging plate 12. As shown in FIG. 23, at the lower end portion of the heat-exchanging plate 12, the projection ribs 14 are formed to extend continuously from an upstream air side area to a downstream air side area in the air-flowing direction A. Thus, as shown in FIG. 25, a U-turn portion is provided between the refrigerant passages 19, 20.

Figure 24:
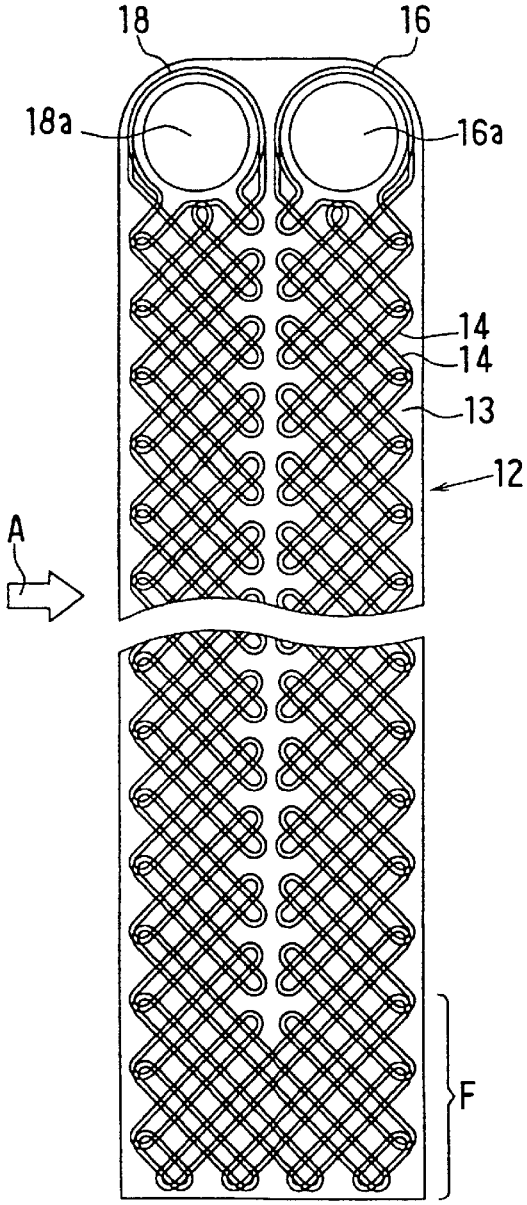
FIG. 24 is a plan view showing an overlapped state of a pair of the heat-exchanging plates according to the seventh embodiment.

In this way, as shown in FIGS. 23, 24, the U-turn portion D is provided in the lower side area F of the heat-exchanging plate 12.

In the seventh embodiment, the portion of the heat-exchanging plate 12, for forming the first and second refrigerant passages 19, 20, is similar to that in the above-described second embodiment, and the explanation thereof is omitted.

Figure 22:
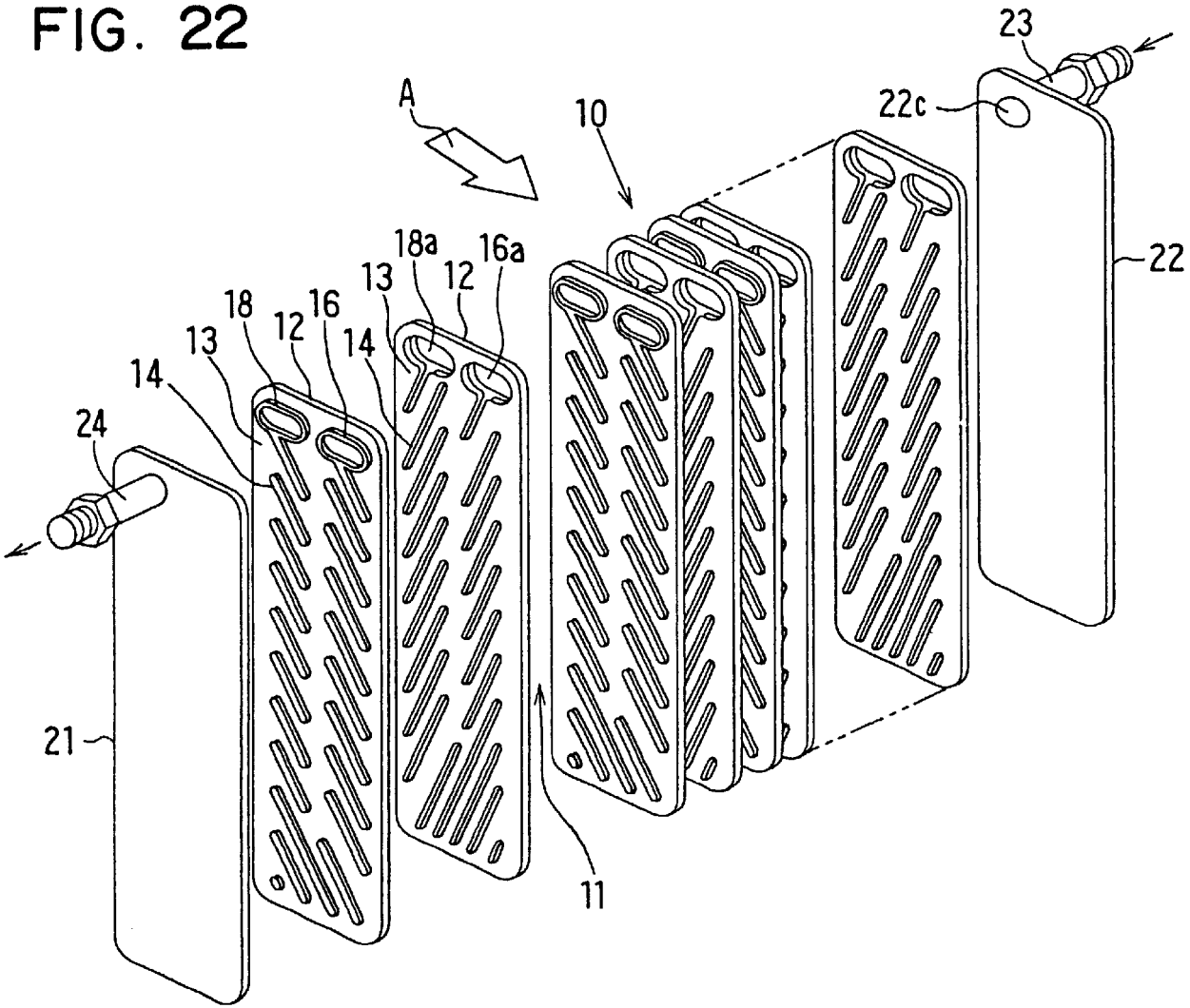
FIG. 22 is a disassembled perspective view showing an evaporator according to a seventh preferred embodiment of the present invention.

Further, as shown in FIG. 22, the refrigerant inlet 23 is connected to the right-side end plate 22, while the refrigerant outlet pipe 24 is connected to the left-side end plate 21. The refrigerant inlet pipe 23 communicates with the right side end of the upstream-air side upper tank portion 18, and the refrigerant outlet pipe 24 communicates with the left side end of the upstream-air side upper tank portion 18. The right side end plate 22 has a communication hole 22*c* through which the refrigerant inlet pipe 23 communicates with the upstream-air side upper tank portion 18. Similarly, the left side end plate 21 has a communication hole (not shown) through which the refrigerant outlet pipe 24 communicates with the upstream-air side tank portion 18.

As shown in FIG. 25, a partition member 27 is disposed at the center portion inside the upstream-air side upper tank portion 18. Therefore, refrigerant passes through the first and second refrigerant passages 19, 20 to be in U-turn, as shown in FIG. 25.

According to the seventh embodiment of the present invention, as shown in FIG. 24, the U-turn portion D is provided by the projection ribs 14 in the lower side area F of the heat-exchanging plate 12. Thus, the lower side area F of the heat-exchanging plate 12 is used as a heat-exchanging area having a high heat-exchanging effect, because air passing through the lower side area F is also disturbed by the projection ribs 14.

An eighth preferred embodiment of the present invention will be now described with reference to FIG. 26. In the eighth embodiment, as shown in FIG. 26, the evaporator 10 is formed into a shape other than the rectangular parallelopiped shape by using the feature of the present invention in which a fin member is not provided.

Figure 26:
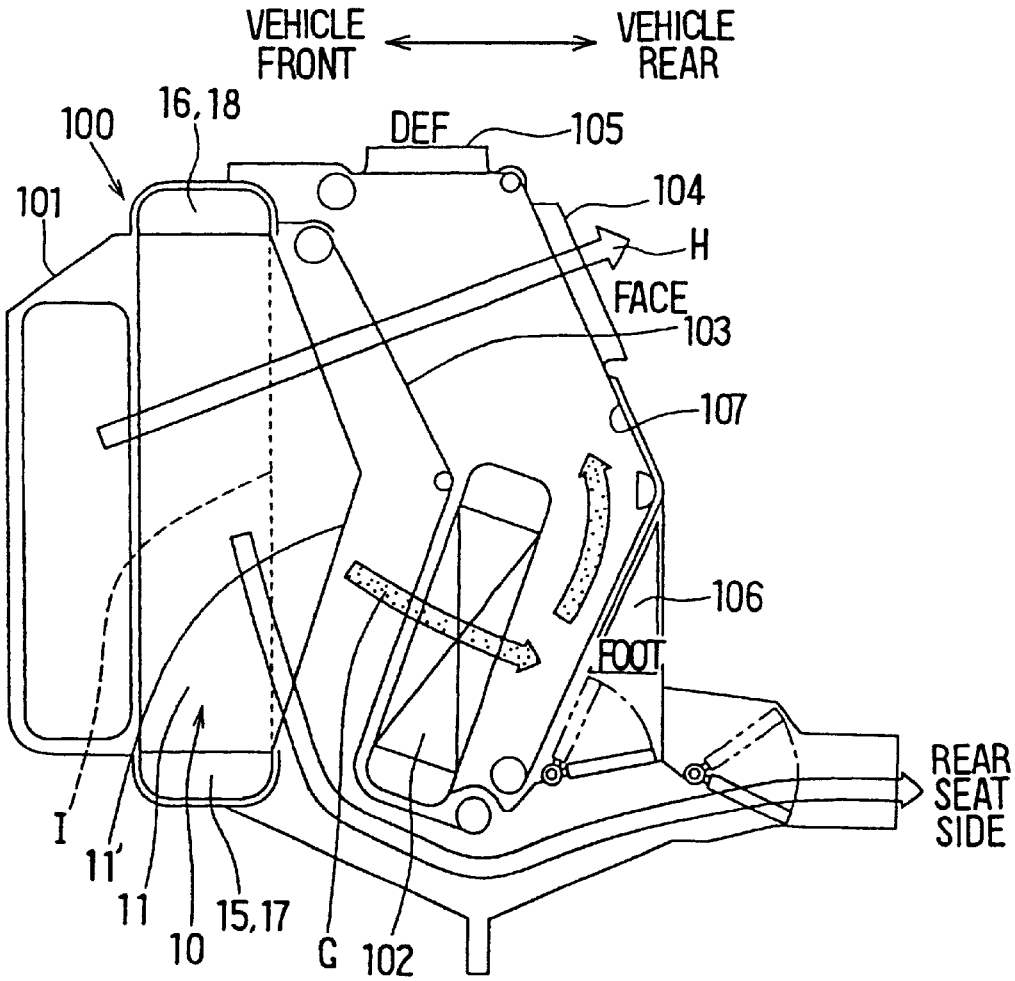
FIG. 26 is a schematic sectional view showing a vehicle air conditioning unit in which an evaporator of an eighth preferred embodiment is disposed.

FIG. 26 shows an air conditioning unit 100 for a vehicle. The air conditioning unit 100 includes an air conditioning case 101 in which the evaporator 10 and a heater core 102 for heating air using hot water as a heating source are disposed. An air-mixing film door 103 for adjusting a ratio between an amount of warm air G and an amount of cool air H is disposed in the air conditioning case 100, so that the temperature of air blown into a passenger compartment is controlled.

Air blown from a face opening 104, a defroster opening 105 and a foot opening 106 are changed by a film door 107.

In the present invention, because the fin member such as a corrugated fin is not needed, the evaporator 10 can be formed into an any shape along an inside wall surface of the air conditioning case 101. Thus, the inside space of the air conditioning case 101 is effectively used for improving the cooling performance of the evaporator 10.

As shown in FIG. 26, generally, a large space is formed in the air conditioning case 101 at an upstream air side of the air-mixing film door 103. In the eight embodiment of the present invention, for using this space effectively, the core portion 11 of the evaporator 10 protrudes triangularly toward a downstream air side. In FIG. 26, the numeral 11' indicates the triangular protrusion portion of the evaporator 10.

When an evaporator having a rectangular parallelopiped shape is disposed, the volume of the evaporator becomes smaller as indicated by the broken line I in FIG. 26. However, according to the eighth embodiment, the volume of the evaporator 10 is increased due to the triangular protrusion portion 11', thereby improving cooling performance of the evaporator 10.

Figure 27:
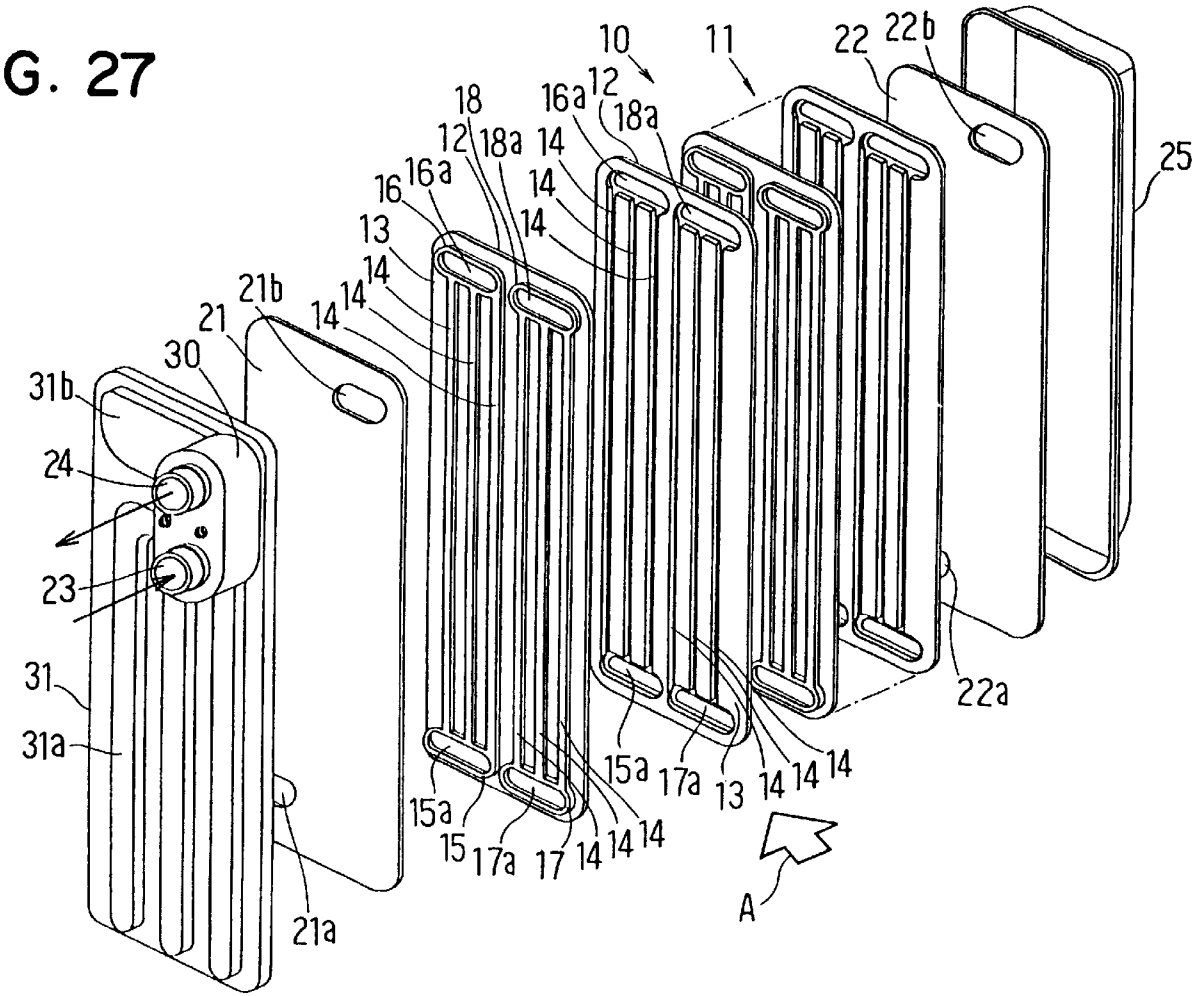
FIG. 27 is a disassembled perspective view showing an evaporator according to a ninth preferred embodiment of the present invention.
Figure 28:
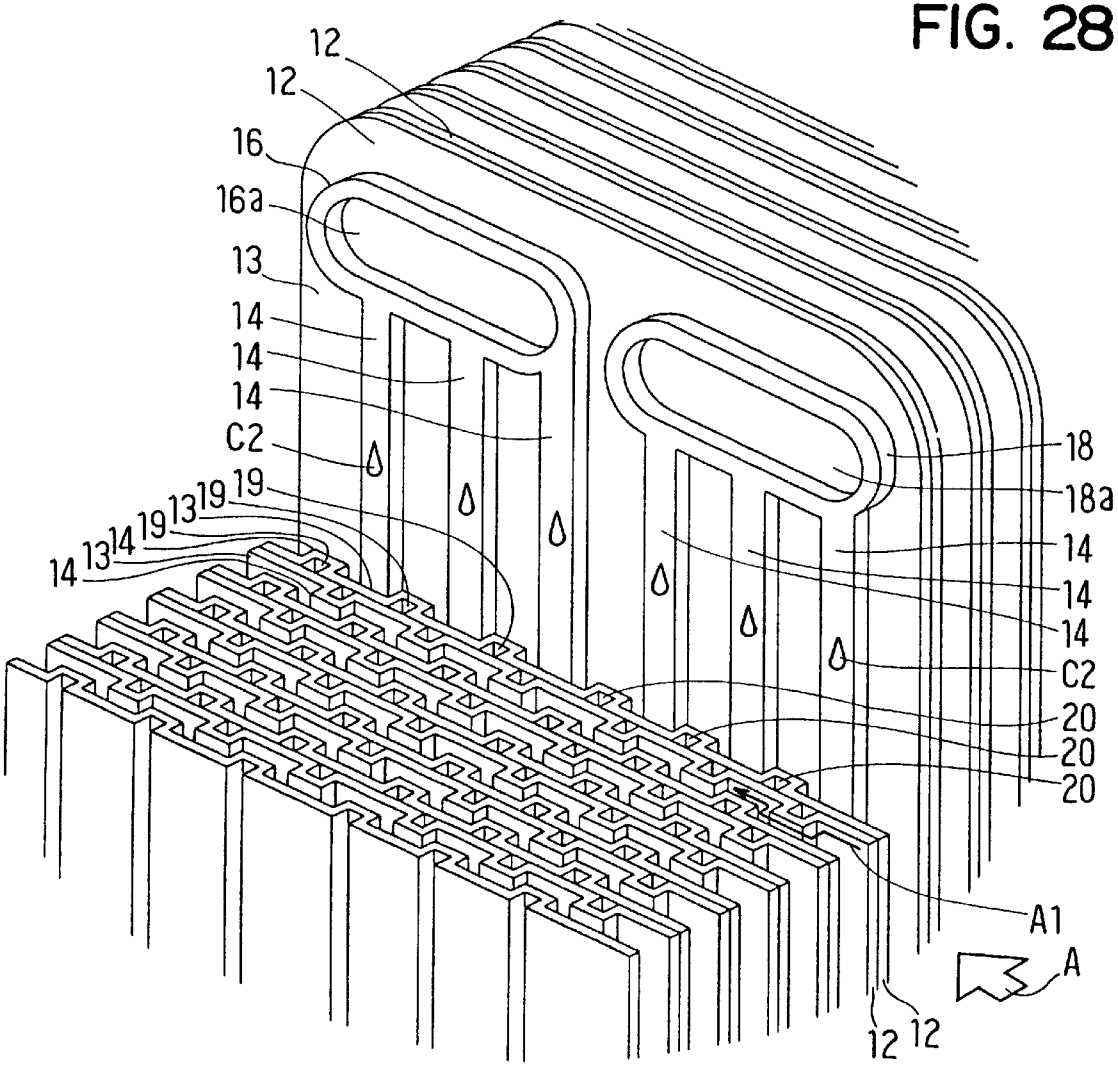
FIG. 28 is an enlarged perspective view showing a main portion of the evaporator according to the ninth embodiment.
Figure 29:
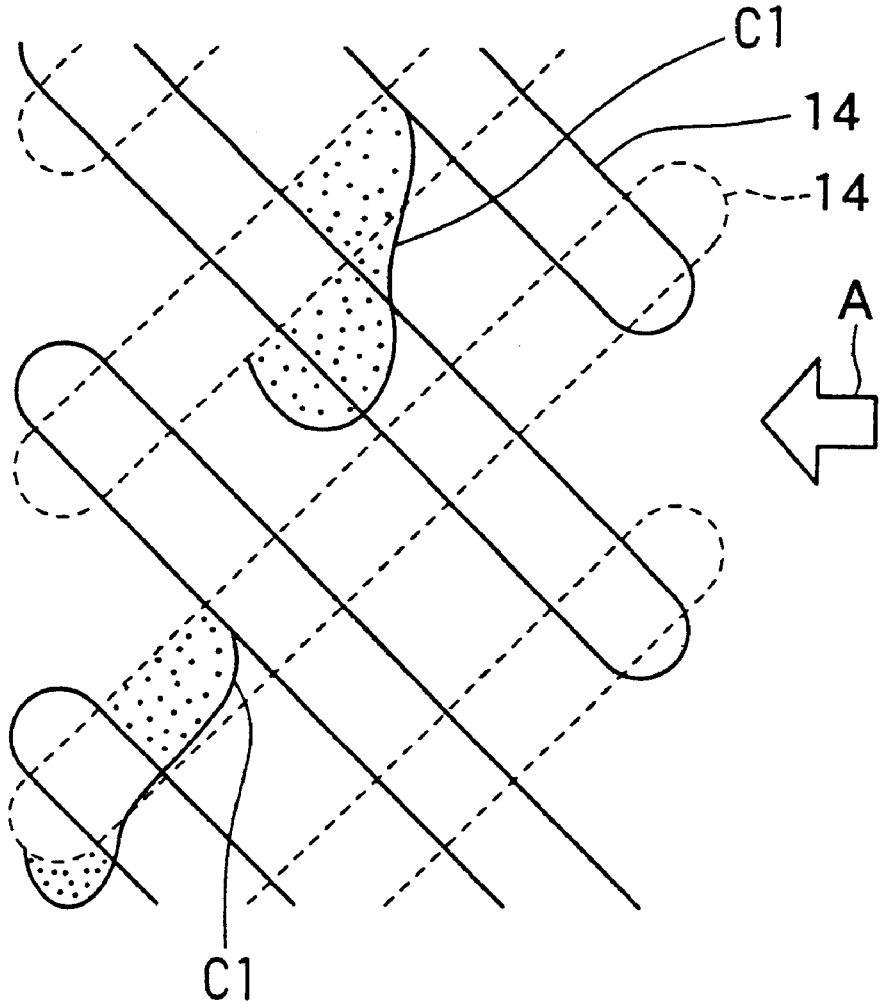
FIG. 29 is a view for explaining a falling state of condensed water in a comparison example (second embodiment) of the ninth embodiment.

A ninth preferred embodiment of the present invention will be now described with reference to FIGS. 27, 28. In the ninth embodiment, draining performance of condensed water generated on the evaporator 10 is improved. In the ninth embodiment, the components similar to those in FIG. 21 of the sixth embodiment are indicated with the same reference numbers, and the explanation thereof is omitted. The projection ribs 14 provided in the heat-exchanging plate 12 are similar to that in the above-described first embodiment. That is, the projection ribs 14 are provided in the heat-exchanging plate 12 linearly along the plate longitudinal direction. However, in the ninth embodiment, the protrusions 14*a* described in the first embodiment are not provided.

Figure 31:
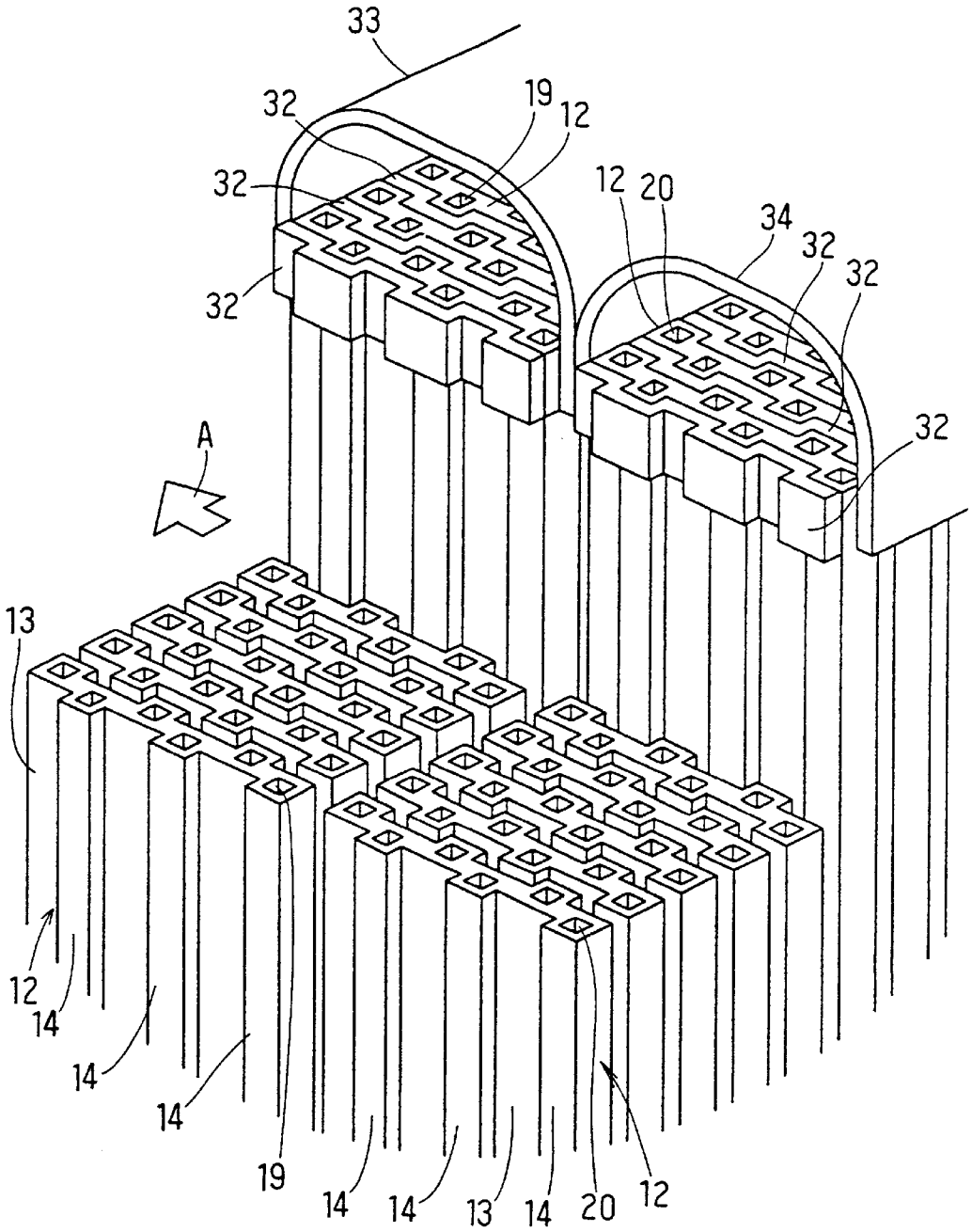
FIG. 31 is an enlarged perspective view showing a main portion of the evaporator according to the tenth embodiment.

In the above-described second embodiment of the present invention, the projection ribs 14 of each heat-exchanging plate 12 are inclined to an opposite direction to cross to each other. Therefore, as shown in FIG. 31, condensed water C1 is stored in the contacting area of the projection ribs 14, and an air-flowing resistance is increased.

In the ninth embodiment of the present invention, the evaporator 10 is used so that the longitudinal direction of the heat-exchanging plate 12 is in the up-down direction. When air passes through between the heat-exchanging plates 12 in a wave shape as shown by arrow A1 in FIG. 28, condensed water C2 is readily generated on the protrusion outer surfaces of the projection ribs 14. In the ninth embodiment, a clearance is provided between the protrusion outer surfaces of the projection ribs 14 of one heat-exchanging plate 12 and an another heat-exchanging plate 12 adjacent to the one heat exchanging plate 12 while a connection therebetween is not provided in an entire length in the plate longitudinal direction. Therefore, condensed water C2 does not stays on the protrusion outer surfaces of the protrusion portion 14.

Thus, condensed water on the surface of the heat-exchanging plate 12 can smoothly fall downwardly. As a result, air-flowing resistance is prevented from being increased due to the condensed water C2.

According to the ninth embodiment, each of the heat-exchanging plates 12 has the same shape. For example, in each of the heat-exchanging plates 12, six projection ribs 14 are formed to project from the flat base plate 13. Each of the projection ribs 14 has an approximate rectangular shape in cross section, and a protrusion height equal to the height of the tank portion 15–18. Further, as shown in FIG. 28, the projection ribs 14 are provided unsymmetrically relative to a center in the plate width direction.

In adjacent two of the heat-exchanging plates 12, because the protrusion ribs 14 are arranged to be offset from each other in the plate width direction, the protrusion outer surface faces a recessed portion provided by the flat base plate 13. Thus, a clearance having a dimension approximately equal to the protrusion height of the projection ribs 14 is provided between the protrusion outer surfaces of the projection ribs 14 and the flat base plate 13. Accordingly, as shown by arrow "A1" in FIG. 28, air blown by the blower unit meanderingly passes through the air passage in the wave like between adjacent the heat-exchanging plates 12 in the entire length in the plate width direction.

On the other hand, similarly to the above-described first embodiment, by contacting the flat base plates 13 of each pair of the heat-exchanging plates 12, the inner sides of the projection ribs 14 are air-tightly closed by the flat base plates 13 so that the first and second refrigerant passages 19, 20 are formed. The first refrigerant passage 19 disposed at the downstream-air side communicates with the downstream-air side tank portions 15, 16, and the second refrigerant passage 20 disposed at the upstream-air side communicates with the upstream-air side tank portions 17, 18.

A tenth preferred embodiment of the present invention will be now described with reference to FIGS. 30, 31. By a method of the tenth embodiment, the heat-exchanging plates 12*a*–12*c* described in the first embodiment and the heat-exchanging plate 12 described in the ninth embodiment are readily manufactured and assembled.

Figure 30:
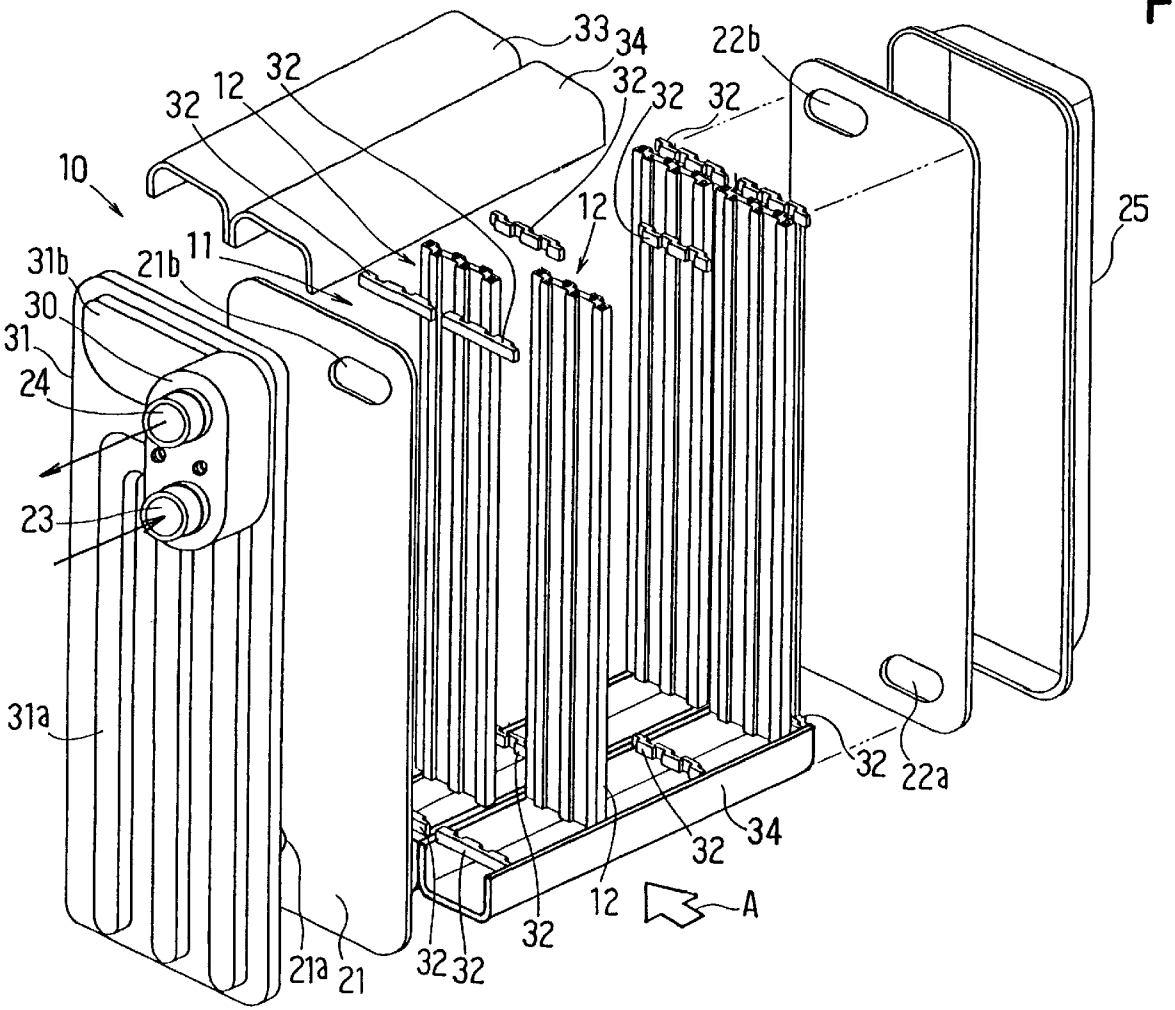
FIG. 30 is a disassembled perspective view showing an evaporator according to a tenth preferred embodiment of the present invention.

In the tenth embodiment, as shown in FIGS. 30, 31, a heat-exchanging plate 12 is formed by an extrusion of an aluminum bare material (i.e., an aluminum material without applying a brazing material) to have projection ribs 14 protruding from the flat base plate 13 on both sides in the laminating direction and to have therein refrigerant passages 19, 20. The projection ribs 14 protruding from the flat base plate 13 on both sides are formed linearly along the entire length in the longitudinal direction of the heat-exchanging plate 12. On both sides of the heat-exchanging plate 12 in the laminating direction, the projection ribs 14 are disposed to be offset. Further, in adjacent heat-exchanging plates 12, the projection ribs 14 in one heat-exchanging plate 12 are placed to face the flat base plate 13 of the other heat-exchanging plate 12 in the laminating direction, so that a clearance is provided therebetween.

The clearance between adjacent the heat-exchanging plates 12 is maintained by inserting a spacer member 32 between the adjacent heat-exchanging plates 12 at both end sides in the plate longitudinal direction. The spacer member 32 is press-formed to have protrusions and recesses corresponding to the shape of the clearance between adjacent heat-exchanging plates 12. The spacer member 32 is made from a both-surface clad plate which is formed by cladding an aluminum brazing material (e.g., A4000) on both surfaces of an aluminum core material (e.g., A3000).

The heat-exchanging plate 12 is separated into an upstream-air side plate and a downstream-air side plate in the air-flowing direction. Both longitudinal ends of the downstream-air side plate of the heat-exchanging plate 12 are connected to a tank member 33 to communicate with an inner space of the tank member 33. Similarly, both longitudinal ends of the upstream-air side plate of the heat-exchanging plate 12 are connected to a tank member 34 to communicate with an inner space of the tank member 34. The tank members 33, 34 are separately formed from the heat-exchanging plate 12.

The tank members 33, 34 are made from a both-surface clad plate which is formed by cladding an aluminum brazing material (e.g., A4000) on both surfaces of an aluminum core material (e.g., A3000). Similarly to the tank portions 15–18 described in the above-described first embodiment, the first and second refrigerant passages 19, 20 communicate with each other through the tank members 33, 34. An entire refrigerant passage structure within the evaporator 10 is similar to that in FIG. 21 described in the sixth embodiment, and the explanation thereof is omitted.

In the tenth embodiment, because the clearance extends linearly downwardly between the spacer members 32 at both longitudinal ends of the heat exchanging plate 12, the draining performance of condensed water is improved.

Further, because the heat-exchanging plate 12 is formed by the extrusion, steps for manufacturing the heat-exchanging plate 12 can be greatly reduced, as compared with a press-forming method. Further, the first and second refrigerant passages 19, 20 are provided within the heat-exchanging plate 12 at positions where the projection ribs 14 are formed. Therefore, a refrigerant leakage can be further prevented as compared with a case where the refrigerant passages 19, 20 are formed by bonding both heat-exchanging plates 12.

Figure 32:
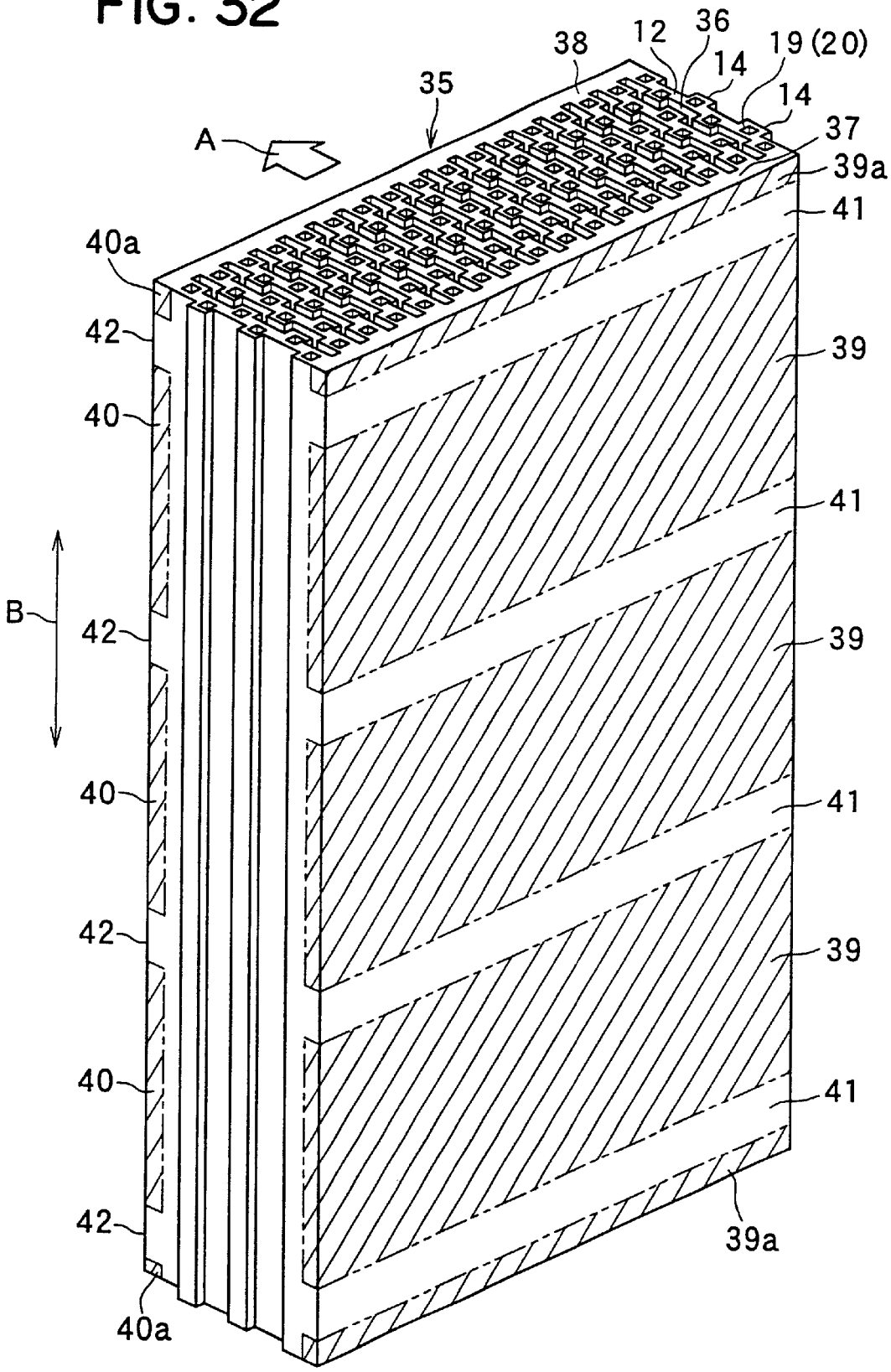
FIG. 32 is a perspective view of an extrusion body according to an eleventh preferred embodiment of the present invention.

An eleventh preferred embodiment of the present invention will be now described with reference to FIGS. 32, 33. In the eleventh embodiment, all the heat-exchanging plates 12 described in the above-described tenth embodiment are integrally formed. FIG. 32 shows an extrusion body 35 having an approximately rectangular parallelopiped shape immediately after an extrusion of an aluminum material. The extrusion body 35 includes plural heat-exchanging plates 12 corresponding to the heat-exchanging plates 12 of the tenth embodiment. In the extrusion body 35, plural projection ribs 14 protrude on both side in the plate laminating direction, the refrigerant passages 19, 20 are formed into through holes in the plate longitudinal direction in the heat exchanging plates 12 at positions where the projection ribs 14 are formed, and clearance portions 36 between adjacent heat-exchanging plates 12 define the air passage.

At a state immediately after the extrusion, because both ends of the clearance portions 36 in the air-flowing direction A are closed by outer peripheral portions 37, 38 of the extrusion body 35, the clearance portions 36 are not used as the air passage.

After removing portions 39, 39*a*, 40, 40*a* indicated by slanting lines in FIG. 32 are removed by a method such as cutting, the both ends of the clearance portions 36 in the air-flowing direction A are opened outside. FIG. 33 shows the opened state of the ends of the clearance portions 36 after the removing portions 39, 39*a*, 40, 40*a* are removed. The removing portions 39, 39*a*, 40, 40*a* are separated into plural parts in the plate longitudinal direction to have connection portions 41, 42 therebetween. By the connection portions 41, 42 each having a narrow width, the integrated state of the heat-exchanging plates 12 is maintained. Thus, in the eleventh embodiment, the spacer member 32 described in the above-described tenth embodiment is not necessary.

Holding plates 44, 45 having slit portions 43 into which both upper and lower ends of the heat-exchanging plates 12 are inserted are disposed in and are fitted to the removing portions 39*a*, 40*a* at both ends in the extrusion body 35. Further, tank members 46, 47 are attached to the upper and lower holding plates 44, 45, respectively. The holding plates 44, 45 and the tank members 46, 47 are molded from an aluminum material, and are integrally bonded through brazing.

Figure 33:
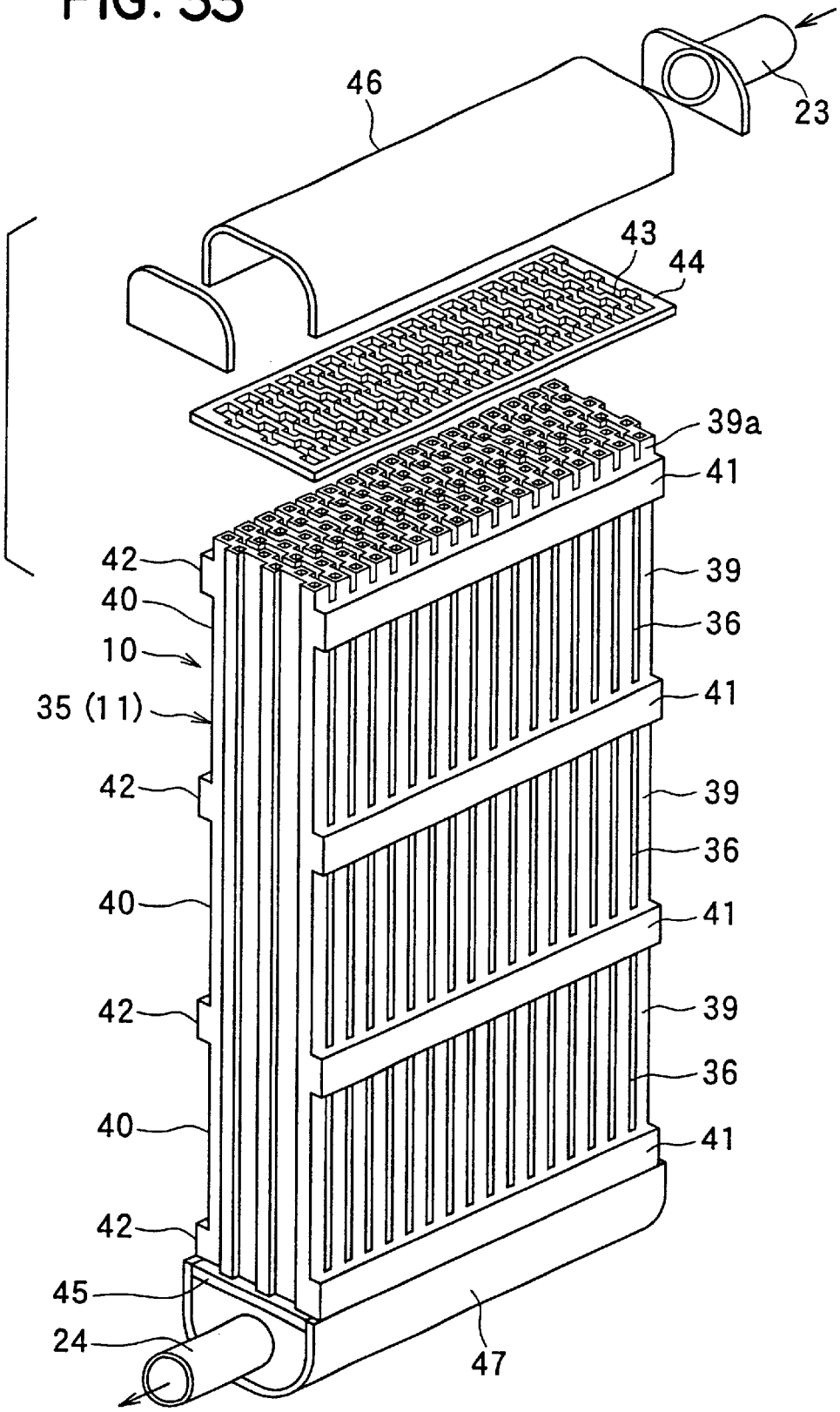
FIG. 33 is a disassembled perspective view of the extrusion body according to the eleventh embodiment.

As shown in FIG. 33, the refrigerant inlet pipe 23 is disposed in the upper tank member 46, and the refrigerant outlet pipe 24 is disposed in the lower tank member 47.

Therefore, refrigerant flowing into the upper tank member 46 from the refrigerant inlet pipe 23 is distributed into the refrigerant passage 19 (20) within each heat-exchanging plate 12. Refrigerant having passing through the refrigerant passage 19 (20) is collected into the lower tank member 47, and thereafter, is discharged to an outside from the refrigerant outlet pipe 24.

Figure 35:
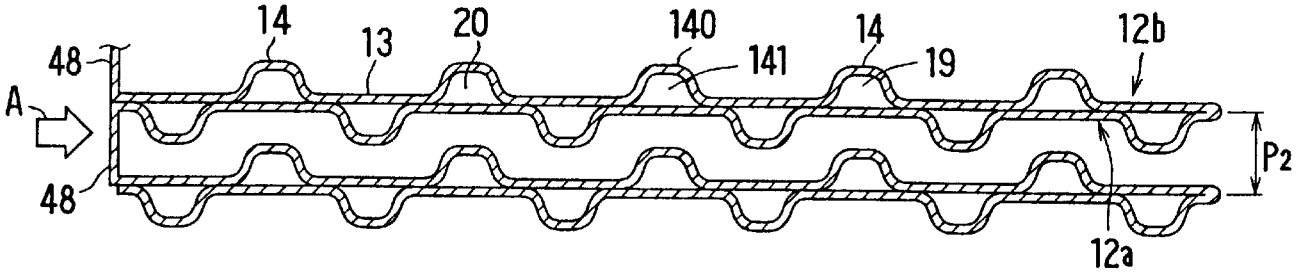
FIG. 35 is a cross-sectional view taken along line 35'–35' in FIG. 34 after bending the heat-exchanging plates of the twelfth embodiment.
Figure 36:
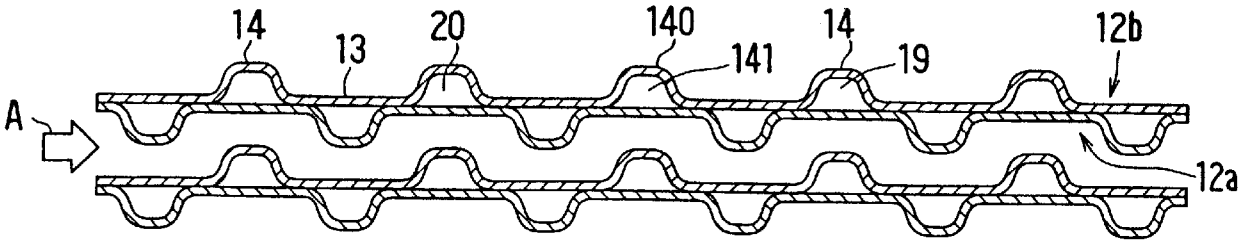
FIG. 36 is a cross-sectional view taken along line 36'–36' in FIG. 34 after bending the heat-exchanging plates of the twelfth embodiment.

A twelfth preferred embodiment of the present invention will be now described with reference to FIG. FIGS. 34–36. In the twelfth embodiment of the present invention, the forming state of the heat-exchanging plate 12 and the assembling method of the evaporator 10 (heat exchanger) are changed.

In the above-described first through ninth embodiments, the refrigerant passages 19, 20 are formed between the heat-exchanging plates 12*a* and 12*b*, or 12*a* and 12*b*, or the heat-exchanging plates 12, 12. In the present invention, because a fin member is unnecessary, the heat-exchanging plates 12*a*–12*c*, 12 can be formed by bending a single plate member.

Figure 34:
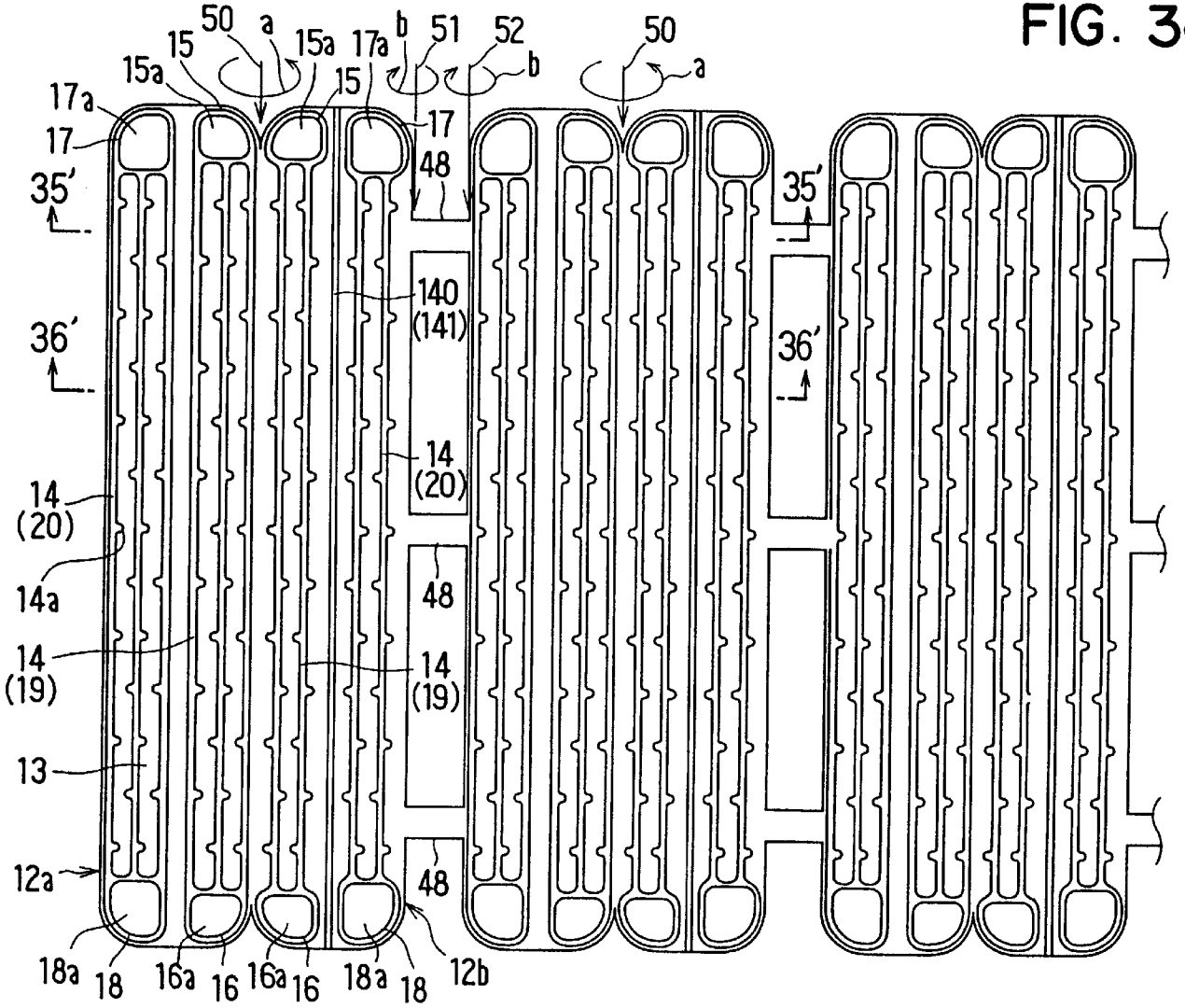
FIG. 34 is a plan view showing heat-exchanging plates according to a twelfth preferred embodiment of the present invention.

Thus, in the twelfth embodiment of the present invention, as shown in FIG. 34, the heat-exchanging plate 12*a* indicated in FIG. 3 of the first embodiment and the heat-exchanging plate 12*b* indicated in FIG. 4 of the first embodiment are adjacently integrally formed, while each pair of the heat-exchanging plates 12*a*, 12*b* are integrally connected by connection portions 48 each having a narrow width.

Thereafter, both the heat-exchanging plates 12*a*, 12*b* are bent at a center portion 50 therebetween in a direction as shown by arrow "a" in FIG. 34, so that the protrusion outer surfaces of the projection ribs 14 are placed toward outside and the flat base plates 13 contact each other. Further, the connection portions 48 are bent at root portions 51, 52 at both ends thereof, in a direction as shown by arrow "b" in FIG. 34 (i.e., a direction opposite to the direction shown by arrow "a"), so that a predetermined clearance for forming the air passage is provided outside the heat-exchanging plates 12*a*, 12*b*. FIG. 35 shows a sectional shape after bending the heat-exchanging plates 12*a*, 12*b*, when being taken from line 35'–35' in FIG. 34. On the other hand, FIG. 36 shows a sectional shape after bending the heat-exchanging plates 12*a*, 12*b*, when being taken from line 36'–36' in FIG. 34.

Similarly, the first and third heat-exchanging plates 12*a* and 12*c*, or the heat-exchanging plates 12 can be integrally formed from a plate member, and thereafter, can be integrally assembled by bending. That is, in the twelfth embodiment, plural the heat-exchanging plates 12, 12*a*, 12*b*, 12*c* can be formed into a plurally-bent single-plate state without being separated from each other, or can be formed into partially separated state.

Figure 37:
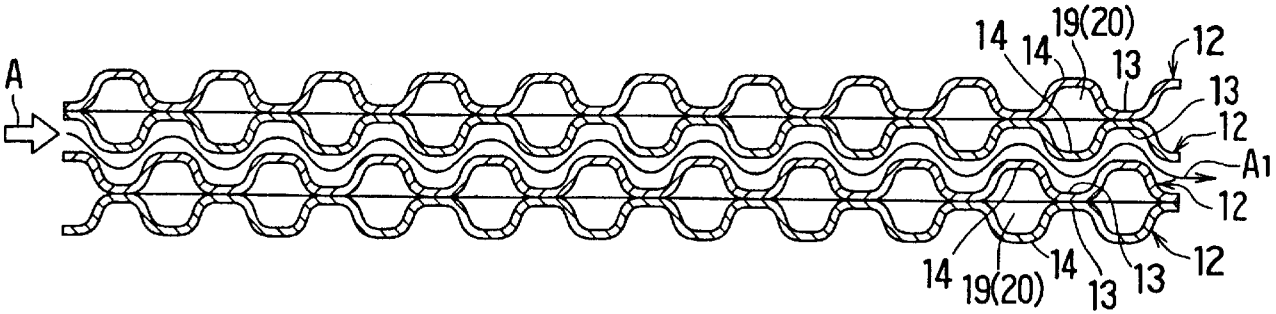
FIG. 37 is a sectional view showing an assembling state of heat-exchanging plates according to a thirteenth preferred embodiment.

A thirteenth preferred embodiment of the present invention will be now described with reference to FIG. 37. In the thirteenth embodiment, as shown in FIG. 37, in each pair of heat exchanging plates 12 for forming the refrigerant passages 19, 20, the projection ribs 14 and the flat base plates 13 are positioned at the same positions in the air-flowing direction A. Further, between adjacent heat-exchanging plates 12 for forming the air passage, the positions of the projection ribs 14 and the flat base plates 13 are offset to form the wave-shaped air passage A1.

A fourteenth preferred embodiment of the present invention will be now described with reference to FIGS. 38–40. In the fourteenth embodiment, the portions similar to those in the above-described first embodiment are indicated with the same reference numbers, and the explanation thereof is omitted.

In the above-described first embodiment, each of the heat-exchanging plates 12*a*–12*c* is made from a both-surface clad plate which is formed by cladding an aluminum brazing material (e.g., A4000) on both surfaces of an aluminum core material (e.g., A3000). However, in the fourteenth embodiment, each of the heat-exchanging plates 12*a*–12*c* is made from a single-surface clad plate which is formed by cladding an aluminum brazing material (e.g., A4000) only on one surface of an aluminum core material (e.g., A3000). When the single-surface clad plate is used as each of the heat-exchanging plates 12*a*–12*c*, and the tank portions 15–18 are formed as shown in FIG. 7 of the first embodiment, the contacting surface portion D of the tank portions 15–18 are not brazed. Thus, in the fourteenth embodiment, the shape of the tank portions 15–18 is changed so that the contacting surface portion D of the tank portions 15–18 can be sufficiently brazed even when the single-surface clad plate is used as each of the heat-exchanging plates 12*a*–12*c*.

Figure 38:
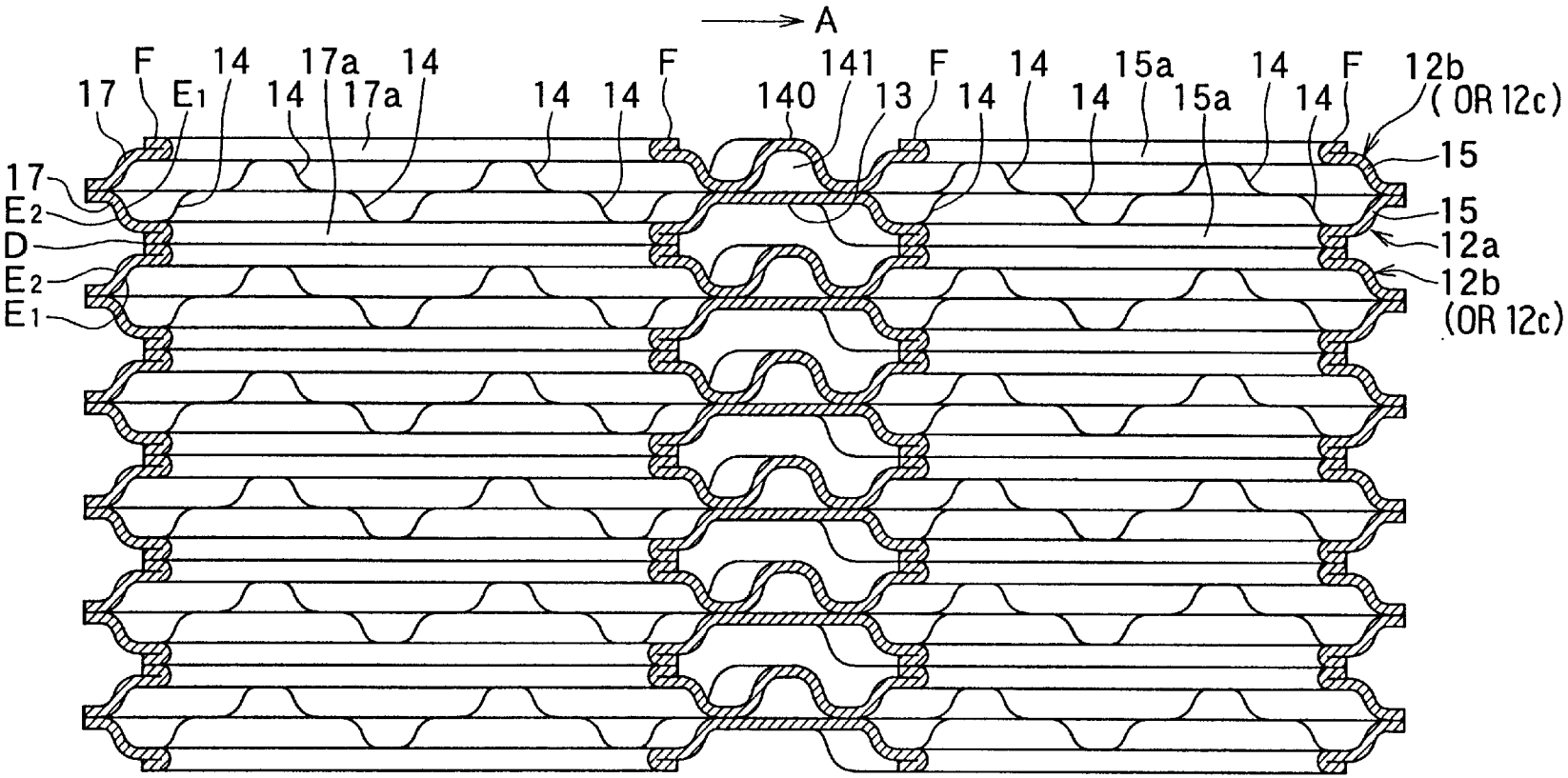
FIG. 38 is a sectional view showing a tank portion according to a fourteenth preferred embodiment of the present invention.

FIG. 38 is a sectional view showing a connection structure of the upper tank portions 15, 17 between the first heat-exchanging plate 12*a* and the second or third heat-exchanging plate 12*b* (12*c*). In the fourteenth embodiment, the lower tank portions 16, 18 have a connection structure similar to that of the upper tank portions 15, 17. In each of the heat-exchanging plates 12*a*–12*c*, one side surface E1 on which the flat base plates 13 contact each other is clad by the brazing material, and the other side surface E2 opposite to the one side surface E1 is not clad.

In each top portion of the tank portions 15–18, bent portions F are formed in peripheral portions of the communication holes 15*a*–18*a* so that the clad brazing material is exposed outside. Therefore, in the top portions of the tank portions 15–18, the bent portions F around the peripheral portions of the communication holes 15*a*–18*a* contact each other to be bonded by brazing. Thus, the contacting surface portion D of the tank portions 15–18 can be sufficiently brazed even when the single-surface clad plate is used as each of the heat-exchanging plates 12*a*–12*c*.

Figures 39A, 39B, 39C, 39D:
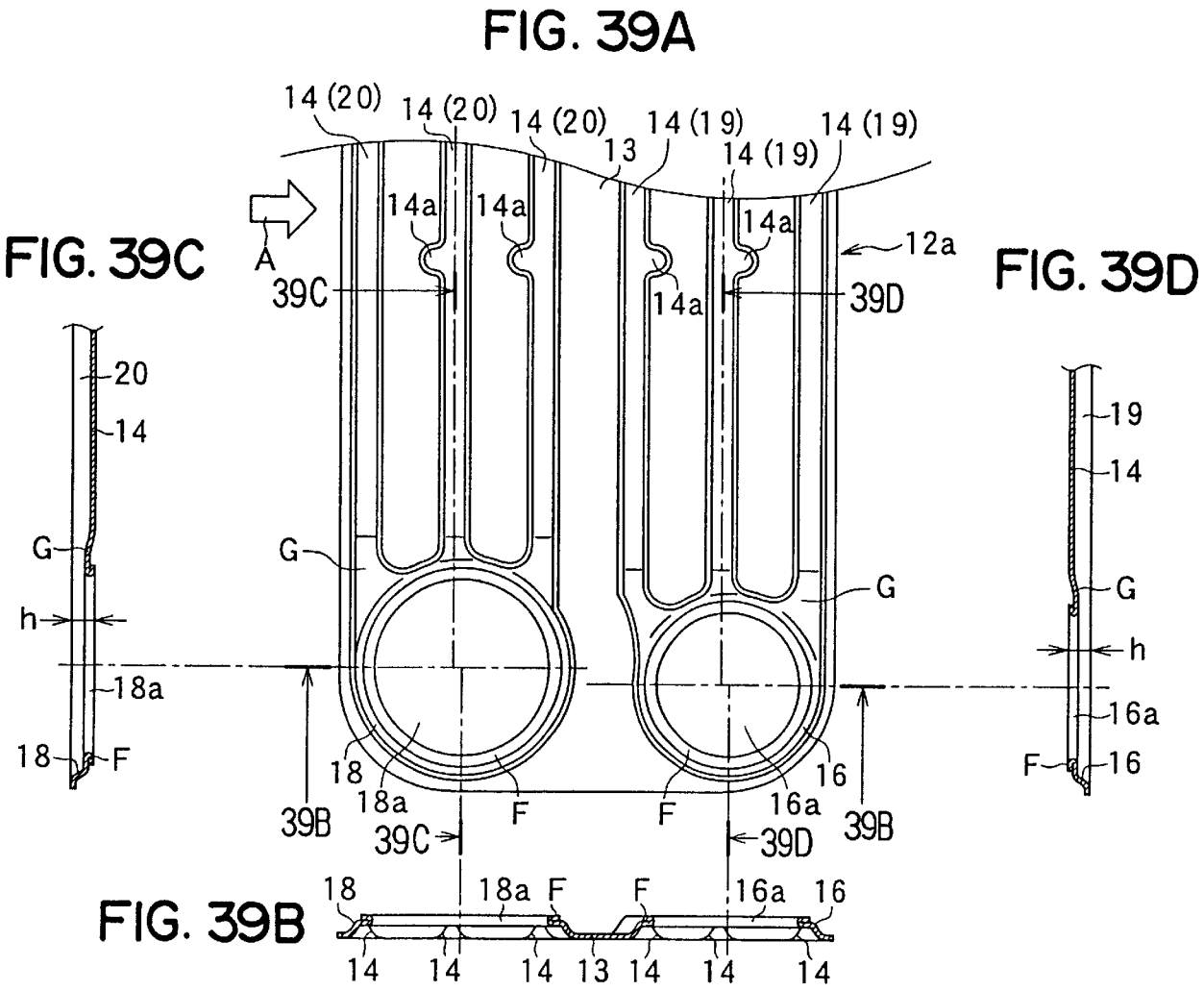
FIG. 39A is a plan view showing a part of a first heat-exchanging plate according to the fourteenth embodiment.
FIG. 39B is a cross-sectional view taken along line 39B—39B in FIG. 39A.
FIG. 39C is a cross-sectional view taken along line 39C—39C in FIG. 39A.
FIG. 39D is a cross-sectional view taken along line 39D—39D in FIG. 39A.

FIGS. 39A, 39B, 39C, 39D show a tank structure of the first heat-exchanging plate 12*a* according to the fourteenth embodiment. In FIG. 39A, only the lower tank portions 16, 18 are indicated; however, the upper tank portions 15, 17 have the same structure of the lower tank portions 16, 18. FIG. 39B is a sectional view taken along line 39B—39B in FIG. 39A, FIG. 39C is a sectional view taken along line 39C—39C in FIG. 39A, and FIG. 39D is a sectional view taken along line 39D—39D in FIG. 39A. As shown in FIGS. 39C, 39D, each of the projection ribs 14 has a protrusion height "h" equal to that of the rank portions 16, 18. Therefore, an inclined surface G inclined downwardly from the protrusion top surfaces of the projection ribs 14 toward the tank portions 16, 18 are formed in the protrusion portions of the tank portions 16, 18 due to the plate thickness of the bent portion F.

Figures 40A, 40B, 40C, 40D:
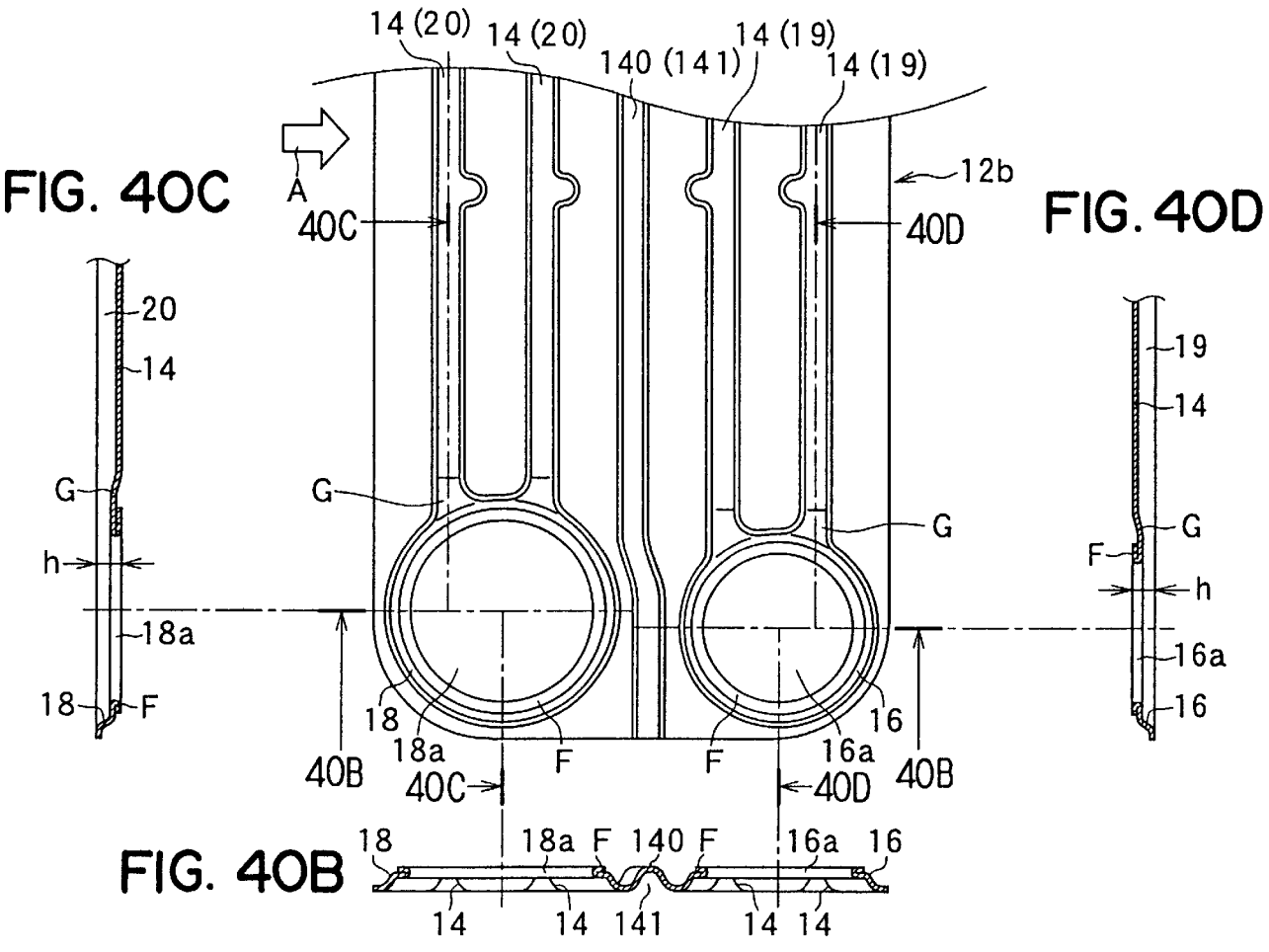
FIG. 40A is a plan view showing a part of a second heat-exchanging plate according to the fourteenth embodiment.
FIG. 40B is a cross-sectional view taken along line 40B—40B in FIG. 40A.
FIG. 40C is a cross-sectional view taken along line 40C—40C in FIG. 40A.
FIG. 40D is a cross-sectional view Is taken along line 40D—40D in FIG. 40A.

FIGS. 40A, 40B, 40C, 40D show a tank structure of the second heat-exchanging plate 12*b* according to the fourteenth embodiment. Similarly, FIG. 40B is a sectional view taken along line 40B—40B in FIG. 40A, FIG. 40C is a sectional view taken along line 40C—40C in FIG. 40A, and FIG. 40D is a sectional view taken along line 40D—40D in FIG. 40A. As shown in FIGS. 40C, 40D, each of the projection ribs 14 has a protrusion height "h" equal to that of the rank portions 16, 18. Further, similarly to the first heat-exchanging plate 12*a*, the second heat-exchanging plate 12*b* has the inclined surface G inclined downwardly from the protrusion top surfaces of the projection ribs 14 toward the tank portions 16, 18.

The third heat-exchanging plate 12*c* has a shape approximately similar to that of the second heat-exchanging plate 12*b*. In the third heat-exchanging plate 12*c*, only the communication passage 120 is different from the second heat-exchanging plate 12*b*.

Figure 41:
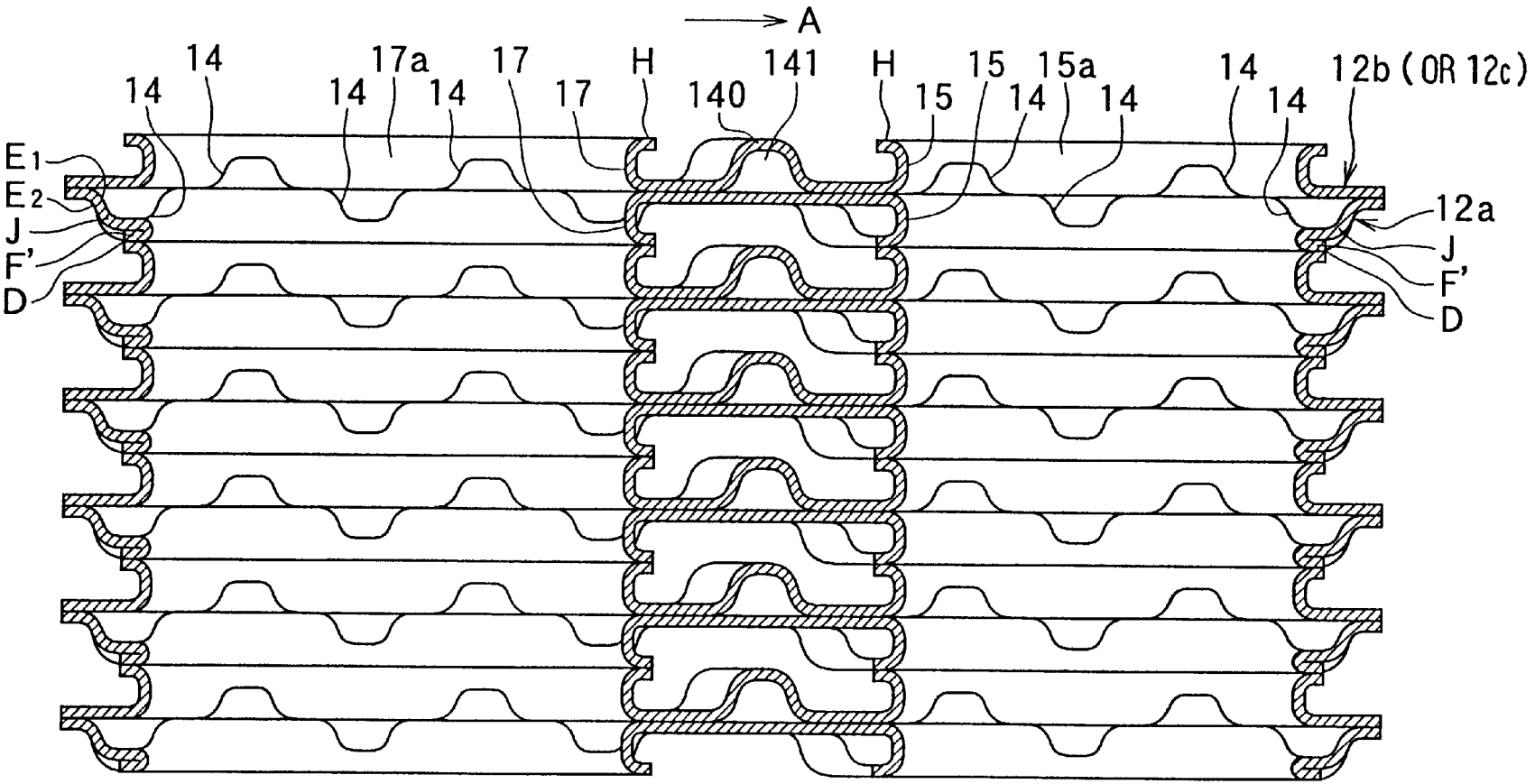
FIG. 41 is a sectional view of a tank portion according to a fifteenth preferred embodiment of the present invention.

A fifteenth preferred embodiment of the present invention will be now described with reference to FIG. 41. The fifteenth embodiment is a modification of the fourteenth embodiment. As shown in FIG. 41, each of the tank portions 15, 17 is formed into a cylindrical shape, and has a flange portion H bent toward outside. Similarly, each of the tank portions 16, 18 is formed into a cylindrical shape, and has a flange portion H bent toward outside.

According to the fifteenth embodiment of the present invention, in each of the tank portions 15–18, at the flange portions H, the brazing material clad on only the one side surface E1 is exposed. Therefore, it is possible to contact and bond outside surfaces of the tank portions 15–18. In the first heat-exchanging plate 12*a*, for communicating the refrigerant passage of the tank portions 15–18 and the refrigerant passages 19, 20 with each other, a bent portion J is formed so that a part of the cylindrical shaped inner portion in the tank portions 15–18 extends outside. Further, at only the bent portion J, a bent portion F' is formed in the tank portions 15–18. Thus, the contacting surface portion D of the tank portions 15–18 can be sufficiently brazed even when the single-surface clad plate is used as each of the heat-exchanging plates 12*a*–12*c*.

Figure 42:
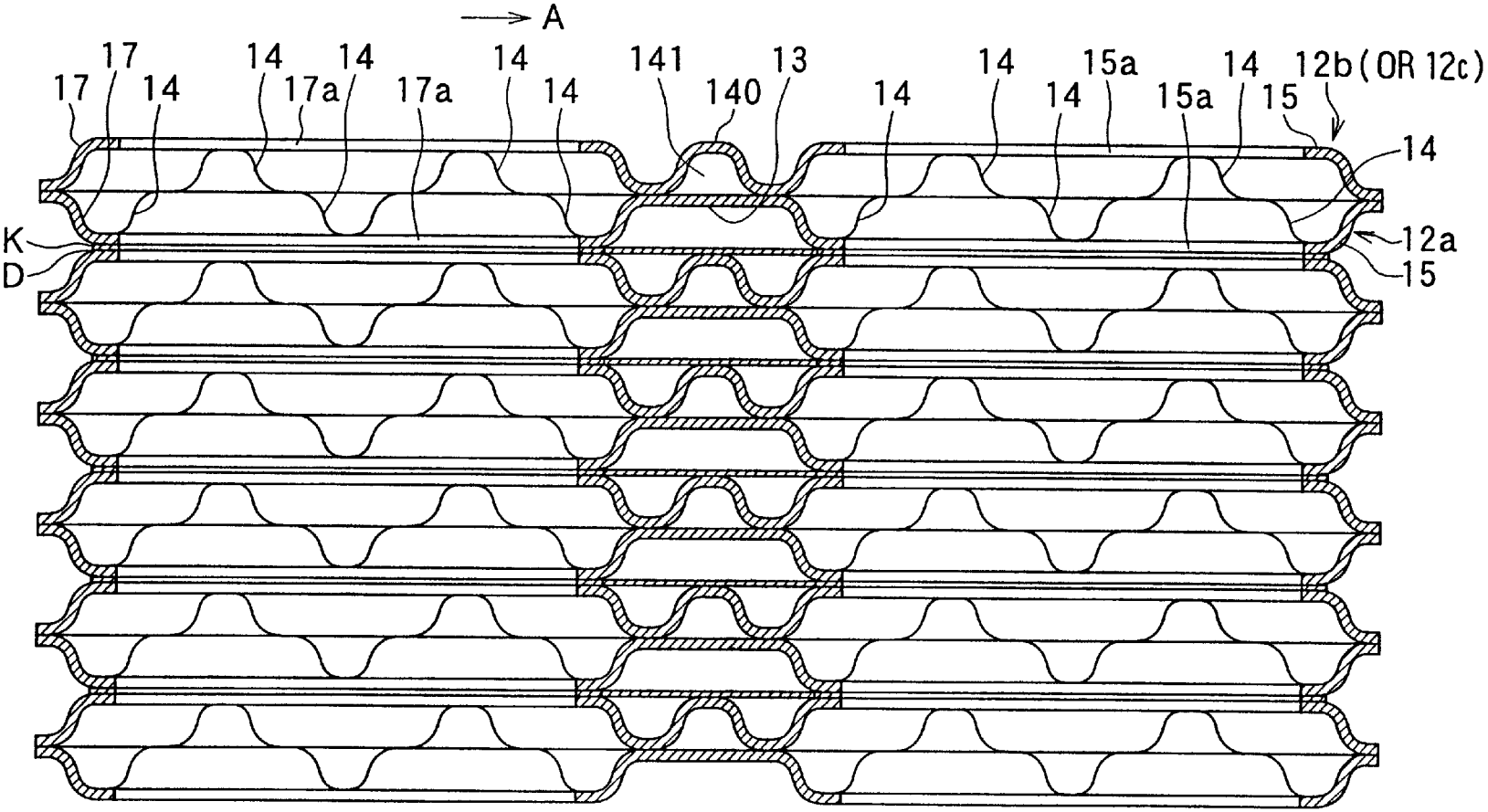
FIG. 42 is a sectional view of a tank portion according to a sixteenth preferred embodiment of the present invention.

A sixteenth preferred embodiment of the present invention will be now described with reference to FIG. 42. In the above-described fourteenth and fifteenth embodiments, for using the single-surface clad plate as the heat-exchanging plates 12*a*, 12*b*, 12*c*, the bent portions F, F' or the flange portion H are formed. However, in the sixteenth embodiment, the tank portions 15–18 has shapes similar to that in FIG. 7 of the first embodiment, while the single-surface clad plate is used. In the sixteenth embodiment, a both-surface clad plate K is formed to be separated from the heat-exchanging plates 12*a*–12*c*. The both-surface clad plate K has a shape corresponding to the contacting surfaces D of the tank portions 15–19.

The both-surface clad plate K is assembled into the contacting surfaces D of the tank portions 15–19, so that the contacting surfaces D of the tank portions 15–19 are brazed by using the brazing material of the plate K. Instead of the both-surface clad plate K, a brazing plate K made of only brazing material may be used.

Figures 43, 44:
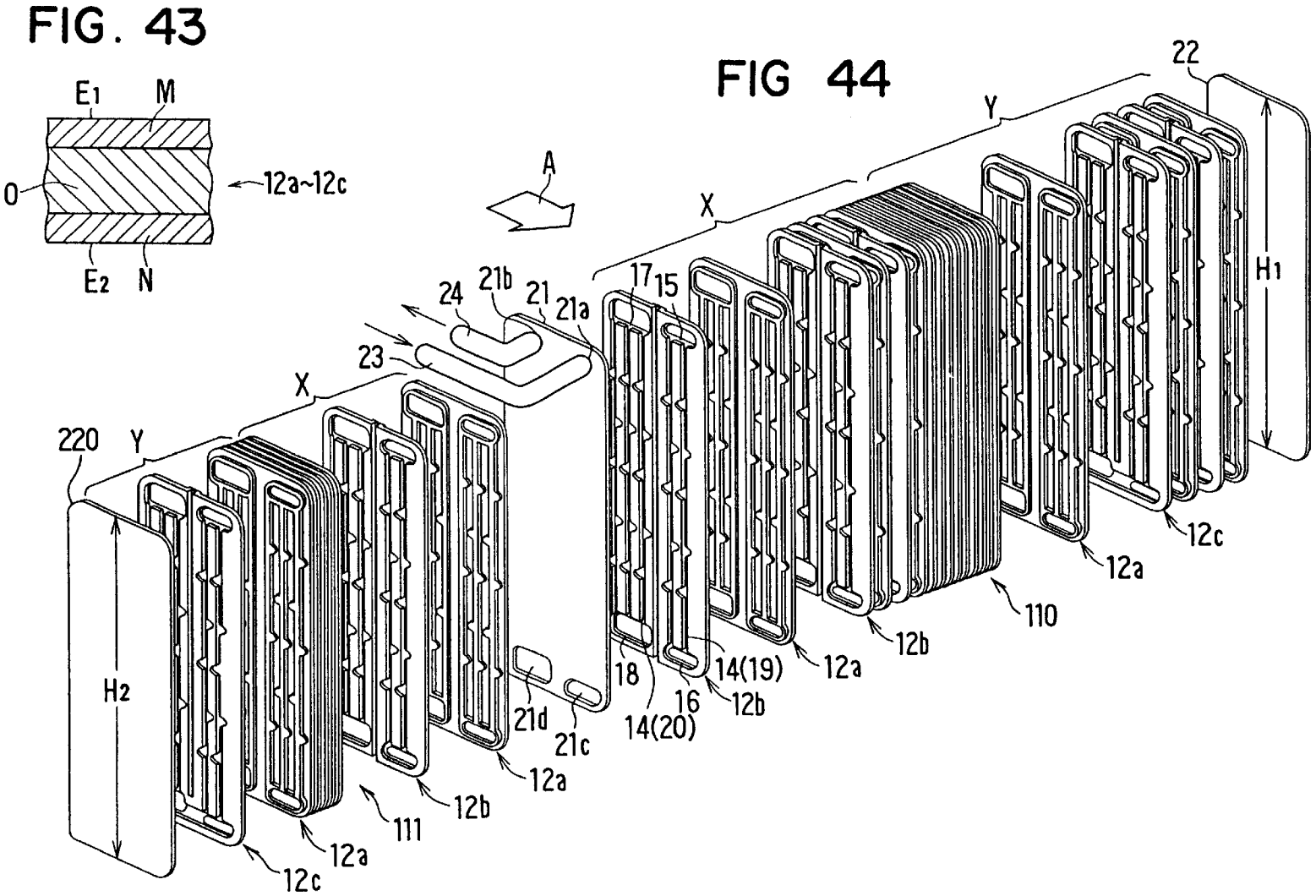
FIG. 43 is a sectional view of a heat-exchanging plate according to a seventeenth preferred embodiment of the present invention.
FIG. 44 is a disassembled perspective view showing an evaporator according to an eighteenth preferred embodiment of the present invention.

A seventeenth preferred embodiment of the present invention will be now described with reference to FIG. 43. FIG. 43 shows each material structure of the heat-exchanging plates 12*a*–12*c*, 12 according to the seventeenth embodiment. As shown in FIG. 43, relative to a core material layer O made of an aluminum core material (e.g., A3000), a brazing material layer M made of aluminum brazing material (e.g., A4000) is clad only on one surface E1, and a sacrifice corrosion layer N is clad on the other surface E2. The sacrifice corrosion layer N is made by mixing a little material having a low electrode potential such as Zn into A3000-aluminum material.

According to the seventeenth embodiment of the present invention, the brazing material is only clad on the one surface of the core layer O, and corrosion resistance performance is improved by the sacrifice corrosion layer N. Therefore, the plate thickness of the heat-exchanging plates 12*a*, 12*b*, 12*c*, 12 can be thinned to 0.25 mm, while the corrosion resistance performance is improved. Thus, the evaporator 10 has a reduced weight and a reduced size, while being manufactured in low cost.

An eighteenth preferred embodiment of the present invention will be now described with reference to FIGS. 44, 45. In the eighteenth embodiment, a heat-exchanging core portion 11 includes a first core portion 110 having a first height H1 (i.e., a dimension in the up-down direction in FIG. 44) and a second core portion 111 having a second height H2 lower than the first height H1 by a predetermined dimension (H2<H1). That is, the first core portion 110 having the first height H1 corresponds to the core portion 11 of the above-described first embodiment. Relative to the end plate 21 to which the refrigerant inlet pipe 23 and the refrigerant outlet pipe 24 are connected, plural heat-exchanging plates 12*a*–12*c* and an end plate 220 having the second height H2 are disposed outside in the laminating direction.

According to the eighteenth embodiment of the present invention, the first and second core portions 110, 111 are formed by only the heat-exchanging plates 12*a*, 12*b*, 12*c* having the projection ribs 14 for defining the refrigerant passages 19, 20 without using a fin member such as corrugated fin. Thus, the core portion 11 having the first and second core portions 110, 111 is readily formed into a step like.

In the above-described first embodiment of the present invention, because a pipe joint and an expansion valve connected to the refrigerant inlet pipe 23 and the refrigerant outlet pipe 24 protrude to an outside of the end plate 21, a dead space is generated around the refrigerant inlet and outlet pipes 23, 24, the pipe joint, and the expansion valve. However, in the eighteenth embodiment, the second core portion 111 having the second height H2 is disposed in an arrangement space under the refrigerant inlet and outlet pipes 23, 24, the pipe joint and the expansion valve. Therefore, the cooling effect of the evaporator 10 can be further improved by the second core portion 11.

Next, an entire refrigerant passage structure of the evaporator 10 according to the eighteenth embodiment will be now described with reference to FIG. 45. In the eighteenth embodiment, as shown in FIG. 44, the refrigerant inlet pipe 23 and the refrigerant outlet pipe 24 are disposed in an upper side of the end plate 21, and a refrigerant branching hole 21*c* and a refrigerant returning hole 21*d* are opened in a lower side of the end plate 21. Further, the heat-exchanging area X formed by combining the first and second heat-exchanging plates 12*a*, 12*b* and the second heat-exchanging area Y formed by combining the first and third heat-exchanging plates 12*a*, 12*c* are respectively provided between the end plates 21 and 22 of the first core portion 110 and between the ends plates 21 and 220 of the second core portion 111.

Further, in the first core portion 110, in addition to the partition members 27, 28 for partitioning the heat-exchanging areas X, Y, partition members 27*a*, 28*a* are provided in the heat-exchanging area X. Further, in the second core portion 111, partition members 27*b*, 28*b* for partitioning both the heat-exchanging areas X, Y are also provided.

Thus, refrigerant from the refrigerant inlet pipe 23 firstly flows through the left side of the first refrigerant passage 19 in the area X of the first core portion 110 downwardly. Thereafter, refrigerant is branched at a position (i.e., the point P in FIG. 45) of the lower tank 16 of the first and second heat-exchanging plates 12*a*, 12*b*, so that a part of refrigerant flows into the heat-exchanging area X of the second core portion 111 through the refrigerant branching hole 21*c*.

Figure 45:
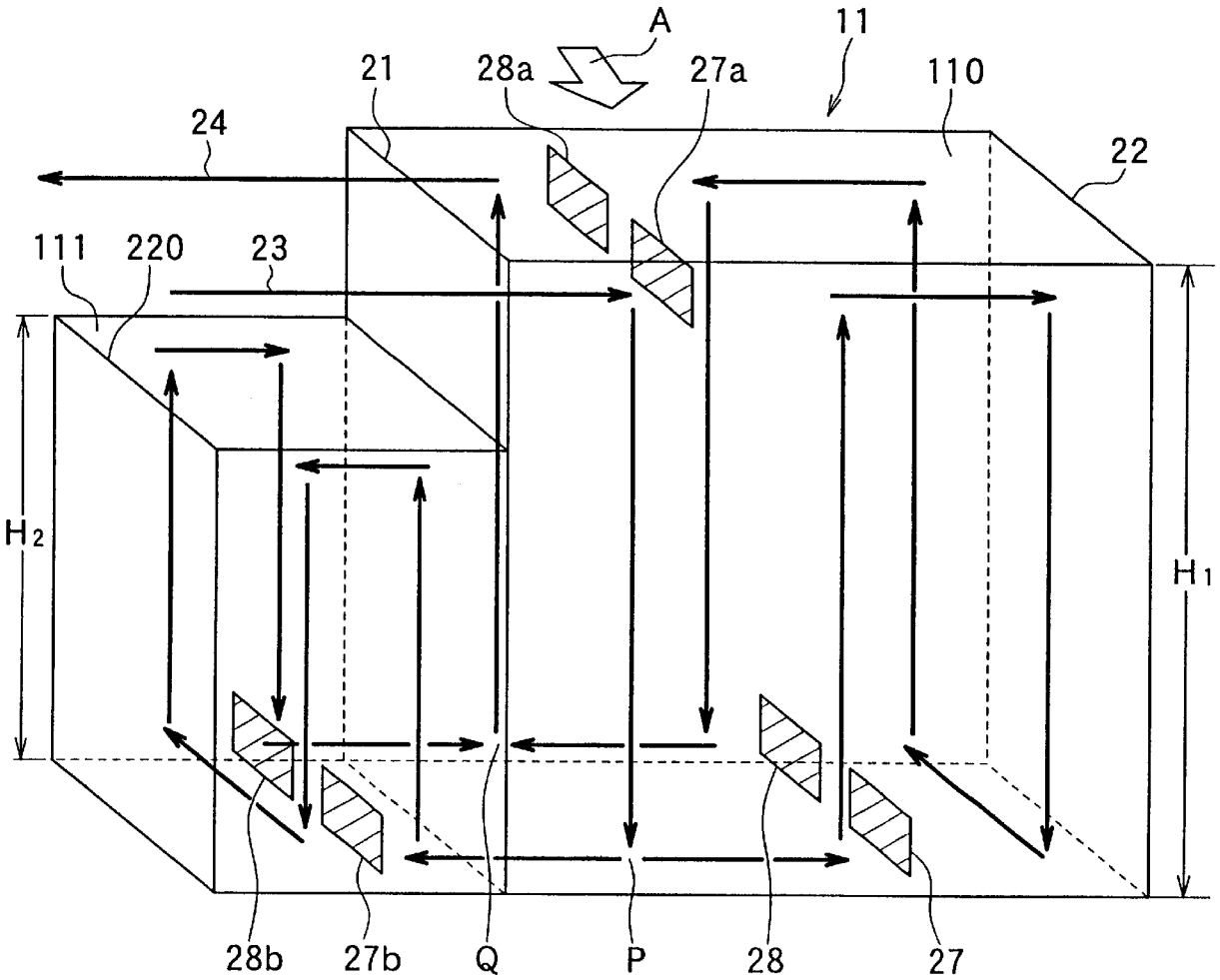
FIG. 45 is a schematic perspective view showing a refrigerant passage of the evaporator according to the eighteenth embodiment.

Thus, as shown by the arrows in FIG. 45, refrigerant flows in parallel between the heat-exchanging areas X, Y of the first core portion 110 and the heat-exchanging areas X, Y of the second core portion 111. Thereafter, refrigerant of the second core portion 111 flows into the lower tank portion 18 (shown by the point Q in FIG. 45) to be collected with refrigerant in the first core portion 110. The collected refrigerant flows upwardly through the refrigerant passage 20 in the heat-exchanging area X of the first core portion 110, and flows outside from the refrigerant outlet pipe 24. In the eighteenth embodiment, the refrigerant flow in the first core portion 110 and the refrigerant flow in the second core portion 111 are indicated in detail in FIG. 45. In the eighteenth embodiment, the other portions are similar to those in the above-described first embodiment of the present invention.

Figure 46:
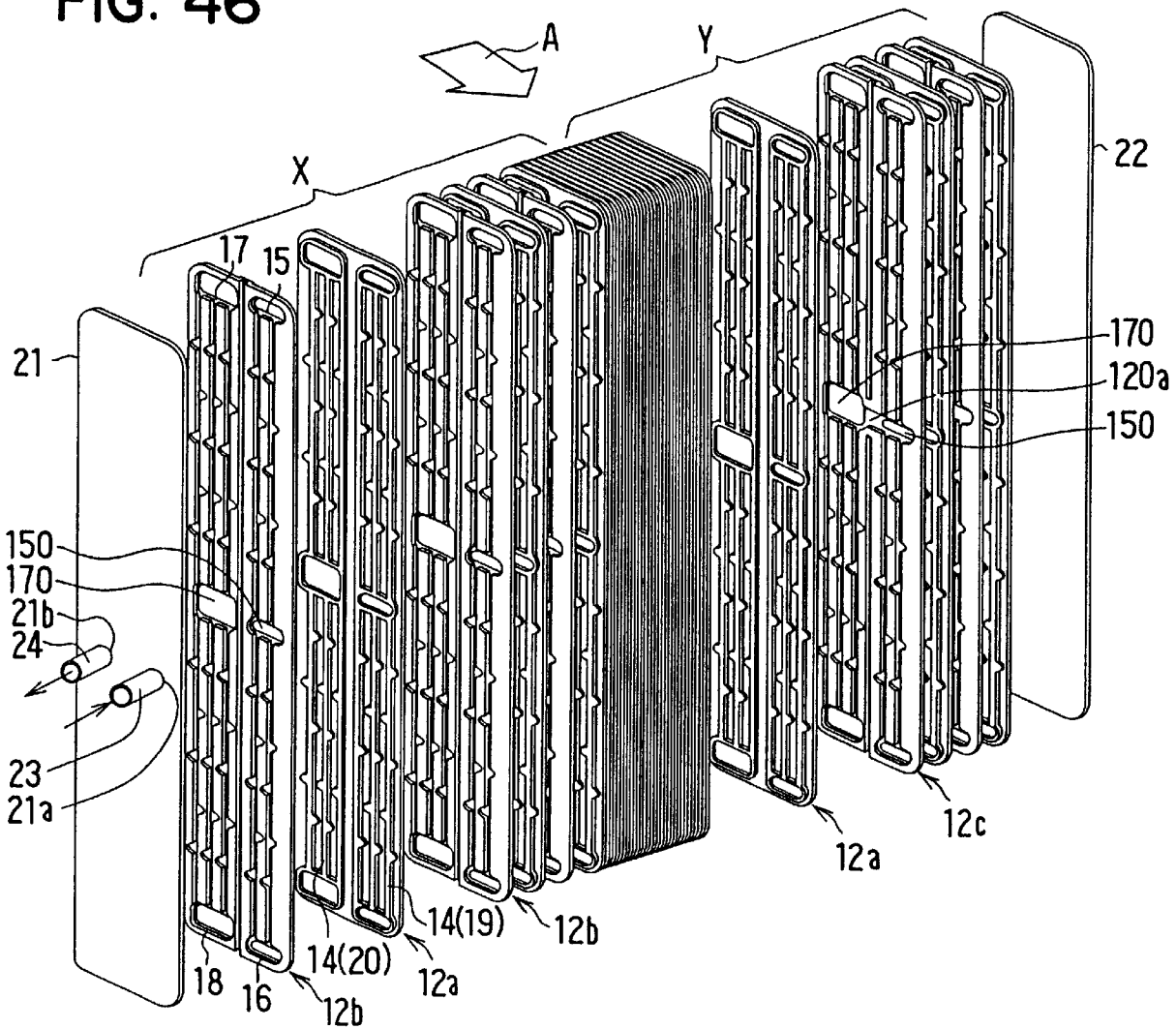
FIG. 46 is a disassembled perspective view showing an evaporator according to a nineteenth preferred embodiment of the present invention.
Figure 47:
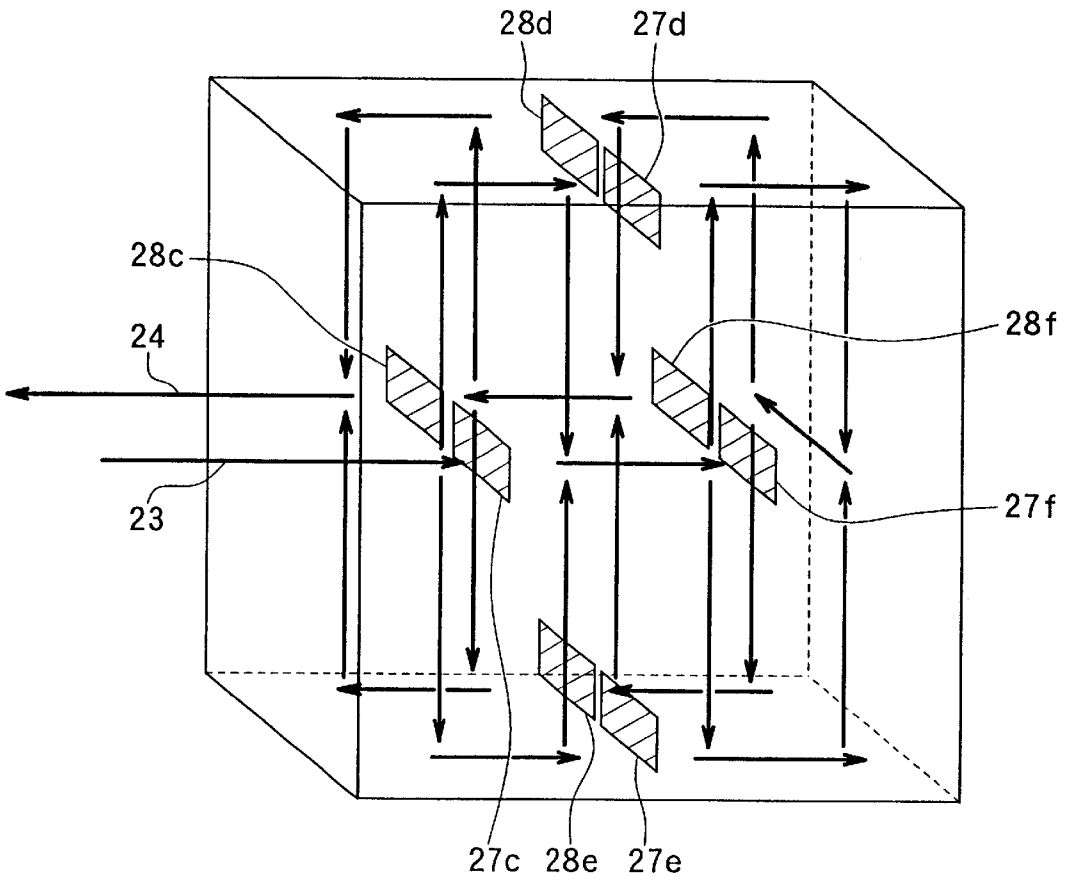
FIG. 47 is a schematic perspective view showing a refrigerant passage of the evaporator according to the nineteenth embodiment.

A nineteenth preferred embodiment of the present invention will be now described with reference to FIGS. 46, 47. As shown in FIGS. 46, 47, in the nineteenth embodiment, while the tank portions 15–18 are provided at both ends of the heat-exchanging plates 12*a*–12*c* in the plate longitudinal direction, tank portions 150, 170 are added at an approximately center portion in the plate longitudinal direction. Further, the refrigerant inlet pipe 23 and the refrigerant outlet pipe 24 are provided in the end plate 21 at an approximately center portion in the plate longitudinal direction to be respectively directly connected to the tank portions 150, 170.

In a case where the refrigerant inlet and outlet pipes 23, 24 are necessary to be arranged at the center portion in the plate longitudinal direction, when the tank portions 150, 170 are not provided in the heat-exchanging plates 12*a*, 12*b*, 12*c* as described in the first embodiment, it is necessary to provide a side refrigerant passage between both end plates 21, thereby increasing pressure loss of the refrigerant passage of the evaporator 10.

According to the nineteenth embodiment, even when the refrigerant inlet and outlet pipes 23, 24 are disposed in the end plate 21 at a center portion of the plate longitudinal direction, because the refrigerant inlet and outlet pipes 23, 24 are directly connected to the tank portions 150, 170, the pressure loss is prevented from being increased.

Similarly to the above-described first embodiment, the heat-exchanging area X is formed by combining the first and second heat-exchanging plates 12*a*, 12*b*, and the heat-exchanging area Y is formed by combining the first and third heat-exchanging plates 12*a*, 12*c*. In the above-described first embodiment, the communication passage 120 for directly communicating the tank portions 16, 18 are formed in the third heat-exchanging plate 12 between the tank portions 16, 18 of the third heat-exchanging plate 12*c*. However, in the nineteenth embodiment, a communication passage 120*a* for directly communicating the tank portions 150, 170 is provided in the third heat-exchanging plate 12*c* between the tank portions 150, 170.

Further, as shown in FIG. 47, in the nineteenth embodiment, four partition members 27*c*–27*f* are provided in the first refrigerant passage 19 on the downstream air side, and four partition members 28*c*–28*f* are provided in the second refrigerant passage 20 on the upstream air side. Thus, as shown by arrows in FIG. 47, refrigerant from the refrigerant inlet pipe 23 is branched to flow upwardly and downwardly in parallel in the first refrigerant passage 19, and both the refrigerant flows are collected, and thereafter, the collected refrigerant is further branched to flow upwardly and downwardly in parallel. Thereafter, both refrigerant flows are collected, and flows into the second refrigerant passage 20 through the communication passage 120*a*. In the second refrigerant passage 20, the branching and the collection of refrigerant are repeated, and flows to the outside from the refrigerant outlet pipe 24.

Although the present invention has been fully described in connection with the preferred embodiments thereof with reference to the accompanying drawings, it is to be noted that various changes and modifications will become apparent to those skilled in the art.

In the above-described embodiments, the present invention is applied to the evaporator 10 where the flow direction A of air (outside fluid) is approximately perpendicular to the refrigerant-flowing direction (plate longitudinal direction) B in the heat-exchanging plates 12*a*–12*c*, 12. However, the air-flowing direction A may be inclined relative to the refrigerant-flowing direction B in the heat-exchanging plates 12*a*–12*c*, 12 to be crossed by a predetermined angle.

In the above-described embodiments, the present invention is typically applied to the evaporator 10 of the refrigerant cycle. However, the present invention may be applied to an any heat exchanger for performing a heat exchange.

Such changes and modifications are to be understood as being within the scope of the present invention as defined by the appended claims.

What is claimed is:

1. A heat exchanger for performing a heat exchange between an inside fluid and an outside fluid, the heat exchanger comprising:

plural pairs of heat-exchanging plates each having a plurality of projection ribs, each pair of said heat-exchanging plates facing each other in such a manner that, said projection ribs protrude outwardly to form therein an inside fluid passage through which the inside fluid flows, and to form an outside fluid passage through which the outside fluid flows between adjacent pairs of said heat-exchanging plates, wherein:

said projection ribs protrude from flat surfaces of said heat-exchanging plates to said outside fluid passage to disturb a flow of the outside fluid; and said projection ribs are provided in each of said heat-exchanging plates to have a protrusion pitch (P1) between adjacent projection ribs, said protrusion pitch being in a range of 10–20 mm.

2. The heat exchanger according to claim 1, wherein adjacent pairs of said heat-exchanging plates are provided to have a passage pitch (P2) which is a distance between said inside fluid passages of the adjacent pairs of said heat-exchanging plates, said passage pitch being in a range of 1.4–3.9 mm.

3. The heat exchanger according to claim 2, wherein said passage pitch is set in a range of 1.4–2.3 mm.

4. The heat exchanger according to claim 1, wherein adjacent pairs of said heat-exchanging plates have a clearance therebetween to form said outside fluid passage, said clearance being in a range of 0.7–1.95 mm.

5. The heat exchanger according to claim 1, wherein said inside fluid passages are provided inside said projection ribs by connecting each pair of said heat-exchanging plates.

6. The heat exchanger according to claim 5, wherein each of said heat-exchanging plates has a plate thickness, and the plate thickness is in a range of 0.1–0.35 mm.

7. The heat exchanger according to claim 6, wherein:

each of said heat-exchanging plates has plural protrusions protruding from side surfaces of said projection ribs;

said protrusions contact each other to have contacting portions when said heat-exchanging plates are laminated; and said heat-exchanging plates are bonded at the contacting portions.

8. The heat exchanger according to claim 1, wherein said heat-exchanging plates are made of an H-material of an aluminum alloy.

9. The heat exchanger according to claim 1, wherein:

each pair of said heat-exchanging plates contact each other on said flat surfaces to be bonded; and said projection ribs protrude outside of each pair of said heat-exchanging plates from said flat surfaces.

10. The heat exchanger according to claim 9, wherein:

each of said projection ribs has a protrusion top surface; and said protrusion top surfaces of said projection ribs in one heat-exchanging plate face said flat surfaces of an adjacent heat-exchanging plate to have a predetermined clearance therebetween in a laminating direction of said heat-exchanging plates.

11. The heat exchanger according to claim 9, wherein in each pair of said heat-exchanging plates, said inside fluid passages are defined between inner recess sides of said projection ribs of one heat-exchanging plate and said flat surfaces of the other heat-exchanging plate.

12. The heat exchanger according to claim 11, wherein plural pairs of said heat-exchanging plates are laminated in a laminating direction to be bonded.

13. The heat exchanger according to claim 12, wherein:

said heat-exchanging plates have a tank portion, at both ends in a flow direction of the inside fluid in said heat-exchanging plates; and said inside fluid passages provided in plural pairs of said heat-exchanging plates communicate with each other through said tank portion.

14. The heat exchanger according to claim 13, wherein:

said inside fluid passages are divided into two inside fluid passage groups in a flow direction of the outside fluid; and said tank portion has both tank members in the flow direction of the outside fluid respectively at the both ends of said heat-exchanging plates to correspond to said two inside fluid passage groups.

15. The heat exchanger according to claim 12, wherein:

said heat-exchanging plates include two tank portions having communication holes at one end thereof in a flow direction of the inside fluid;

said two tank portions are arranged in a flow direction of the outside fluid so that said inside fluid passages in each pair of said heat-exchanging plates communicate with each other through said two tank portions; and each pair of said heat-exchanging plates includes a U-turn portion at the other end thereof in the flow direction of the inside fluid, through which the inside fluid U-turns.

16. The heat exchanger according to claim 1, wherein:

said heat-exchanging plates are laminated to form a laminating body; and said laminating body has a rectangular parallelopiped portion, and a triangular protrusion portion protruding outside from said rectangular parallelopiped portion.

17. The heat exchanger according to claim 1, wherein in each of said heat-exchanging plates, each projection rib continuously extends in a direction crossing relative to a flow direction of the outside fluid.

18. The heat exchanger according to claim 1, wherein:

each of said projection ribs is formed into a rectangular shape having a width narrower than a predetermined width and a length larger than a predetermined length; and said projection ribs are arranged to prevent the outside fluid from flowing straightly.

19. The heat exchanger according to claim 18, wherein said projection ribs are arranged to cross diagonally relative to a flow direction of the outside fluid.

20. The heat exchanger according to claim 18, wherein said projection ribs are arranged in a direction perpendicular to a flow direction of the outside fluid.

21. The heat exchanger according to claim 18, wherein said projection ribs are divided into a first projection rib group in which the projection ribs are arranged perpendicularly to a flow direction of the outside fluid, and a second projection rib group in which the projection ribs are arranged in parallel with the flow direction of the outside fluid.

22. The heat exchanger according to claim 1, wherein each pair of said heat-exchanging plates are integrated to form an integrated plate having therein a through hole for forming said inside fluid passages.

23. The heat exchanger according to claim 22, further comprising:

a tank member formed separately from said heat-exchanging plates; wherein:

plural said integrated plates are laminated in a laminating direction; and said tank member is connected to said integrated plates so that said inside fluid passages communicate with each other through said tank member.

24. The heat exchanger according to claim 23, further comprising:

a spacer member formed separately from said heat-exchanging plates, wherein said spacer is disposed between adjacent said integrated plates to have a predetermined distance therebetween.

25. The heat exchanger according to claim 23, further comprising a connection member for connecting said integrated plates to have a predetermined clearance between adjacent said integrated plates.

26. The heat exchanger according to claim 22, wherein each integrated plate having said through hole is formed by an extrusion.

27. The heat exchanger according to claim 1, wherein:

the inside fluid is refrigerant of a refrigerant cycle; and the outside fluid is air.

28. The heat exchanger according to claim 1, wherein said heat-exchanging plates are integrally formed by an extrusion.

29. The heat exchanger according to claim 1, wherein:

each of said heat-exchanging plates is composed of an aluminum core layer, a brazing layer clad on one surface of said aluminum core layer, and a sacrifice corrosion layer clad on the other surface of said aluminum core layer; and each pair of said heat-exchanging plates are connected by bonding said flat surfaces to each other through brazing using said brazing layer.

30. The heat exchanger according to claim 29, wherein:

said heat-exchanging plates have tank portions at an end side in an extending direction of said projection ribs, said tank portions protrude from said flat surfaces to the same direction as a protrusion direction of said protrusion ribs to form communication holes;

in a laminating direction of said heat-exchanging plates, said inside fluid passages communicate with each other through said communication holes of said tank portions;

said tank portions have exposed portions exposed outside around said communication holes; and said tank portions are bonded to each other in said heat-exchanging plates by using said brazing layer in said exposed portions.

31. The heat exchanger according to claim 1, wherein:

said projection ribs extend in an up-down direction approximately perpendicular to a flow direction of the outside fluid;

said inside fluid passages are partitioned into a first inside fluid passage group and a second inside fluid passage group in the flow direction of the outside fluid;

said heat-exchanging plates have tank portions at an end side in an extending direction of said projection ribs, said tank portions protrude from said flat surfaces to form communication holes;

said tank portions are partitioned into a first tank member, and a second tank member at an upstream side of said first tank member in the flow direction of the outside fluid, said first tank member communicating with said first inside fluid passage group and said second tank member communicating with said second inside fluid passage group; and said first tank member has a dimension in the up-down direction smaller than that of said second tank member.

32. A heat exchanger for performing a heat exchange between an inside fluid and an outside fluid, the heat exchanger comprising:

plural pairs of heat-exchanging plates each having a plurality of projection ribs, each pair of said heat-exchanging plates facing each other in such a manner that, said projection ribs protrude outwardly to form therein an inside fluid passage through which the inside fluid flows, and to form an outside fluid passage through which the outside fluid flows between adjacent pairs of said heat-exchanging plates, wherein:

said projection ribs protrude from flat surfaces of said heat-exchanging plates to said outside fluid passage to disturb a flow of the outside fluid; and said projection ribs are provided in each of said heat-exchanging plates to have a protrusion pitch (P1) between adjacent projection ribs, said protrusion pitch being in a range of 2–20 mm;

said projection ribs extend in a direction approximately perpendicular to a flow direction of the outside fluid;

said inside fluid passages are partitioned into a first inside fluid passage group and a second inside fluid passage group in the flow direction of the outside fluid;

each pair of said heat exchanging plates have an inner leakage-detecting projection rib between said first inside fluid passage group and said second inside fluid passage group in the flow direction of the outside fluid, said inner leakage-detecting projection rib extending along said projection ribs; and said inner leakage-detecting projection rib has therein an inner leakage-detecting passage opened to an outside.

33. A heat exchanger for performing a heat exchange between an inside fluid and an outside fluid, said heat exchanger comprising:

plural pairs of heat-exchanging plates each having a plurality of projection ribs extending in an extending direction approximately perpendicular to a flow direction of the outside fluid, each pair of said heat-exchanging plates facing each other in such a manner that said projection ribs protrude outwardly to form therein inside fluid passages through which the inside fluid flows, and to form an outside fluid passage through which the outside fluid flows between adjacent pairs of said heat-exchanging plates, wherein:

said projection ribs protrude from flat surfaces of said heat-exchanging plates to said outside fluid passage to disturb a flow of the outside fluid;

said inside fluid passages are partitioned into a first inside fluid passage group and a second inside fluid passage group in the flow direction of the outside fluid;

each pair of said heat exchanging plates have an inner leakage-detecting projection rib between said first inside fluid passage group and said second inside fluid passage group in the flow direction of the outside fluid, said inner leakage-detecting projection rib extending along said projection ribs; and said inner leakage-detecting projection rib has therein an inner leakage-detecting passage opened to an outside.

* * * * *